US006137044A

United States Patent [19]

Guilmette et al.

[11] Patent Number: 6,137,044

[45] Date of Patent: Oct. 24, 2000

[54] SOUND SYNTHESIZER SYSTEM FOR PRODUCING A SERIES OF ELECTRICAL SAMPLES

[75] Inventors: Pierre Guilmette, Levis; Serge Didier Glories, Sainte-Foy, both of Canada

[73] Assignee: Giisi Inc., Levis, Canada

[21] Appl. No.: 09/404,679

[22] Filed: Sep. 23, 1999

[30] Foreign Application Priority Data

Sep. 23, 1998 [FR] France ..... 98 11871

[51] Int. Cl.[7] ..... G10H 7/10

[52] U.S. Cl. ..... 84/603; 84/604; 84/625

[58] Field of Search ..... 84/603–607, 622–625

[56] References Cited

U.S. PATENT DOCUMENTS 4,133,241 1/1979 Niimi et al. .

5,553,011 9/1996 Fujita .

5,792,970 8/1998 Mizobata .

FOREIGN PATENT DOCUMENTS 0235538 1/1987 European Pat. Off. .

*Primary Examiner*—Stanley J. Witkowski

[57] ABSTRACT

During a succession of working cycles, a sound synthesizer system for obtaining at an output a series of electrical samples produces first level samples from zero level samples which can come from diverse sources. The samples are produced allowing for parameters such as the frequency, amplitude, phase or a filter coefficient. All of the data used in establishing samples is processed in cells materialized by locations of a plurality of memories. The content of the cells can evolve from one working cycle to the other and data calculation means are used on a timesharing basis for all the cells. The first level samples can be selectively combined to form second level samples before they are transferred to an output.

31 Claims, 38 Drawing Sheets

CLK
2
3
Q0
Q1
Q2
3-BIT COUNTER
CCAL
DECO-DER
D0
D1
D2
C0
C1
C2
C3
C4
C5
C6
C7
4
P2_AMP
P2_FRE
P2_PHA
P2_FLT
P3
P4
5
P1
6
PCPU
S-R FLIP-FLOP
Q
7
8
CPU WAIT
Reset
Set
16
ACT
10
CELL ADDRESS
AC
Adr.Cell
ACPU
SEL
11
Adr.Base
Adr.CPU
n-BIT COUNTER
Qn
9
To Fig 2B PHA
A
ADDER
A + B
B
U7
POS_X
35
MUX
Sel A
INIT_X
Output
Sel B
36
BISTABLE
Input
Data
Output
Data
Sel
CD_INIT
U6
P3
Write
A + B
ADDER
A
B
M5
MEMORY
(192)
Input
Data
Output
Data
AC
P4
Address
30
To Fig. 7B 60
Sortie_0
ACC_ENS
ACT
C_ENS
U11-0
63-0
A
ADDER
A + B
B
BISTABLE
Input
Data
Output
Data
62-0
Bit_0
P4
Write
Erase
Sortie_1
U11-1
63-1
A
ADDER
A + B
B
BISTABLE
input
Data
Output
Data
62-1
Bit_1
P4
Write
Erase
To Fig. 11B To Fig.12C
25

BIT 4
BIT 5
BIT 8
BIT 6
BIT 7
BX4
BIT 8
ACC_DET
BX5
BIT 4
BIT 5
BIT 8
BIT 6
BIT 7
BX6
ACC_ENS
25
0000
25a
To Fig.12A

BIT 7
BIT 8
DATA_CTR
25
BIT 6
BIT 8
BIT 7
ACC_CEL
BIT 4
BIT 5
BX1
BIT 8
BIT 6
BIT 7
IN_CEL
BIT 4
BX2
BIT 5
BIT 8
BIT 6
BIT 7
BX3
25a
To Fig.12B

| Fig. 14A | Fig. 14B |
|---|---|

M18
MEMORY
DCPU
Read
Input
Data
Output
Data

W_FLT_COEF
R_FLT_COEF
Address
Read
Write
COEF
162
165
MUX
ACPU
Sel A
Output
Sel B
Sel
M17
MEMORY
Input
Data
Output
Data
Address
Read
Write
W_FLT_COEF
R_FLT_COEF
163
To Fig. 19B C_INIT
CD_INIT
INIT_X
208
192
BUFFER
Input
Output
Activate
196
186
=0000
To Fig. 20B
SC_ECH/SC_ETR
180
181
SC_ECH
SC_ETR
182
COMPAR.
A
B
B<=A
MOD_CCY
MOD_DCY
MOD_ALT
E_DEB
M19
MEMORY
(192)
Read
Input
Data
Output
Data
Address
Read
Write
POS_X
DCPU
AC
R_ECH_FIN
W_ECH_FIN

SOUND SYNTHESIZER SYSTEM FOR PRODUCING A SERIES OF ELECTRICAL SAMPLES

BACKGROUND OF THE INVENTION

1. Field of the Invention

The present invention relates to a sound synthesizer system for producing a series of electrical signals which, after digital/analog conversion, can be applied to one or more transducers to produce an audible spectrum.

The invention concerns more particularly, although not exclusively, a sound synthesizer system of the type indicated above which can be used with the aid of a plug-in card which can be inserted into a personal computer to confer on it a very extensive and varied capacity to produce sounds.

2. Description of the Prior Art

The units most widely used at present to synthesize sound are known as "Wave Table" or "FM" units. In the "Wave Table" unit the sound is synthesized with the aid of groups of sound samples prestored in a rigid manner in a memory on any known recording medium, internal or external to the device.

In its simplest form, a "FM" unit uses two oscillations, one of which is a carrier which is frequency modulated by the other oscillation. This principle enables more complex oscillations to be generated by a limited number of oscillations. The signal obtained depends on the frequency ratios and on the amplitude of the modulating signals. The harmonics are the sidebands of the frequency modulation. These products have an equidistant frequency ratio proportional to the ratio between the modulating frequency and the carrier frequency. The amplitude of the modulatng signal determines the number of harmonics. The amplitudes of the harmonics produced cannot be determined freely and they follow a figure resembling an interference curve.

This means that "Wave Table" and "FM" units of the above type have the drawback of offering very little flexibility in terms of the modalities of composition of the final sound spectrum, the parameters characterizing the successive samples (amplitude, frequency and phase, in particular) being for the most part predefined without possibility of modification.

Also, these current sound synthesizer units operate with a computer, often a personal computer, and require frequent intervention by the computer. Being mobilized for this task continuously during the process of composition, processing and audio output, the computer cannot take care of housekeeping tasks, for example imaging or data acquisition tasks, other than those devoted to processing the data.

Finally, these prior art units are not very user-friendly and therefore do not lend themselves well to applications in multimedia installations which are currently expanding hugely among consumers.

The aim of the invention is to provide a sound synthesizer system which is free of the drawbacks of the prior art units briefly described above.

SUMMARY OF THE INVENTION

The invention therefore consists in a system for synthesizing a series of electronic samples for producing a sound spectrum appearing at an output, said system comprising:

first means for determining a succession of working cycles timed in accordance with a sampling frequency;

at least one source of zero level samples representing at least one sound signal and adapted to provide in each working cycle x in progress at least one zero level sample, second means for determining, for each of said zero level samples to be selected during a next working cycle x+1, a first value of a frequency parameter appropriate to that sample, third means for determining, for each of said zero level samples to be processed during a next working cycle x+1, at least one second value of at least one other parameter, also appropriate to that sample, at least two parameters memories for respectively memorizing said first and second parameter values during the current working cycle x at n respective memory locations so that said values can be used during the next working cycle x+1, fourth means for determining during each current working cycle x and as a function of each of the n frequency parameter values stored during the preceding working cycle x−1, a designation value for designating among said zero level samples the zero level sample(s) which during the next working cycle x+1 will contribute to producing n respective first level samples, a designation value memory for storing said n designation values determined during the current working cycle x so that they can be used during the next working cycle x+1, fifth means for applying to each of the zero level samples designated during the preceding working cycle x−1, during the current working cycle x, the corresponding value of said other parameter stored during the preceding working cycle x−1, to form n current first level samples and to store them in n respective locations of an accumulation memory, and sixth means for transferring to said output during the current working cycle x the n first level samples stored in memory during the preceding working cycle x−1, the n memory locations of said parameter memories, said designation value memory and said accumulation memory respectively providing n cells whose content can be modified from one working cycle to the other.

As a result of the above features, each sample of the sound spectrum produced can be composed in real time with a very great variety of intrinsic properties, and without this requiring much memory space or hardware.

In accordance with another essential feature of the invention, said first, second, third, fourth, fifth and sixth means are used on a timesharing basis during successive working cycles to determine the values relating to said cells in said parameter, designation value and accumulation memories.

In this way, most of the circuits of the synthesizer system can be used on a timesharing basis to create at its output the various sound production channels. As a result of this, the synthesizer system has a very simple structure.

Other features and advantages of the invention will become apparent in the course of the following description which is given by way of example only and with reference to the accompanying drawings.

BRIEF DESCRIPTION OF THE DRAWINGS

FIG. 8, 8A, 8B and 8C are a circuit for allocating sound samples from the first level to circuits of the downstream synthesizer unit.

FIG. 12 and 12A–C are a simplified diagram showing how the parameters generated in the circuits shown in FIGS. 5 and 6 can be used to influence the production of samples as a function of a plurality of sound signal sources, either internal or external to the system in accordance with the invention.

FIG. 13, 13A and 13B are a diagram of a circuit for selecting operating modes of the system of the invention.

FIG. 14, 14A and 14B are a diagram of a circuit for generating first level samples from zero level samples produced in the synthesizer unit and adapted to generate a plurality of sound signal waveforms.

FIGS. 18, 18A and 18B are a diagram of a circuit for analyzing input signals in order to determine parameters characterizing first level samples generated from zero level samples originating from external sound signals.

DETAILED DESCRIPTION OF THE PREFERRED EMBODIMENTS

Figure 1:
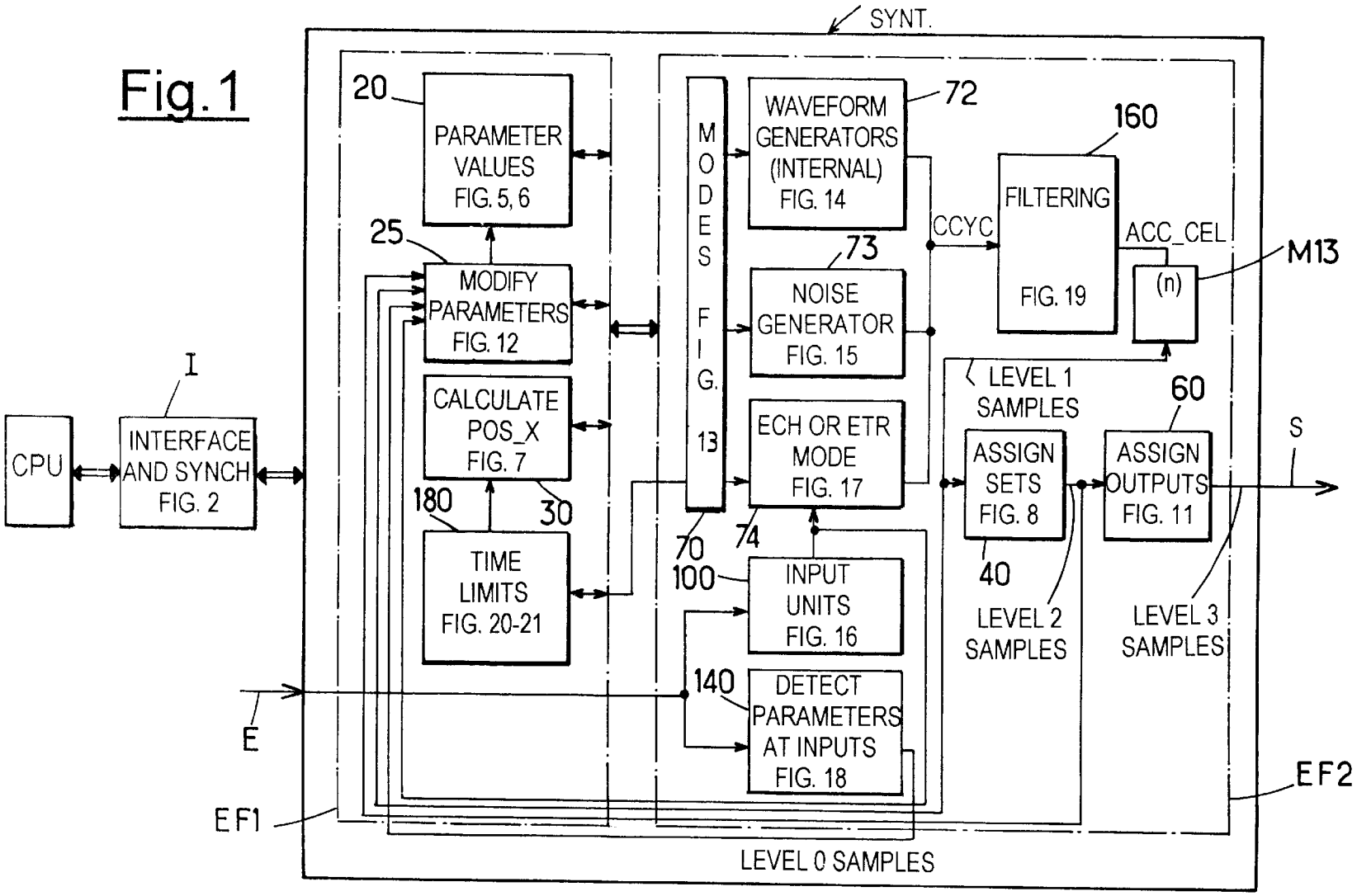
FIG. 1 is an overall block diagram of the synthesizer system of the invention.

FIG. 1 is a symbolic diagram showing in the form of functional units the main circuits of the sound synthesizer system of the invention. It shows that the system comprises three basic units one of which is a control unit in the form of a computer CPU. This unit can be a personal computer running a sound synthesizer program, stored on diskette for example, and running under any of the usual operating systems, for example "Windows"™. The control unit can be any other device capable of executing a program dedicated to controlling the system in accordance with the invention.

The CPU is connected to a functional interface I which handles the exchange of messages between the CPU and a synthesizer unit SYNT and times all the sound synthesis operations that are carried out in the unit SYNT. The latter delivers the required sound signal at an output S.

As also shown in FIG. 1, the synthesizer unit SYNT comprises a number of hardware functional blocks described in detail hereinafter with reference to the figures, the figure covering each of the blocks being indicated in that block. Note that, broadly speaking, the unit SYNT comprises two main functional systems EF1 and EF2, within the chain-dotted frames, and essentially responsible for establishing parameters defining the characteristics of the sound samples to be produced and using the parameters by applying them to zero level samples to generate higher level samples. Furthermore, to facilitate understanding of the invention, each block contains a key word or expression to designate its overall function.

Figures 2, 2A, 2B, 2C:
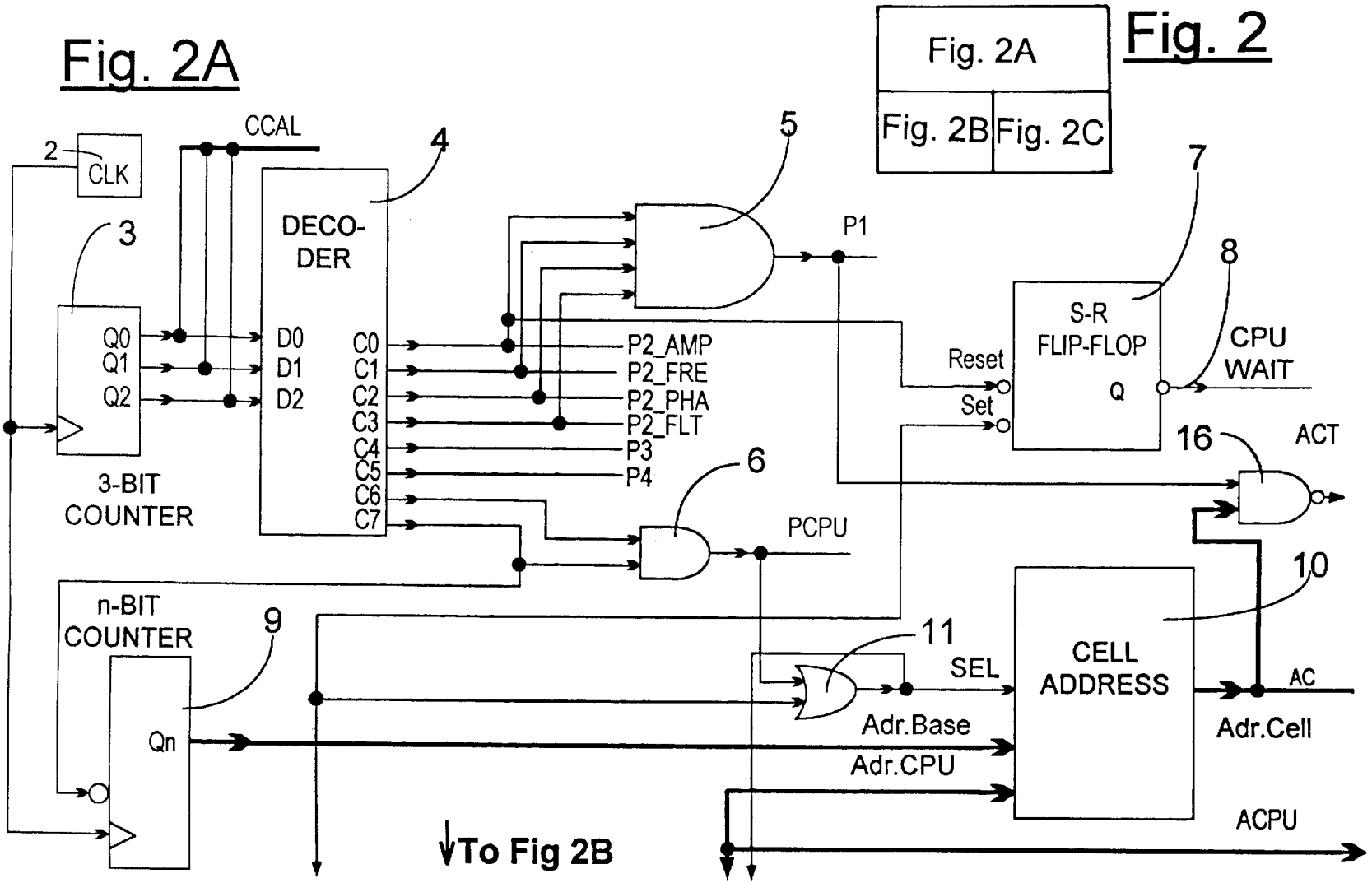
FIG. 2 and 2–C are diagrams of the interface for exchanging messages between a management unit and a sound synthesizer unit and for timing operations carried out in the synthesizer unit.
Figure 2B:
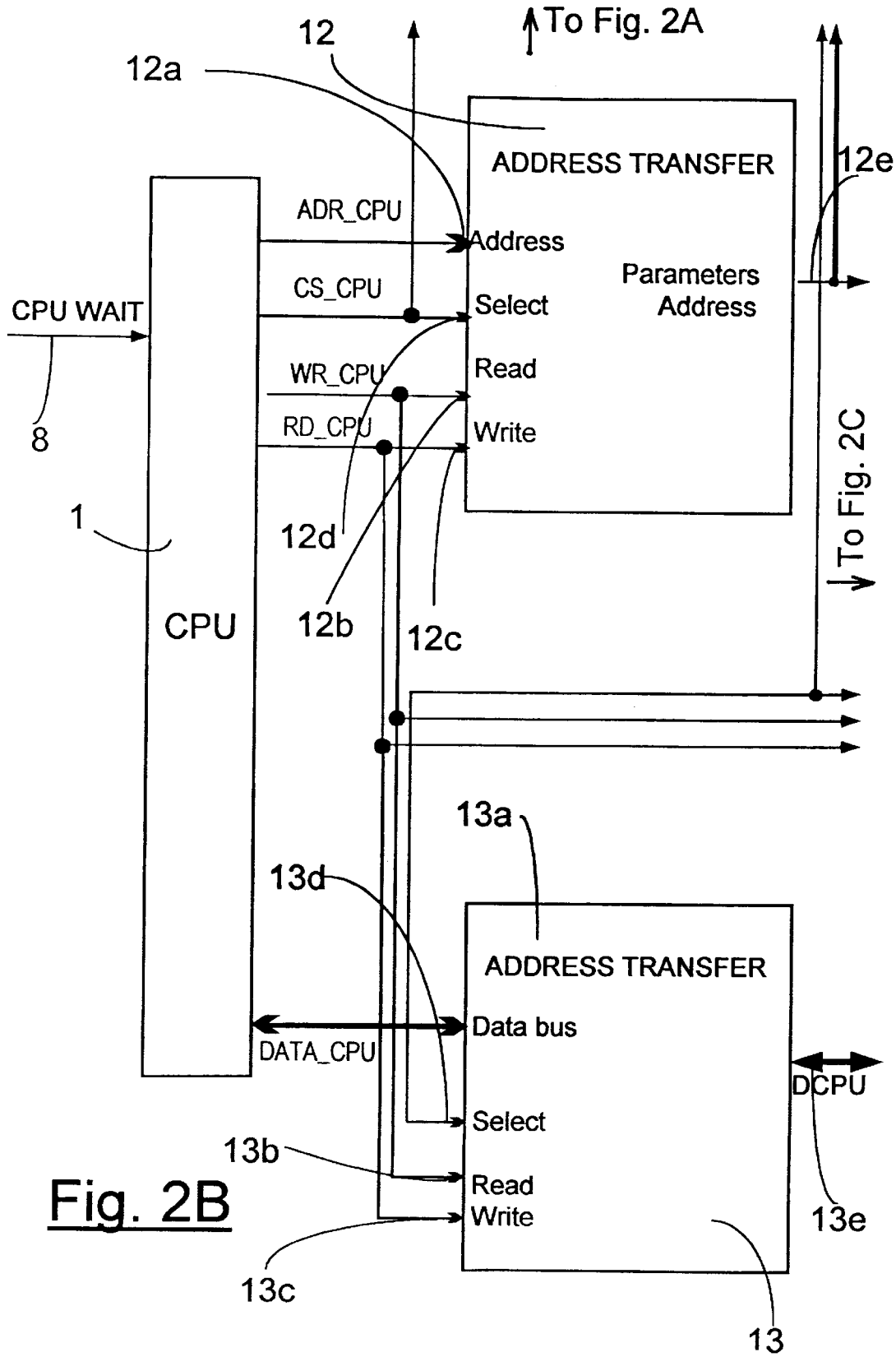
Figure 2C:
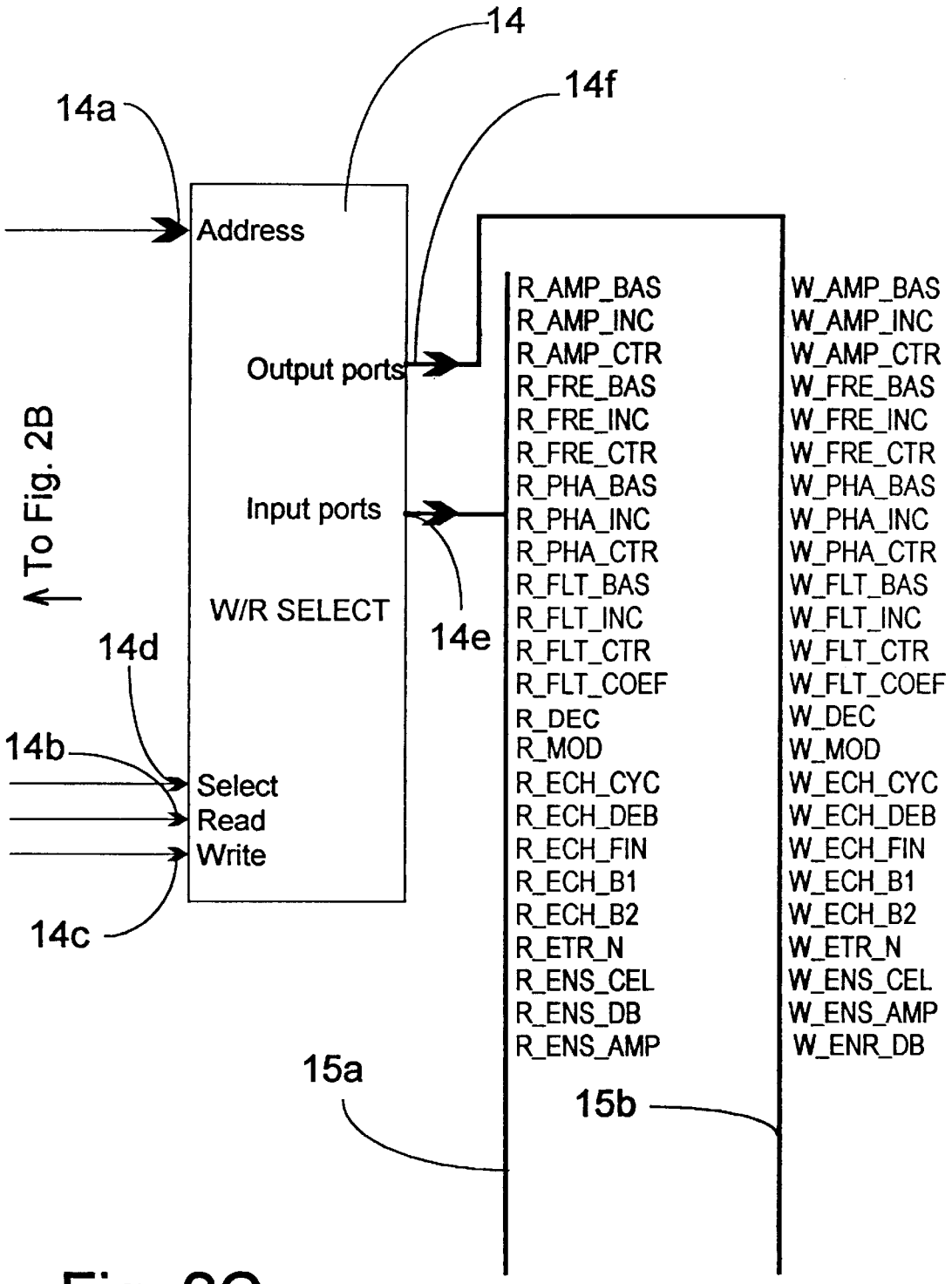
Figure 3:
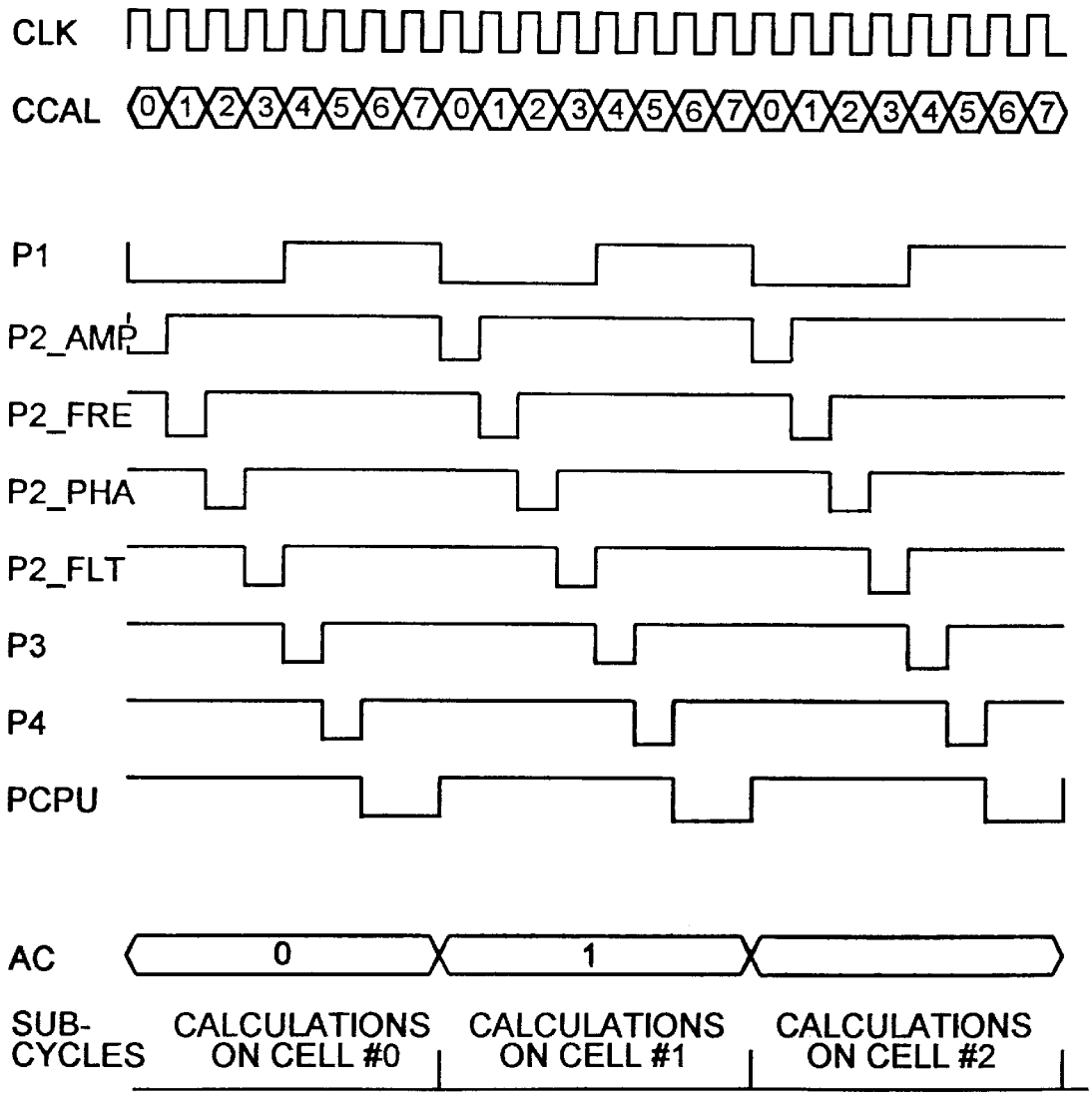
FIGS. 3 and 4 are a timing diagram of signals appearing in the interface from FIG. 2, the time scale in FIG. 3 being smaller than that in FIG. 4.
Figure 4:
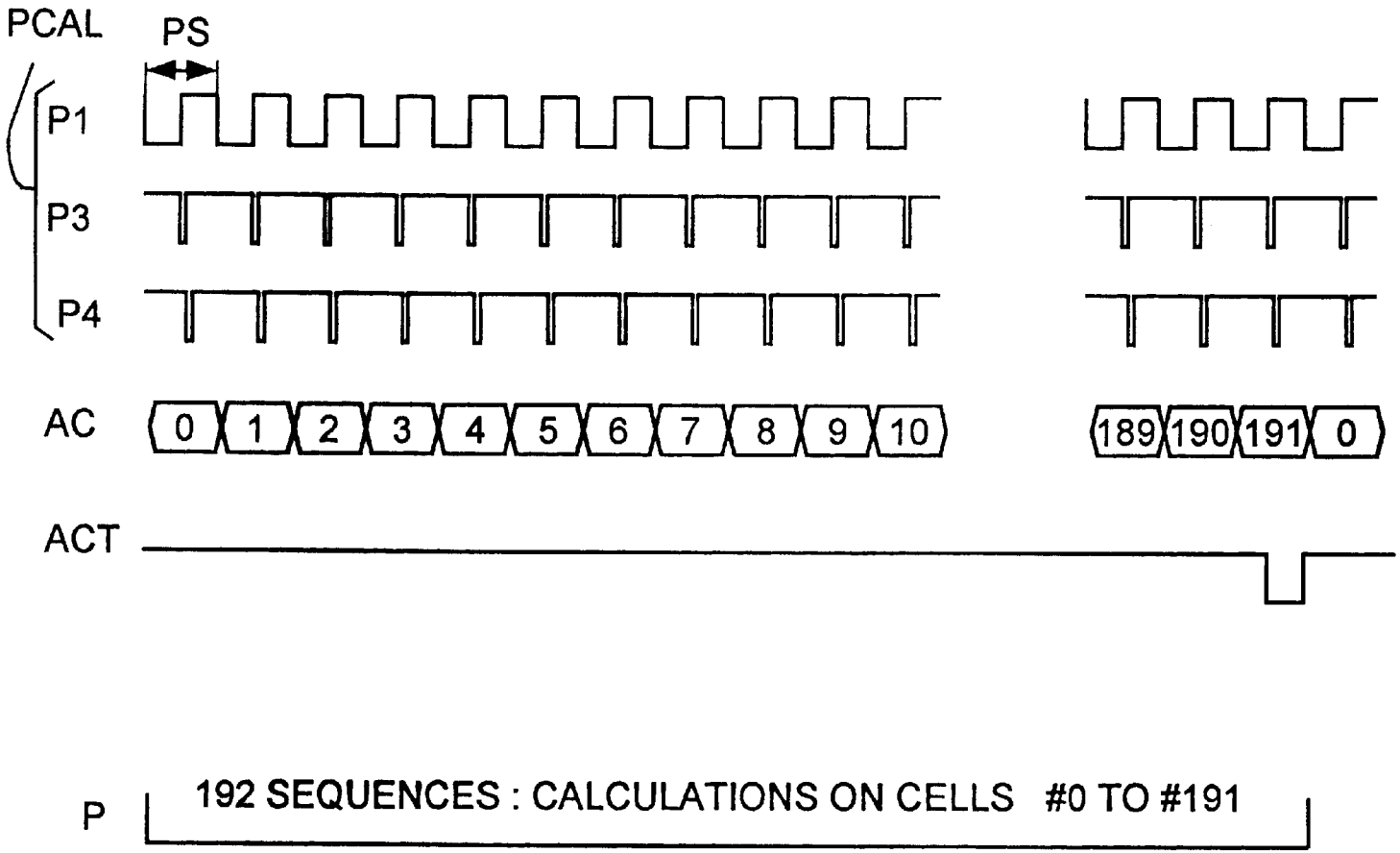

FIG. 2 is a symbolic diagram of the interface I of the sound synthesizer system of the invention, in which the CPU is symbolized by the rectangle 1. The signals generated in the interface I are shown in FIGS. 3 and 4, the scale of FIG. 3 being smaller than that of FIG. 4.

The interface I includes a quartz crystal oscillator 2 which supplies a basic clock signal CLK (see FIGS. 3 and 4 for the waveforms of the signals and their time relationships) to a three-bit binary counter 3. The three outputs Q0, Q1 and Q2 of the counter 3 constitute a signal CCAL described below and are fed to a binary decoder 4 decoding the 3-bit signal applied to it on eight outputs C0 to C7. The outputs C0 to C3 of the decoder 4 time four sub-periods P2_AMP, P2_FRE, P2_PHA and P2_FLT of a period P1 which is timed by an AND gate 5.

In this description, a "calculation sequence" PCAL is a cycle involving the signal P1 combined with the signals P3 and P4, to the exclusion of a signal PCPU which in each time period P1 determines the access time authorized for the unit CPU. The signal PCPU is the "access cycle" signal.

The outputs C4 and C5 of the decoder 4 respectively time the sub-periods P3 and P4 and the outputs C6 and C7 are connected to an AND gate 6 which times the sub-perod PCPU. It should be noted that the period P1 and the sub-periods P3, P4 and P2_AMP, P2_FRE, P2_PHA and P2_FLT in fact all have the same duration, but that the time slots in which they determine an activity in the unit SYNT are fixed by the duration of their low level in each period. These periods at the low level will therefore be designated "active pulses" in what follows, the active pulses being phase-shifted relative to each other in the various sub-periods.

The output CO of the decoder 4 is also fed to the reset input of an S-R flip-flop 7 to whose SET input is applied a signal CS_CPU from the CPU and representing CPU access requests. This flip-flop periodically supplies a signal ATTENTE_CPU to a terminal 8 to put the CPU in a wait state at the time of a request expressed by a signal CS_CPU and for the cumulative duration of the active pulses of the sub-periods P2_AMP, P2_FRE, P2_PHA, P2_FLT, P3 and P4. During active pulses of signal PCPU, the CPU is authorized to transmit addresses, data and readfwrite commands to the synthesizer unit SYNT. It can also receive data during active pulses of sub-periods PCPU.

The oscillator 2 is also connected to a n-bit binary counter 9, where $2^n$=N is the number of cells in the synthesizer unit SYNT, the meaning of the term "cell" being explained hereinafter.

In the example described, we have chosen N=192, although other numbers of cells are possible. The counter 9 is controlled by the signal C7 from the decoder 4, which causes it to be advanced by one unit on completion of each period P1, and is synchronized to the signal CLK from the clock 2. Its output Qn delivers a cell base address ADR_BASE to a cell address selector block 10 to determine the succession of basic addresses of the cells (0 through 191 in the example).

During sub-period PCPU (FIG. 3), the CPU can communicate via the interface I with the unit SYNT. To this end, the output PCPU of the AND gate 6 and the access request signal CS_CPU are fed to an OR gate 11 whose output can activate a signal SEL for selecting the block 10. The logic state of this signal selectively determines whether the output of the counter 9 constitutes the address of the active cell at a given time or the control program running in the CPU provides this address. In the former case, the output of the counter 9 is passed from the input ADR_BASE of the block 10 to the shared output AC (instantaneous cell address) of this block. In the latter case, the signal SEL activates two interface blocks 13 and 14.

Note that the cells of the unit SYNT are in fact materialized fleetingly during successive sequences PCAL (made up of signals P1, P3 and P4—see FIG. 4) for preparing "first level" samples. These sequences PCAL together constitute a cycle P during which the calculations for the first level samples are performed successively for all the cells. In the example, one such cycle P therefore represents 192 successive sequences PCAL, the cycle P being executed at the sound synthesizer sampling frequency, for example 44.1 kHz. This is the frequency of the signal ACT also shown in FIG. 4.

It is shown below that, in accordance with an important feature of the invention, the cells are materialized by fleetingly and cyclically storing calculated cell data at memory locations of a plurality of hardware memories in the unit SYNT allocated to calculation and/or control functions. Each of these memories has as many locations as there are cells in the unit SYNT. If necessary, addresses or data can also be selectively written at the memory locations concerning the respective cells from the CPU during the sub-period PCPU following each sequence PCAL.

Thus, for cell N° 0, for example, during sequences PCAL in which it is activated, the memories in question can receive information concerning it in order to store that information at their storage location having the address 0 or to deliver the data to their output so that the data can be processed subsequently. Then, during the next PCAL sequence, the same operations or other, similar operations can be carried out for cell 1 at memory locations having the address 1, and so on until cell N° 191 has been processed, after which the process begins again with cell N° 0.

The memories can be loaded (written), read and unloaded in various ways, in particular by the CPU 1. In other words, at the end of each sequence PCAL represented in FIG. 4, and delimited in time between two pulses of the signal ACT, the unit SYNT materializes the 192 cells by means of the contents of the 192 memory locations dedicated to that task, each cell being "composed" of the locations of these memories with the same address. The content of each cell can vary or not from one cycle to the other, depending on the characteristics of the first level samples to be produced.

At this stage, it should be emphasized that because of this approach a great part of the unit SYNT can be used on a timesharing basis, which greatly economizes on hardware. Also, the sound samples to be generated can be composed from a plurality of sources and these can be mixed with great flexibility.

Blocks 13 and 14 respectively transfer to unit SYNT addresses, data and read/write commands, provided that these blocks are activated by the selection signal SEL from gate 11 and the output signal ATTENTE_CPU from flip-flop 7 is deactivated. This signal being active during the active pulse of the sub-period PCPU, the control program executed in the CPU can operate on the unit SYNT in such an extent as this program prescribes such action during the sequence PCAL concerned.

Block 12 can receive from the CPU at an input 12*a* addresses ADR_CPU, at an input 12*b* a read command signal RD_CPU, at an input 12*c* a write command signal WR_CPU and at an input 12*d* the selection signal CS_CPU. Output 12*e* of block 12 transfers address values to several destinations, namely block 10, memory read/write selection block 14 and other blocks of the unit SYNT, as described below.

Block 13 has an input 13*a* for receiving data from the CPU, a read command input 13*b*, a write command input 13*c* and an output 13*e* for transferring data to various elements of the unit SYNT, as described below. The transfer of data can be bidirectional.

Block 14 has an input 14*a* for receiving read/write addresses from block 12, a read command input 14*b* receiving the signal RD_CPU, a write command input 14*c* receiving the signal WR_CPU and a selection input 14d connected to the output of gate 11. This block also has outputs 14*e* and 14*f* respectively connected to a read command bus 15*a* and a write control bus 15*b*, these two buses selectively conveying respective read/write command signals to all the memories of the unit SYNT. The identifications of these signals are indicated in full in FIG. 2 and are shown at the corresponding places in the other figures yet to be described.

The output of gate 5 is combined logically with the output of address selection block 10 in a NAND gate 16 supplying the output signal ACT which is the sampling frequency of the unit SYNT.

Figures 5, 5A:
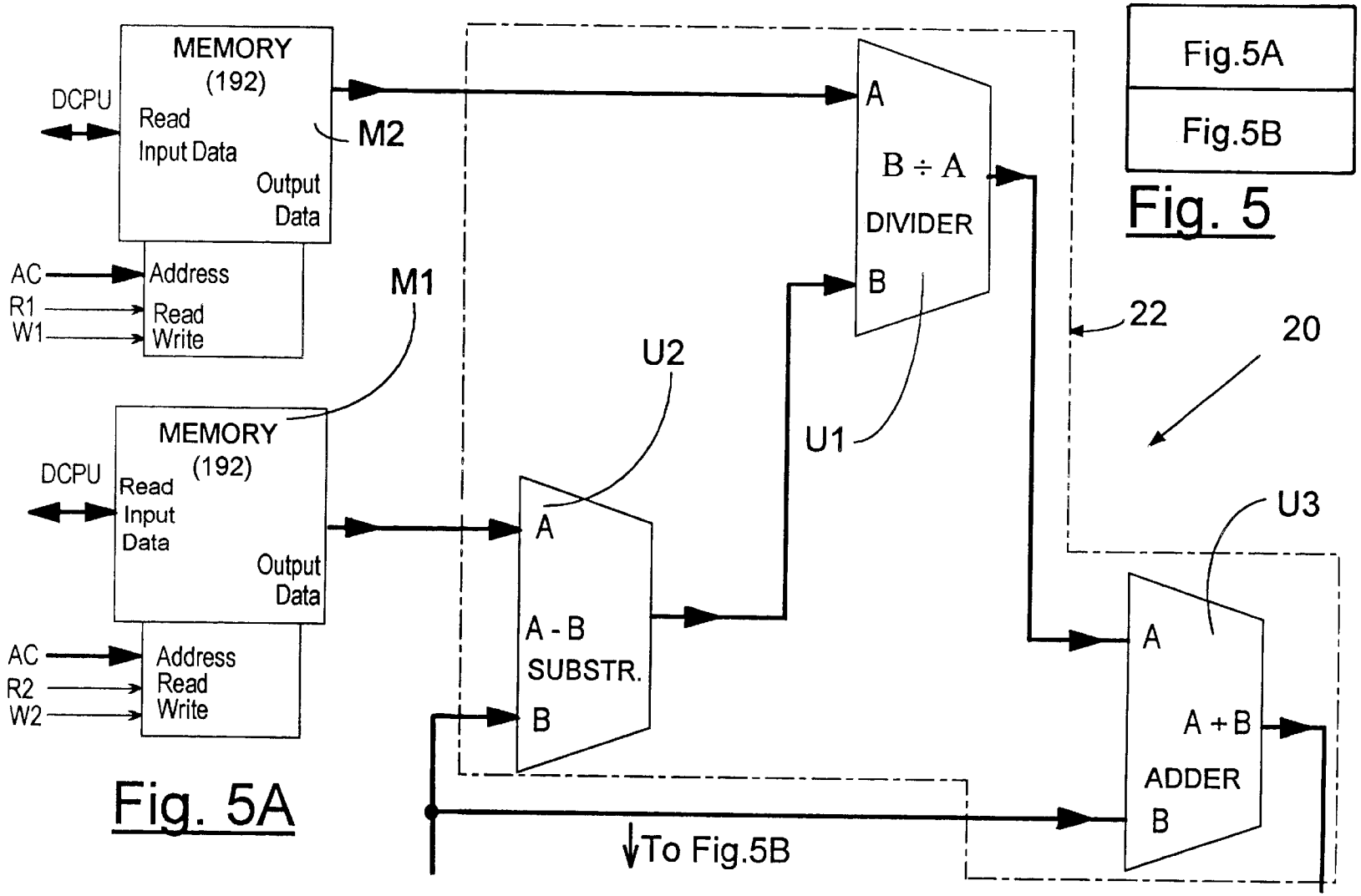
FIG. 5, 5A and 5B are diagrams of a circuit for producing a parameter determining one of the properties of the sound samples to be generated and belonging to the synthesizer unit of the invention.
Figure 5B:
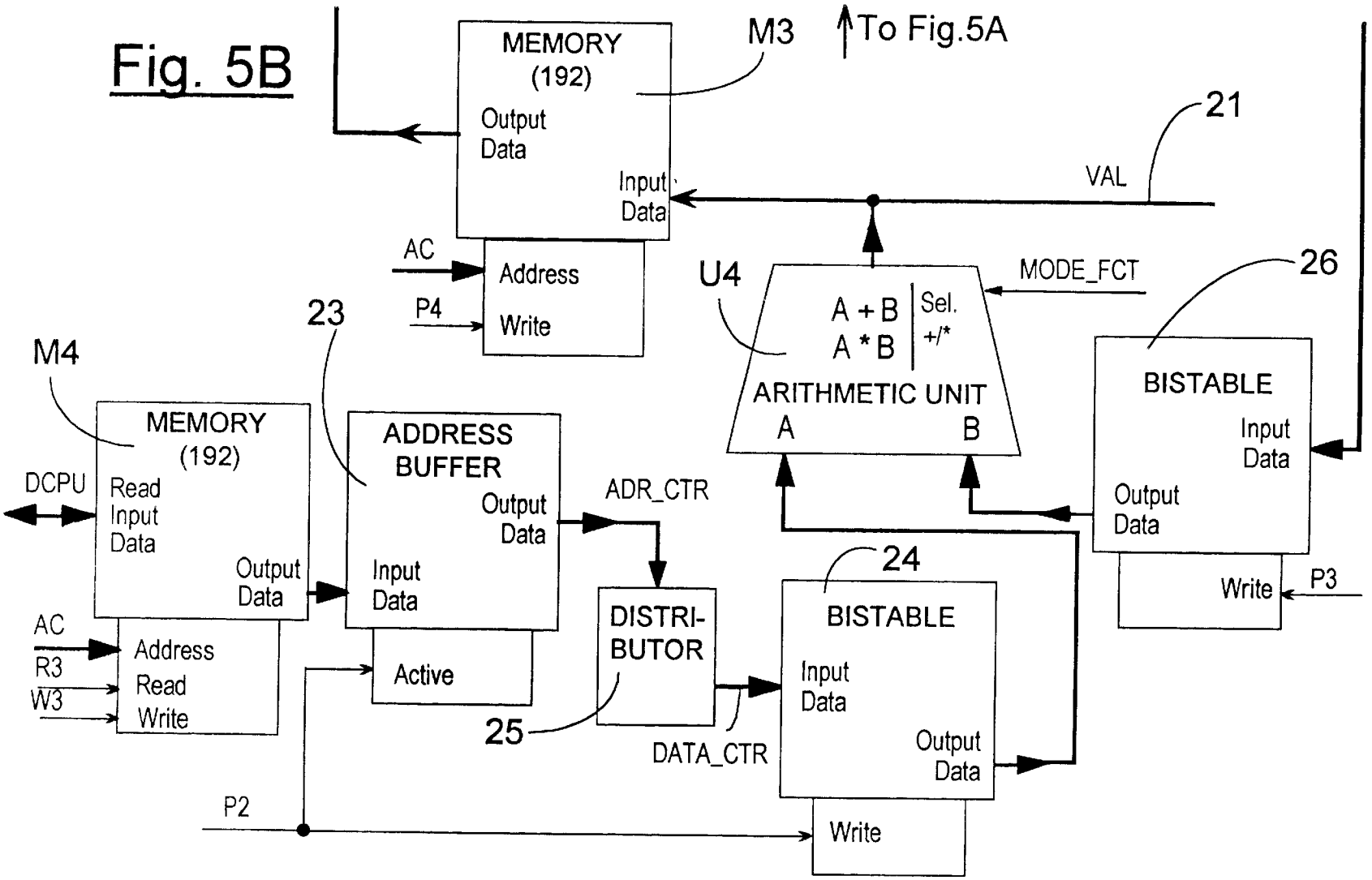

FIG. 5 shows a circuit 20 for generating parameter values. This circuit is part of the unit SYNT. Before describing it, it should first be pointed out that, as already mentioned, the unit SYNT comprises a plurality of memories, some of which are shown in FIG. 5. In all the diagrams of the SYNT unit described hereinafter, each memory is symbolized by a square with associated data inputs and/or outputs and a smaller rectangle with an associated address input, write command input and/or read command input. Also, the number of locations that the memory concerned has in the example under consideration is shown in each square.

Figures 6, 6A:
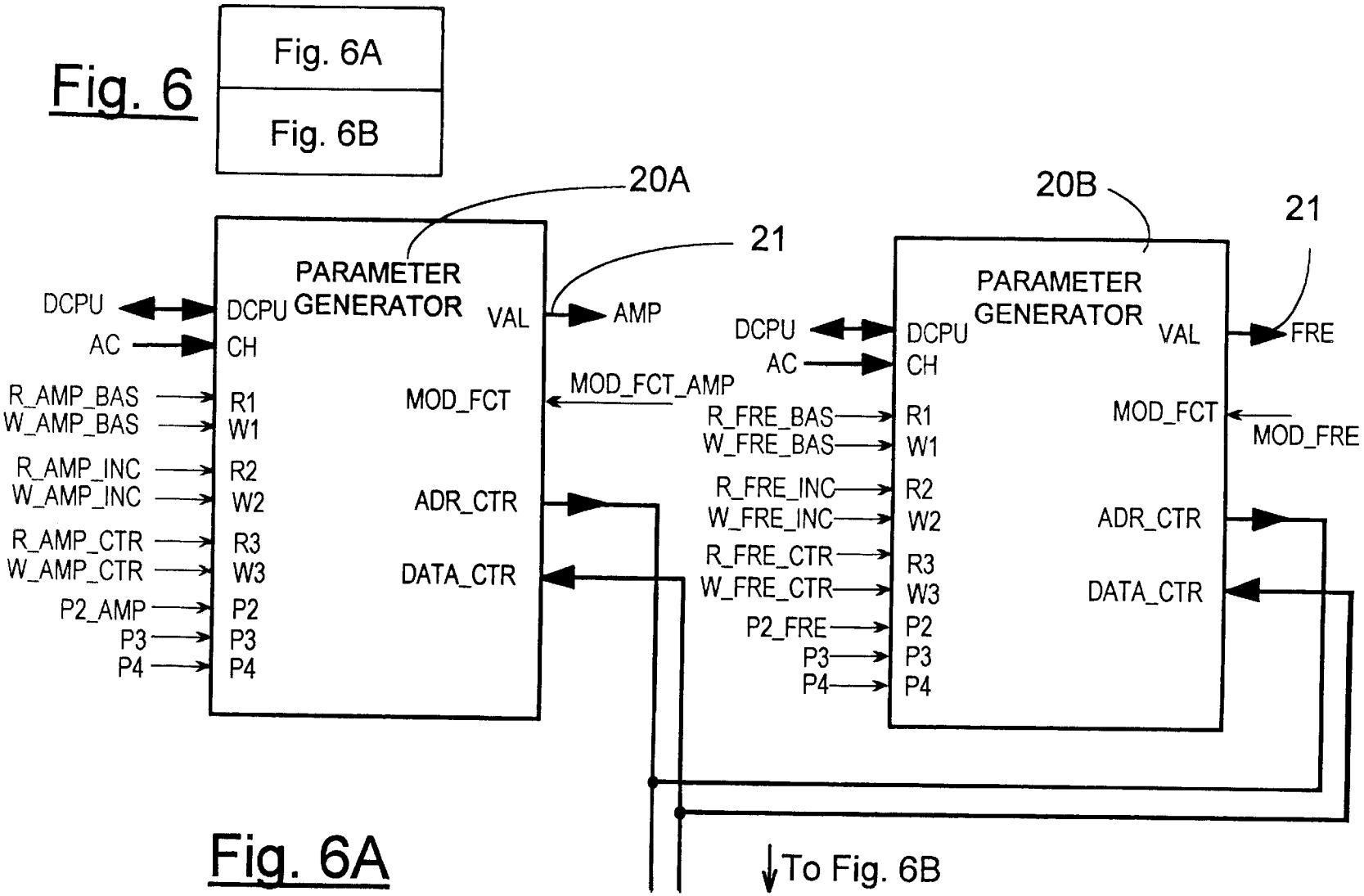
FIG. 6, 6A and 6B are diagrams showing how four circuits for generating a parameter as shown in FIG. 5 can be used to determine four parameters fixing the properties of the samples to be generated.
Figure 6B:
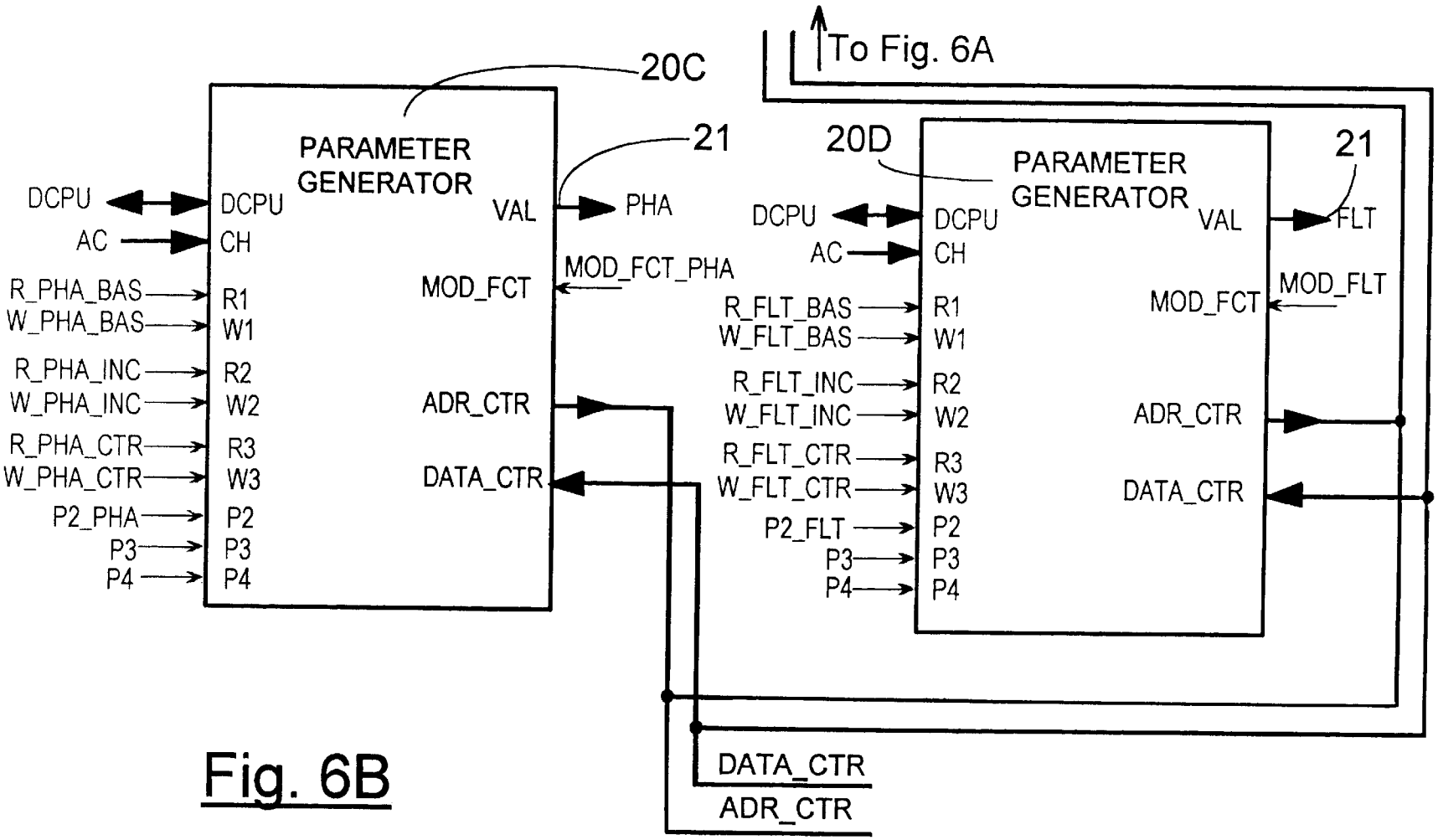

Note also that FIG. 5 shows the hardware of a circuit 20 for generating a parameter that is repeated four times in the unit SYNT (FIG. 6). In other words, during each sequence PCAL, to be more precise during the four active pulses of the sub-periods P2_AMP, P2_FRE, P2_PHA, P2_FLT, each circuit 20 (incorporated in blocks 20*a* through 20*d*, respectively) forms one of four parameters AMPLITUDE, FREQUENCY, PHASE or FILTER that can be allocated to calculating the first level samples. The corresponding parameter value VAL (respectively designated AMP, FRE, PHA and FLT) obtained after the active pulse of the respective sub-periods P2_AMP, P2_FRE, P2_PHA, P2_FLT appears at an output terminal 21 of circuits 20A to 20D. The corresponding amplitude, frequency, phase and filtering characteristics of the successive first level samples calculated for each cell are determined in this way.

This being so, each parameter generator circuit 20A to 20D includes a memory M1 in which can be stored, as appropriate, the basic value of the AMPLITUDE, FREQUENCY, PHASE or FILTER parameter of the cells. These values are received from the CPU via output 13*e* (FIG. 2) during active pulses of sub-period PCPU during which the CPU is authorized to access the unit SYNT.

A memory M2 stores increment values of the parameter where the parameter must be changed to generate a given sample relative to the same parameter of a sample previously generated. The increment value is also supplied by the CPU via output 13*e* of interface unit 13.

The outputs of memories M1 and M2 are fed to a calculator system 22 designed to implement the following calculation function:

$$PAR_{Pn} = \left[\frac{(PAR_{Pn} - PAR_{Pn-1})}{INC_{Pn}}\right] + PAR_{Pn-1}$$

in which PARPn is the current parameter value of the cell concerned during the current sequence PCAL or the initial parameter value, $PAR_{Pn-1}$ is the parameter value generated during the preceding PCAL sequence for that cell and $INC_{Pn}$ is the increment of the current value of the parameter relative to the preceding value. Note that this calculation can introduce automatic interpolation between different successive parameter values to attenuate jumps in value, if necessary.

Accordingly, the output of memory M2 is fed to a first arithmetic unit U1 which applies the operation B÷A to the variables A and B fed to it, the variable B being supplied by an arithmetic unit U2 which applies the operation A−B to its input variables A and B. The variable A of arithmetic unit U2 is each time the difference between the new value of the parameter stored in memory M1 and its current value in a memory or accumulator M3.

The result of the calculation done in arithmetic unit U1 is fed as variable A to another arithmetic unit U3 which applies the operation A+B to its input variables. The input variable B of arithmetic unit U3 comes from memory M3 which temporarily stores for each cell the parameter value $PAR_{Pn-1}$, i.e. the parameter value calculated during the preceding sequence PCALP. The data input of memory M3 is therefore connected to output 21 and its data output is connected to the input for variable B of calculation unit U2. The value $PAR_{Pn-1}$ has been written into memory M3 during the active pulse of sub-period P4 of the preceding sequence PCAL.

Other modifications can be made to a parameter during the process of its generation in the respective circuit 20A to 20D, namely by the part of the circuit shown in the bottom half of FIG. 5. This part includes a memory M4 with read/write command signals R3 and W3 where the amplitude, frequency, phase or filtering are concerned. If necessary, this memory stores a parameter value modification for one or more of the 192 cells according to the address signal AC. Its output is connected to an address buffer 23 whose input values can be passed to the output on command of the respective active pulse of sub-period P2_AMP, P2_FRE, P2_PHA or P2_FLT.

The values transmitted in this way through buffer 23 are fed to a distributor which selects one of a plurality of sources of parameter values for the generation of first level samples by the cells. Distributor 25 is described below with reference to FIG. 12. The signals corresponding to these parameter values are fed to a bistable 24 activated in write mode on the active pulse of the sub-period P2 concerned, according to the nature of the parameter to be modified. The output of bistable 24 is connected to input A of an arithmetic unit U4 which selectively performs a combinatorial calculation such as a sum or a product of values applied to its inputs. Input B of arithmetic unit U4 is connected to a bistable 26 whose input is connected to the output of arithmetic unit U3 and it is activated during the active part of sub period P3. As explained below, the selection of the arithmetic operation effected in unit U4 is commanded by the binary state of a mode command signal MODE_FCT.

The part of the circuit from FIG. 5 just described can apply vibrato to a synthesized sound, for example, by cyclically varying the frequency value of the samples of which the sound is formed.

FIG. 6 is a diagram showing the sets of input and output signals which are applied to, respectively produced by, the four circuits 20A to 20D each of which is identical to the parameter generator circuit 20 from FIG. 5.

Accordingly, block 20A is allocated to the AMPLITUDE parameter and blocks 20B, 20C and 20D are respectively allocated to the FREQUENCY, PHASE and FILTER parameters. The read and write signals R1/W1, R2/W2 and R3/W3 are fed to the memories M1, M2 and M4 from FIG. 5; they come respectively from the control buses 15*a* and 15*b* from FIG. 2. Each block is selectively timed during each PCAL sequence at the moment the active pulse of the corresponding sub-period is produced. Each block also receives input data on bus DCPU and the cell number or address signal AC (FIG. 2). The AMP,FRE,PHA and FLT outputs of each block are processed in other parts of the unit SYNT, as described below; likewise the signals at the remaining terminals of blocks 20A to 20D.

During a PCAL sequence at one of the cells, each corresponding first level sample must be formed from a zero level sample which must be specifically designated and extracted from one of the zero level sample sources. However, this zero level sample must also be allocated a time value so that it can contribute to generation of the first level sample to which it will belong.

Figures 7, 7A, 7B:
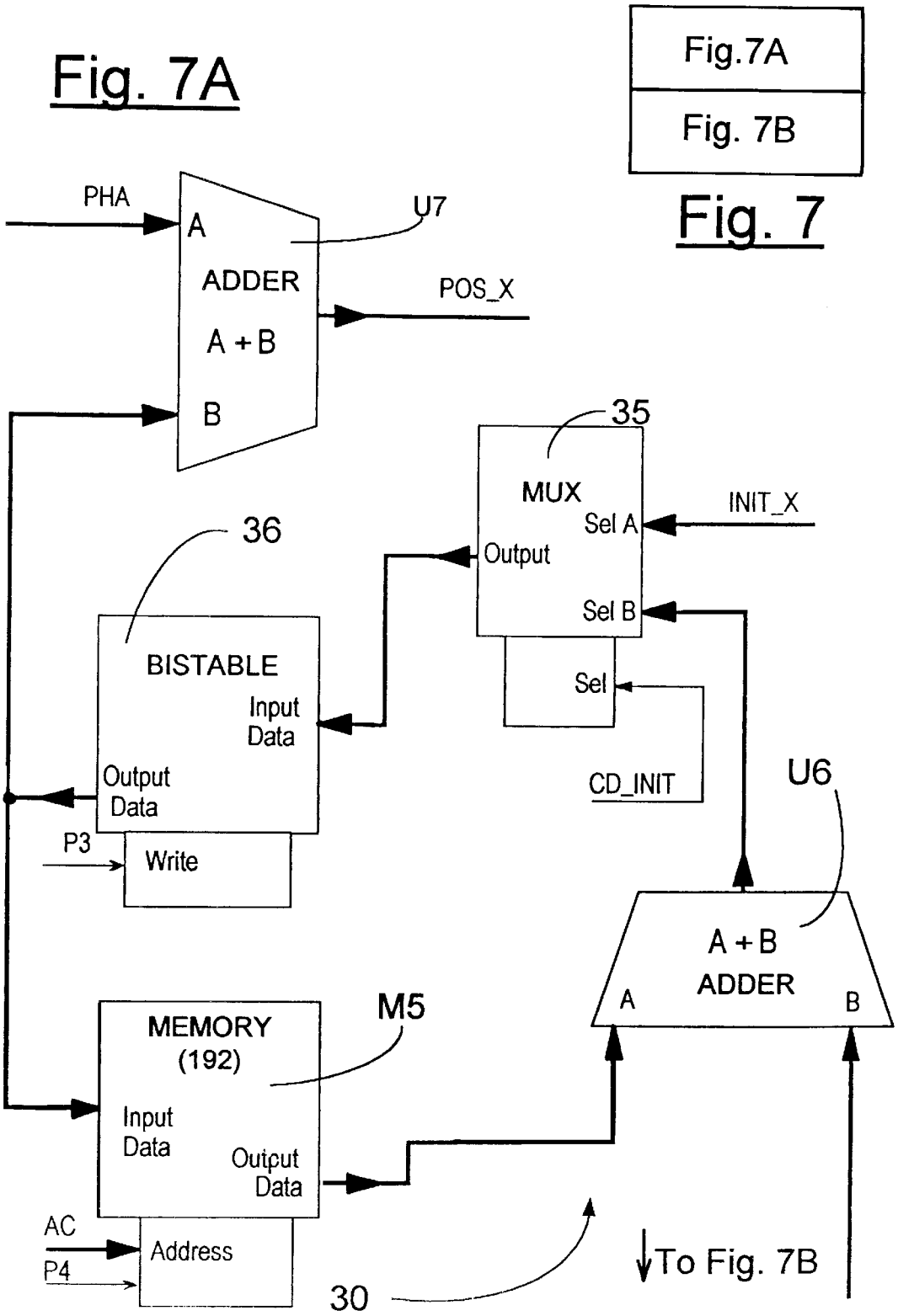
FIG. 7, 7A and 7B are diagrams of a time value generator circuit for designating zero level samples used to prepare first level samples.
Figure 7B:
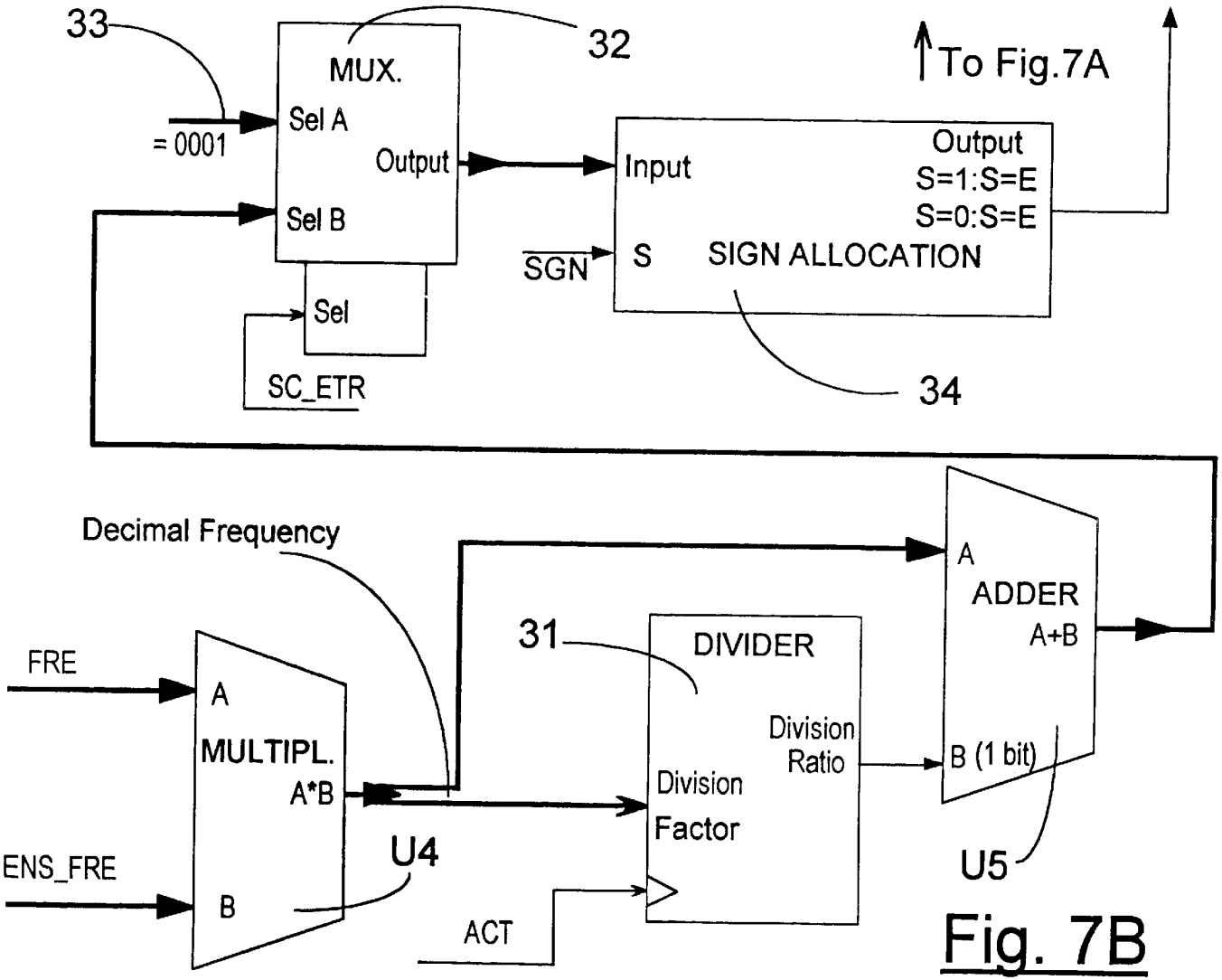

According to one essential feature of the invention, the system therefore includes means, shown in FIG. 7, adapted to generate a binary value known as the "zero level sample designation value", or "designation value", for short. This designation value (symbol POS_X is essentially a function of two other binary values, the first of which is the value FRE generated by block 20B (FIG. 6). This first binary value represents a time interval expressing the ratio between the frequency of any cell relative to a base frequency of which it is a multiplication factor.

This concept can be illustrated by an example. If it is required to synthesize a sinusoidal sound having a fundamental frequency of 440 Hz and necessitating the production of a higher harmonic, the harmonic at 880 Hz, for example, a first cell is allocated to the generation of samples with a relative time value factor 1 (signal FRE) and another cell is allocated to the generation of samples for the harmonic with a relative value 2. The ratio can equally be less than 1.

Calculating the designation values POS_X will also require another time interval value or basic interval (signal ENS_FRE) representing the fundamental frequency of the sound to be synthesized, the interval depending on the value of the frequency and on the number of sampling points with which the sound is to be synthesized.

Returning to the above example, if the sinusoidal sound must have a frequency of 440 Hz and if it is required to synthesize it using a sampling frequency of 44.1 kHz, the oscillation will require 100.227 points per cycle. If the oscillation is defined over 1 024 points, for example (for a complete cycle, the maximum frequency that can be obtained with 1 024 points is 43.0664 Hz), to obtain the oscillation at the required frequency of 440 Hz an increment of 10.21678 is required between two successive address values of the 1 024-point oscillation table. This amounts to an increment between two successive designation values POS_X equal to 10.2178 (or 10.21678 times the sampling frequency of 44.1 kHz) to reproduce a sample defined on a base of 1 024 points per cycle. For the harmonic at 880 Hz, the increment must be doubled to address the same table of 1 024 points per cycle, i.e. 20.43345. Remember that signal ACT corresponds to the sampling rate, here a frequency of 44.1 kHz. Note therefore that the value POS_X inherently represents a sample positioning time value on the time axis, and at the same time designates the samples by constantly evolving, given that it constitutes at the same time a memory address containing the zero level samples.

The designation value POS_X is calculated in a circuit 30 for calculating selection values shown in FIG. 7.

The figure shows that in this calculation circuit the values of the relative interval FRE and of the base interval ENS_FRE are fed to the respective inputs A and B of an arithmetic unit U4 in which they are multiplied. The integer part of the result of the multiplication is fed to the input A of a second arithmetic unit U5 which sums values applied to its inputs A and B. The decimal part of the result of the multiplication is fed to a binary rate divider 31 in which the decimal part is counted down by signal ACT (note that the values in question are in reality expressed in binary notation).

In the above example, in which the output of the unit U4 has the value 30 10.21678, the divider 31 adds in the unit U5 a value 1 to the integer value 10 at the rate of 21 7678 times per one hundred thousand pulses of signal ACT. Accordingly, the value 11 will be added at the output of unit U5 21 678 times over one hundred thousand pulses of signal ACT.

The output of arithmetic unit U5 is fed to one input SEL B of a multiplexer 32 which, under the control of the signal SC_ETR, selects, from one sequence PCAL to the other, the type of growth of the value POS_X as a function of various instances of use of the sources of zero level samples, as explained below. In one case, the growth of the value POS_X is constant (for example 0001) and applied to the connection 33. The output of block 32 is connected to a sign determination block 34 which under the control of a signal SGN allocates a positive or negative sign to the value extracted from the memory M5. Note that if the negative signal is selected, the sound sequence synthesized can be reproduced in reverse time, because the value POS_X will then be decremented from one period P1 to the other by the amount determined in the calculation circuit 30, instead of being incremented.

An accumulator memory M5 loaded by the active pulse of sub-period P4 stores the earlier value POS_X for all the cells.

The output of sign determination block 34 is fed to the input B of an arithmetic unit U6 whose input A is connected to the output of memory M5. Unit U6 calculates the sum of its two input variables. The result is sent to a multiplexer 35 which, under the control of a signal CD_INIT, addresses to its output either the output of arithmetic unit U6 or an initialization value INIT X, yet to be described, from which the value POS_X will be incremented. Th value INIT_X can be equal to zero in some cases. The output of multiplexer 35 is connected to a synchronization bistable 36 in which the value is written by the active pulse of sub-period P3.

The output of bistable 36 is connected to the data input of memory MS and, as variable B. to one input of an arithmetic unit U7 which receives at its other input the value PHA from parameter generator circuit 20 (block 20C in FIG. 6). The result of the calculation performed in arithmetic unit U7 (the sum of its input variables A and B) is the value POS_X.

As previously indicated, the unit SYNT provides on a timesharing basis a number n of cells in which first level sample values are generated from zero level sample values allocated predetermined amplitude, frequency, phase and filter parameters. According to another important feature of the invention, the unit SYNT also includes means for providing on a timesharing basis a number m of sets of cells which, like the latter, are represented by values stored at memory locations of a plurality of memories.

In the non-limiting example currently being described, m=64 and there are therefore 64 sets, so that there are 64 locations in each memory assigned to this task. The sets are intended to combine, or more precisely to accumulate, first level sample values generated in a predetermined number of cells at the end of each sampling cycle P, to produce second level samples.

Accordingly, assume that it is required to reproduce a violin note having its fundamental frequency and a set of harmonics characteristic of that note as played on that instrument. A number of cells equal to the number of fundamental frequencies and harmonics to be reproduced with their associated amplitude, frequency and phase characteristics can then be assigned to this task, after which all the first level samples generated in this way, with their associated time relationships, are all combined in one of the sets, the second level samples containing the accumulated first level samples previously calculated in the cells assigned to the set concerned.

Similarly, it is shown below that the second level samples calculated in the various sets can in turn be distributed across a set of q outputs by appropriate accumulation of second level samples to form third level samples collectively constituting the outputs of the unit SYNT symbolized at S in FIG. 1.

The mechanisms just described are implemented by the hardware components respectively shown in FIGS. 8 and 9, which will now be described in detail.

Figure 8A:
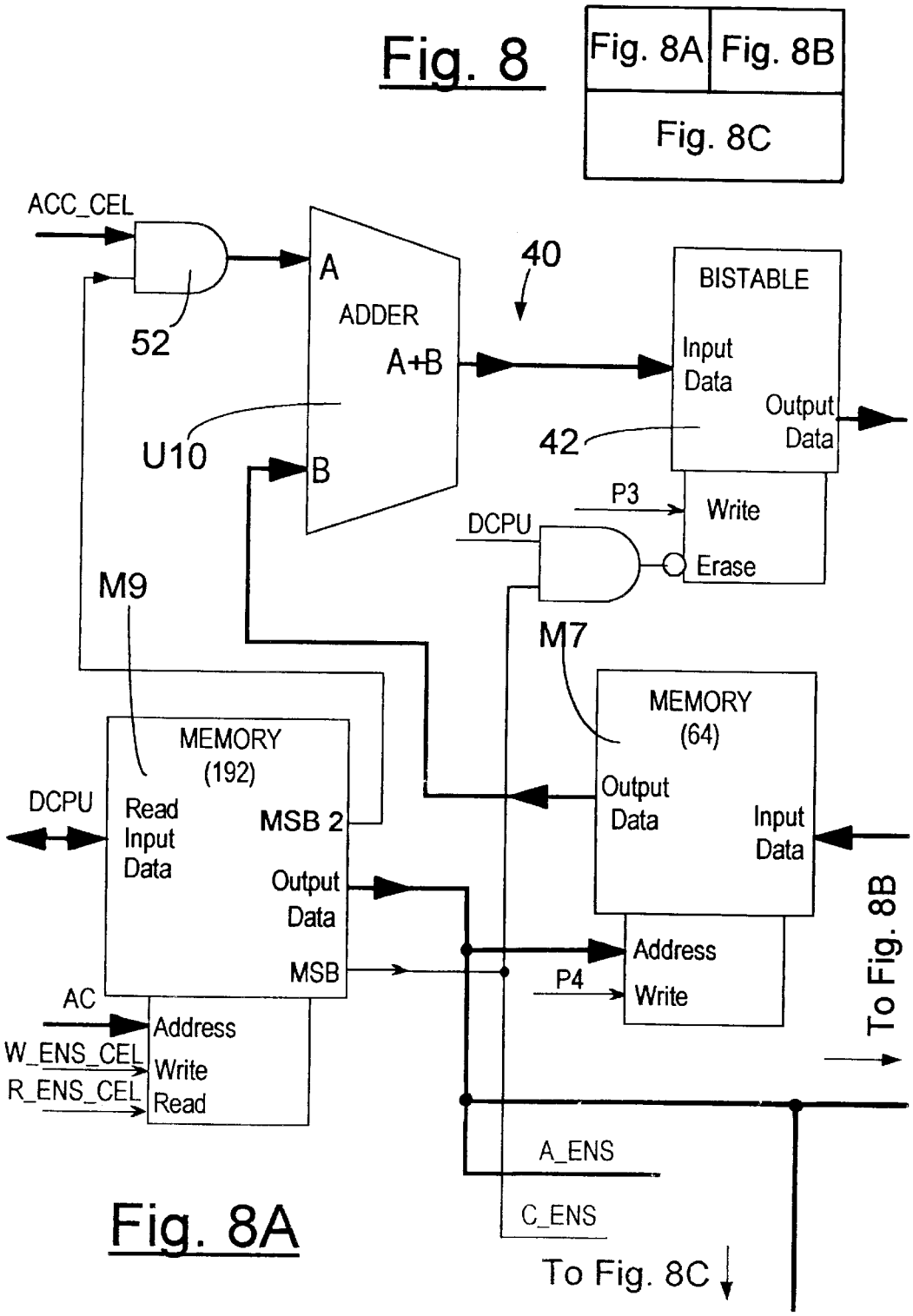
Figure 8B:
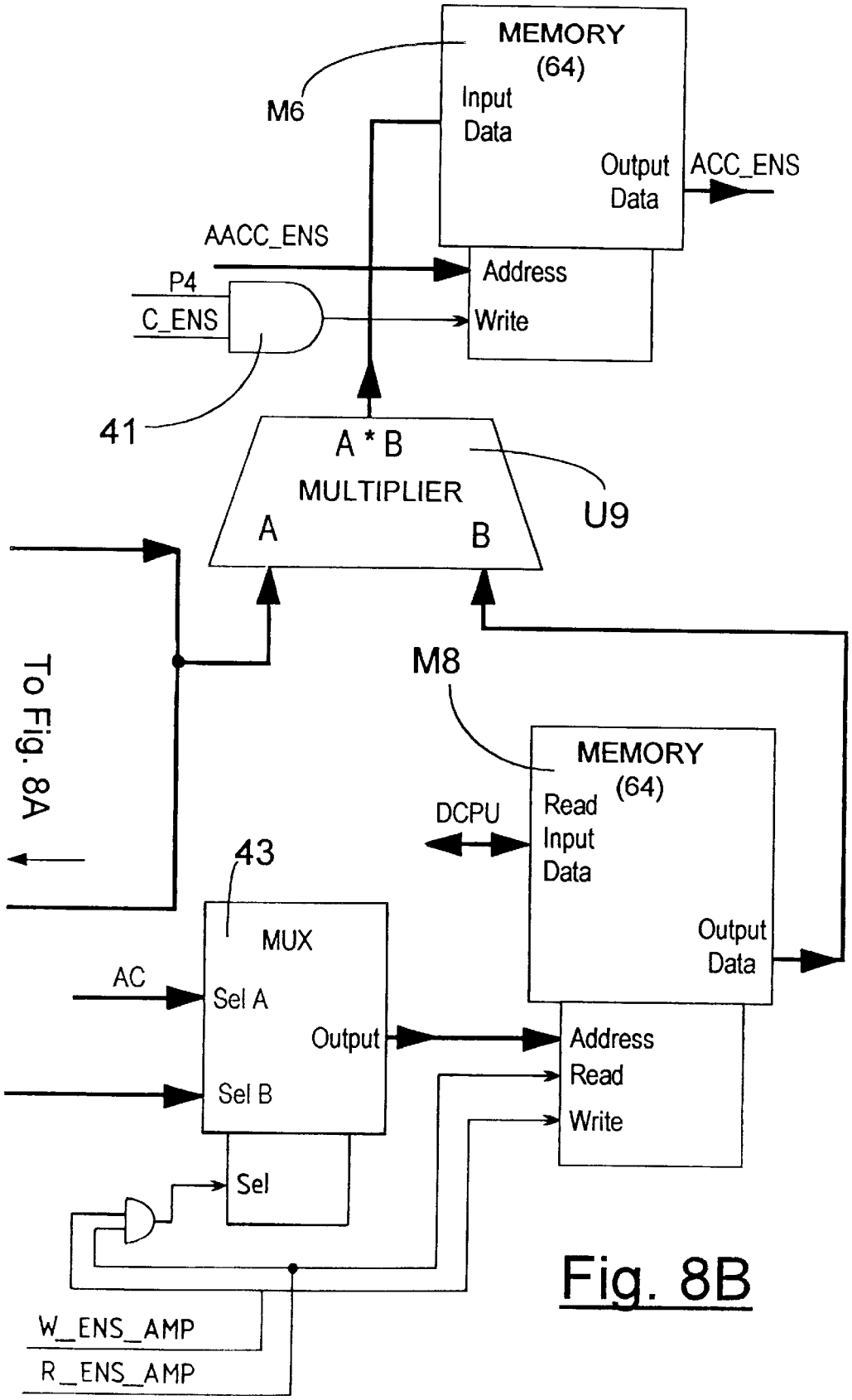
Figure 8C:
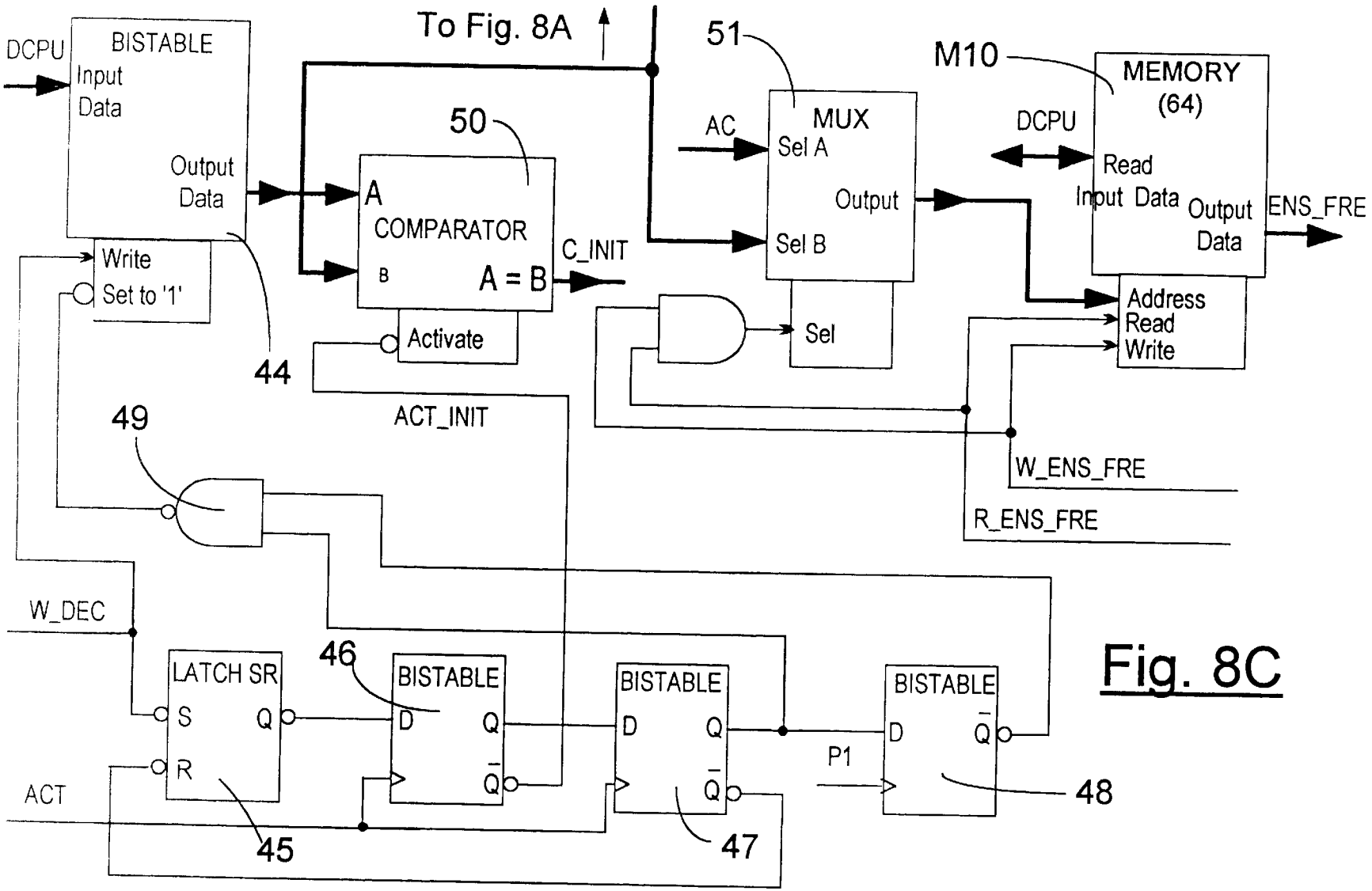

FIG. 8 shows a first level sample allocator circuit 40 for allocating predetermined cells to a predetermined set of the plurality of sets of the synthesizer unit SYNT. FIGS. 9 and 10 show the waveforms of the signals appearing in the allocator circuit 40.

At a given time determined by the timing of signal ACT (FIG. 10), the second level sample value of a set selected for that time is represented by the signal ACC_ENS seen in the top righthand part of FIG. 8 and which constitutes the output of the allocator circuit 40. This value is fleetingly at the address corresponding to this set of an accumulator memory M6 (which has 64 locations in this example), which is addressed by the signal MCC_ENS and whose data input is connected to the output of an arithmetic unit U9 for multiplying its inputs A and B. Writing in memory M6 is under the control of the active pulse of sub-period P4. This reaches it via an AND gate 41 also receiving a signal C_ENS designating the last cell whose first level sample, which has just been calculated, must, for a given allocation, be incorporated in the second level sample value to be supplied by that set.

The arithmetic unit U9 receives at its input A output data stored in a bistable 42 (FIG. 9) which receives this data as input from an arithmetic unit U10. This sums the values applied to its inputs A and B. Data is written in bistable 42 during the active pulse of sub-period P3. The output of bistable 42 is connected to an intermediate accumulator memory M7 (64 locations) in which data can be written during the active pulse of sub-period P4. At the output, this data is fed to input B of arithmetic unit U10. This receives at its input A the accumulated value ACC_CEL of the current cell which is combined by an AND gate 52 with a bit C_CSEL coming as the most significant bit from a memory M9 with 192 locations. The AND gate adds the sample value of the current cell if bit C_CSEL is at '1'. If not, the value is not added to the set. There is therefore a choice of having a cell whose sample value is used as part of the level two sample, or of not using it as a command, for example in order to use the cell so that the value can be added to a given parameter of a given cell without the sample of that cell being directly audible because it is not routed to an output.

Figure 9:
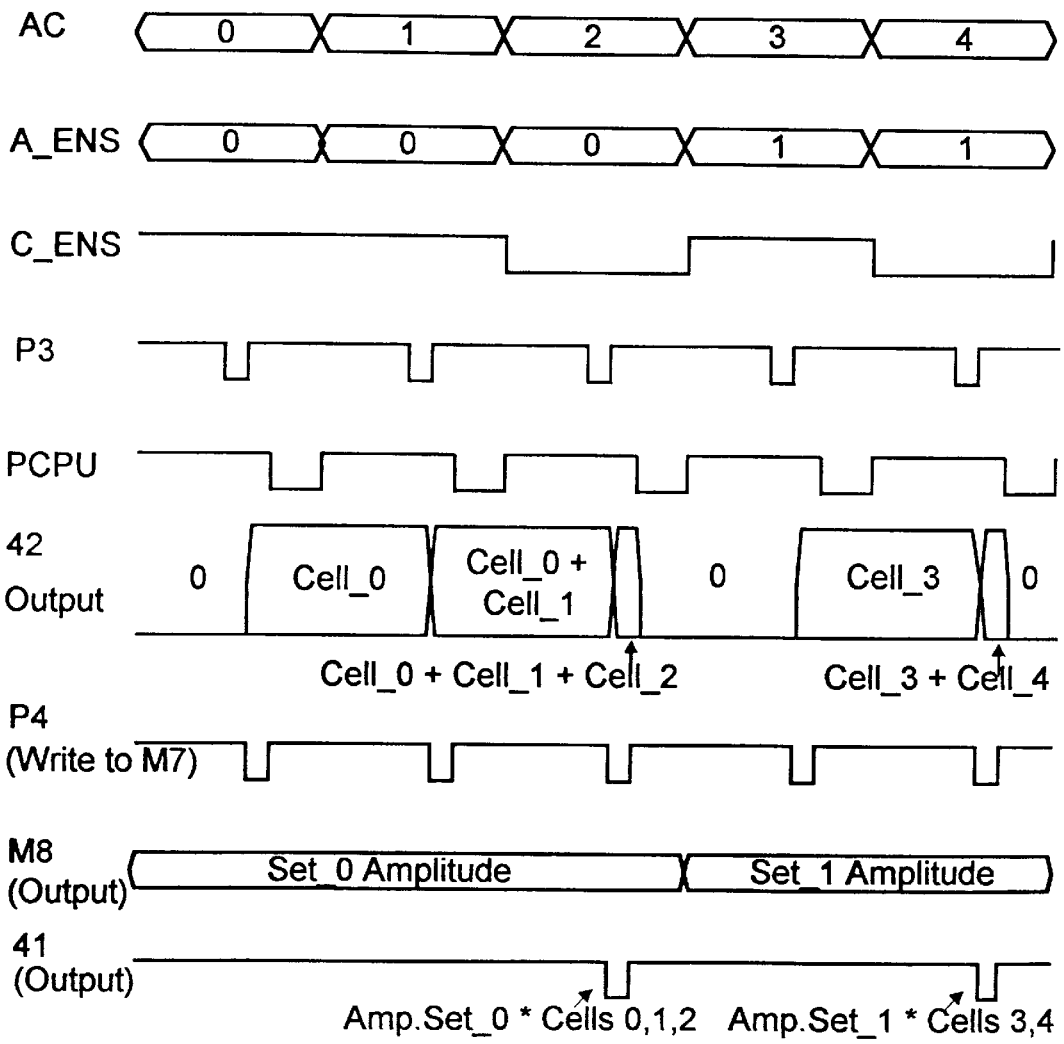
FIGS. 9 and 10 are a timing diagram showing the signals appearing in the allocation circuit from FIG. 8.
Figure 10:
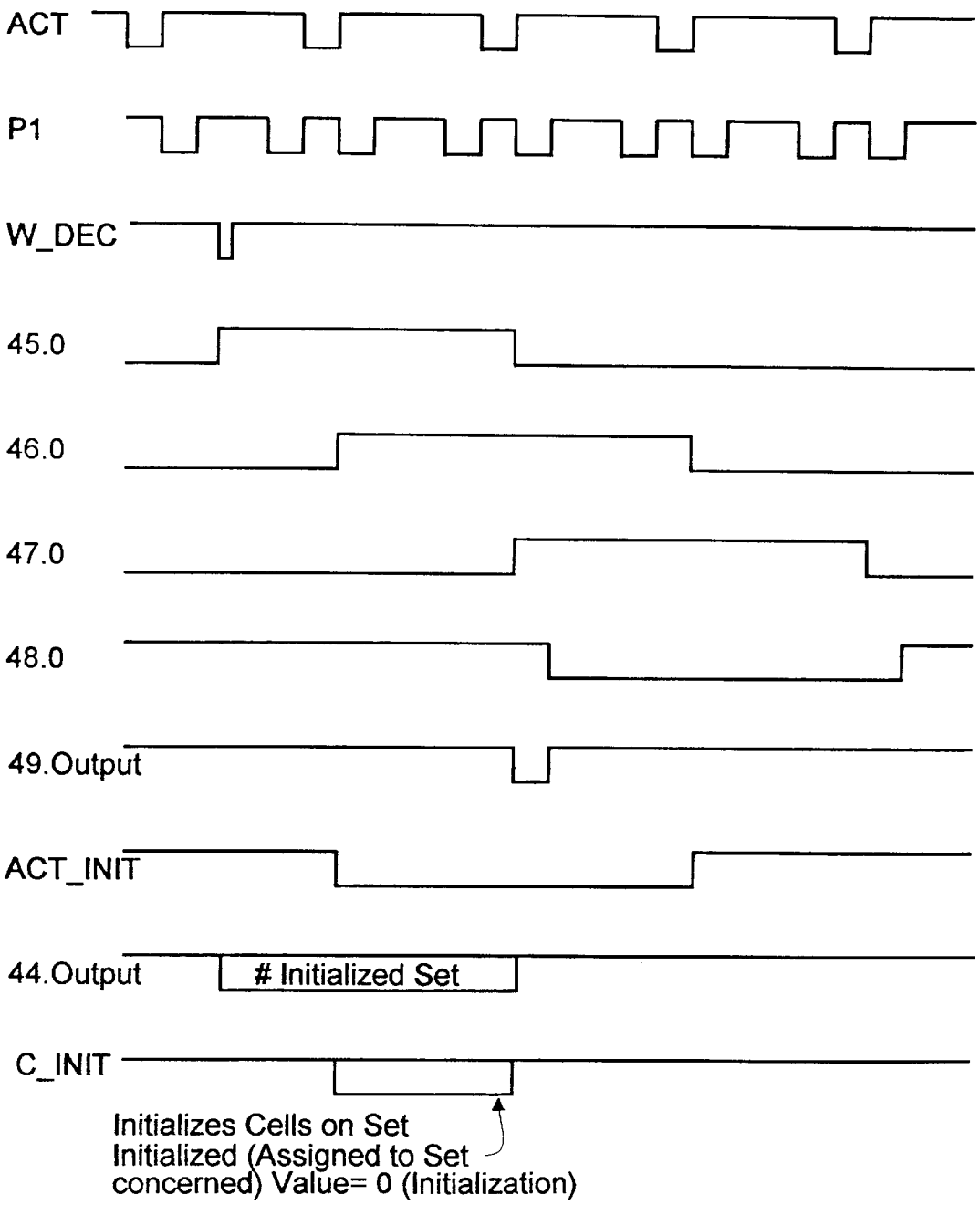

Input A of arithmetic unit U9 therefore receives a value comprising the sum of all the accumulated values ACC CEL of the cells allocated to a given set, which sum appears at the output of bistable 42, as shown in FIG. 9.

Arithmetic unit U9 receives on its input B an amplitude value from a memory M8 (having 64 locations) in which are stored amplitude values that can be written therein by management unit CPU under the control of the write signal W_ENS AMP (FIGS. 2 and 8). The amplitude value can be read in memory M8 under the control of signal R_ENS_AMPL to adjust the calculated amplitude value of the current set under consideration.

The data input of a memory M9 (having 192 locations) is connected to block 13 (FIG. 2) to receive from the CPU address values specifying for each cell to which set the cell will belong in order to contribute to the production of a second level sample. These address values are written in this memory M9 at respective addresses corresponding to the cells concemed.

FIG. 9 shows by way of a simple example this writing in memory M9 for the first five cells of a cycle P, which cells are numbered 0 through 4. In this example, cells 0, 1 and 2 will belong to set 0 and cells 3 and 4 to set 1. Memory M9 is written and read under the control of signals W_ENS CEL and R ENS CEL. The same value determines the address of memory M7 which accumulates this data under the control of the active pulse of sub-period P4.

Each address value written in memory M9 is accompanied by an identification bit which, in this example, is the most significant bit (MSB). In this case, it is at I if, during the next period P1, the calculation for the current set must continue for that set. In contrast, when this bit is at zero, this means that the calculation of the current set is finished. The corresponding signal C_ENS is at 1 for cells 0, 1 and 3, for example, and at 0 for cells 2 and 4 (FIG. 9). As already mentioned, signal C_ENS controls writing in memory M6 of the cumulative value of a second level sample belonging to a current set.

Amplitude data of the sets can be written in memory M8 at addresses which can come either from memory M9 (A_ENS) or directly from block 10 (FIG. 2). The address is selected by a multiplexer 43. Multiplexer 43 transmits the address AC when either signal W ENS_AMP or R_ENS_AMP is at zero. Otherwise it transmits address A_ENS.

The allocation circuit 40 also includes a part for synchronizing the phase of cells and sets.

This phase synchronization and the triggering of a selected set are commanded non-synchronously by a signal W_DEC from block 14 (FIG. 2). To this end, signal W_DEC commands writing of the address of the set to be synchronized in phase into a bistable 44, receiving the address from the CPU. Signal W_DEC is synchronized to the sampling signal ACT by a latch 45, three bistables 46, 47 and 48 and a NAND gate 49. The signals appearing in this part of the circuit are shown in FIG. 10, which explains how the circuit works.

The output Q of bistable 46 supplies a signal ACT_INIT which is used to activate a comparator 50 for comparing two address values, namely that from memory M9 and that supplied by bistable 44. A cell initialization signal C_INIT is delivered if the two address values are equal. This signal is used in particular in the time increment calculation circuit 30 for the multiplexer 35 (FIG. 7).

The allocation circuit 40 from FIG. 8 also supplies the signal ENS_FRE which is also used in the calculation circuit from FIG. 7.

A multiplexer 51 selectively sends to a memory M10 either address values A_ENS or address values AC according to the state of the write-read signals W_ENS_FRE and R_ENS_FRE supplied by block 14 in FIG. 2 for writing in the memory the value ENS_FRE from the CPU at the address of the current set that must use this interval value.

Figures 11, 11A, 11B:
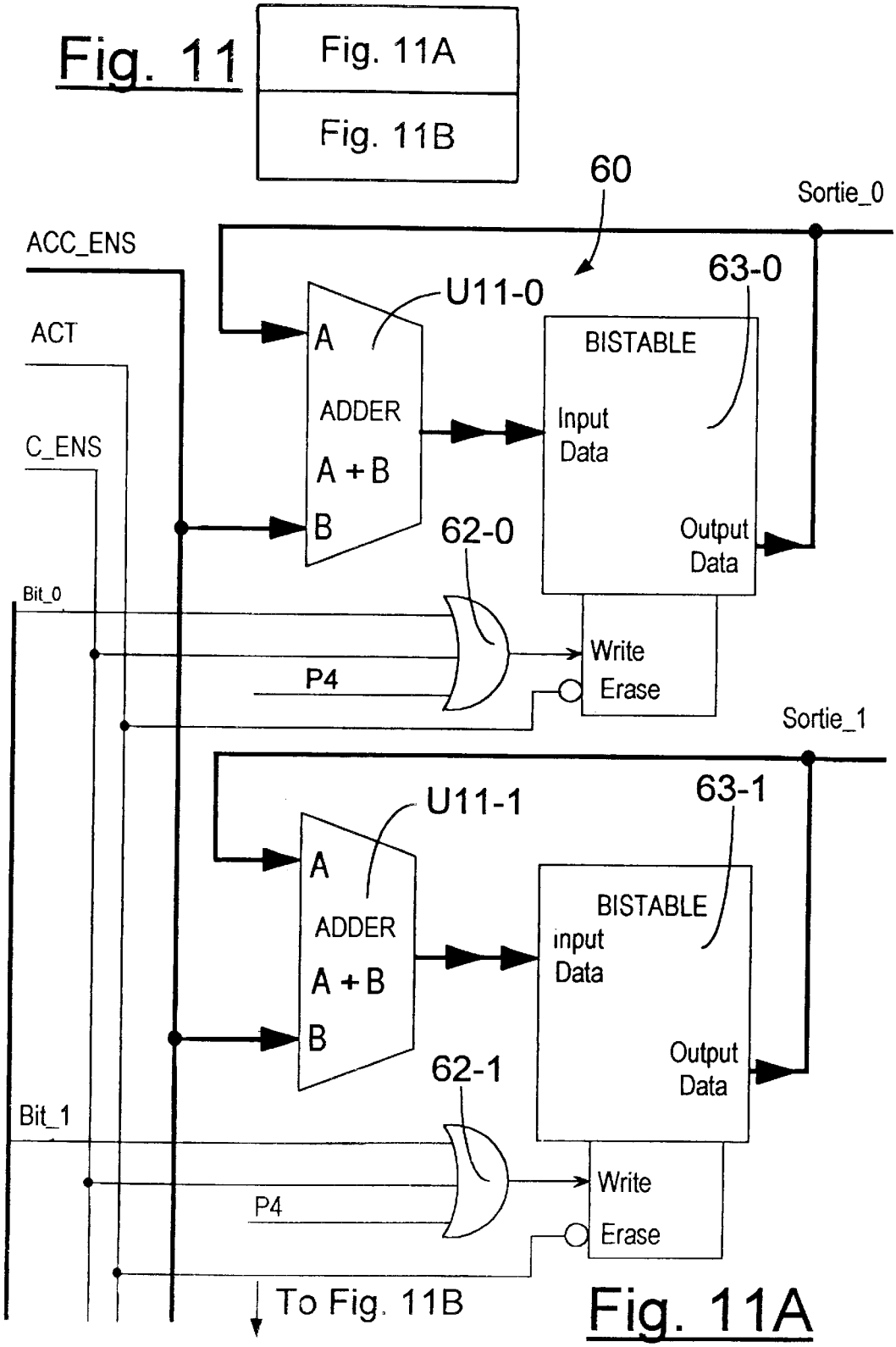
FIG. 11, 11A and 11B are a diagram of a circuit for allocating second level samples to a circuit immediately upstream of the output of the synthesizer unit.
Figure 11B:
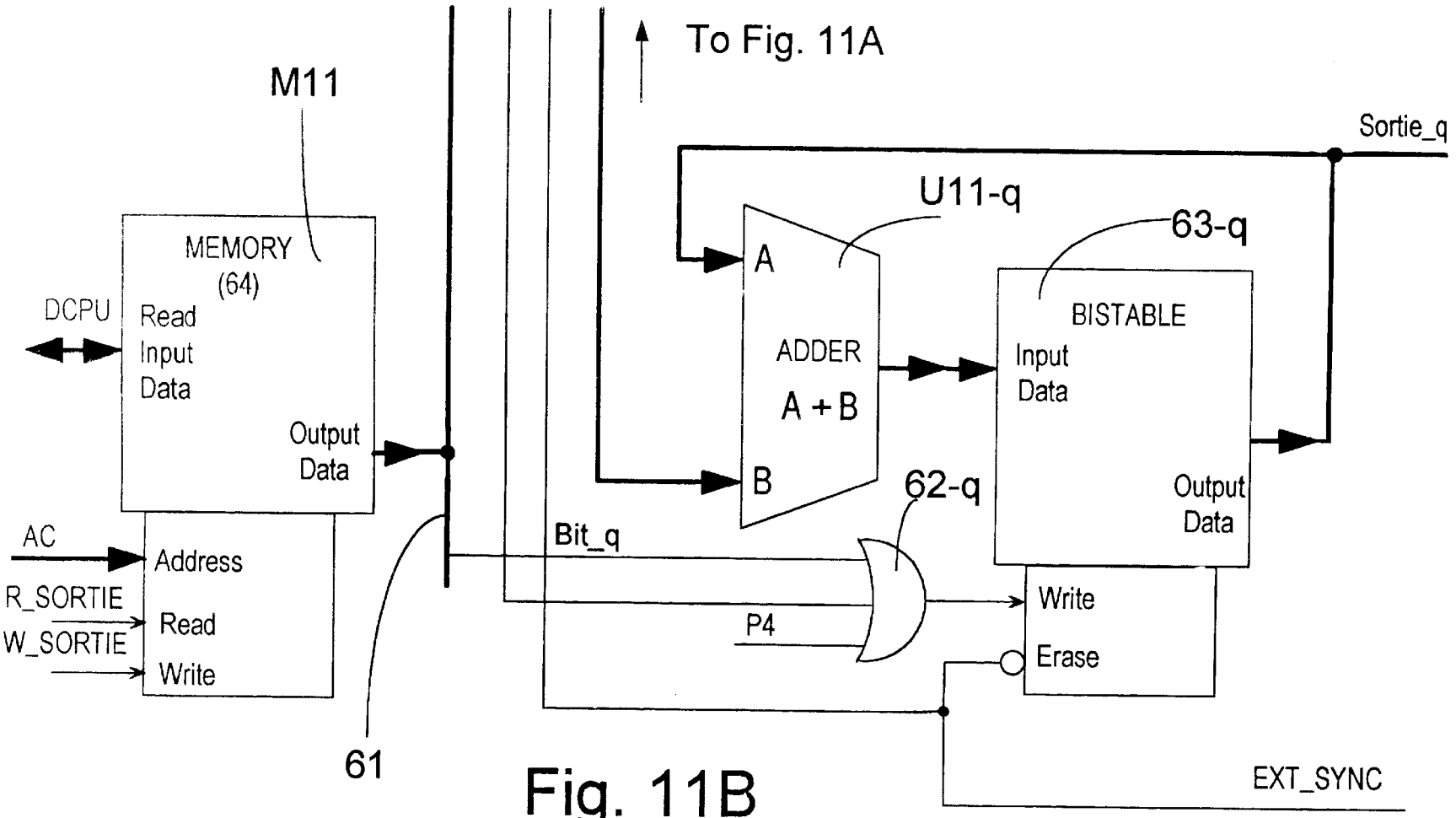

FIG. 11 shows a circuit 60 for allocating second level samples which selectively groups the second level samples at outputs 0 through q to generate third level samples which, in the example described, are output samples of the unit SYNT. There are 16 outputs in the example.

A memory M11 (having 64 addresses, i.e. one per set on the sixth least significant bit of signal AC) contains second level sample distribution values ACC_ENS. These distribution values are supplied by the CPU under the control of a signal W_SORTIE and can be read under the control of a signal R_SORTIE to be transferred over a distribution command bus 61. The bits of these values are respectively applied to logic gates 62-0 through 62-q which also receive signal C_ENS and the active pulse of sub-period P4.

The second level sample values ACC_ENS are respectively fed to arithmetic units U11-0 through U11-q in which previous second level sample values can be added to current values of such samples. The sums calculated in these arithmetic units are stored temporarily in bistables 63-0 through 63-q into which the results of the calculations by the arithmetic units can be written under the command of the outputs of respective gates 62-0 through 62-q. The content of the bistables can be deleted by sampling signal ACT, which also supplies the external synchronization signal EXT_SYNC to an external system (digital/analog converter, processor, etc) for reading outputs 63-0 through 63-q.

As previously stated (see the description of FIG. 5), the parameter values used to generate first level samples can be modified in particular by influences acting on the cells and coming from inside or outside the unit SYNT. In other words, each first level sample can be considered to be calculated by acting on the cell concerned from the various sources.

Figure 12A:
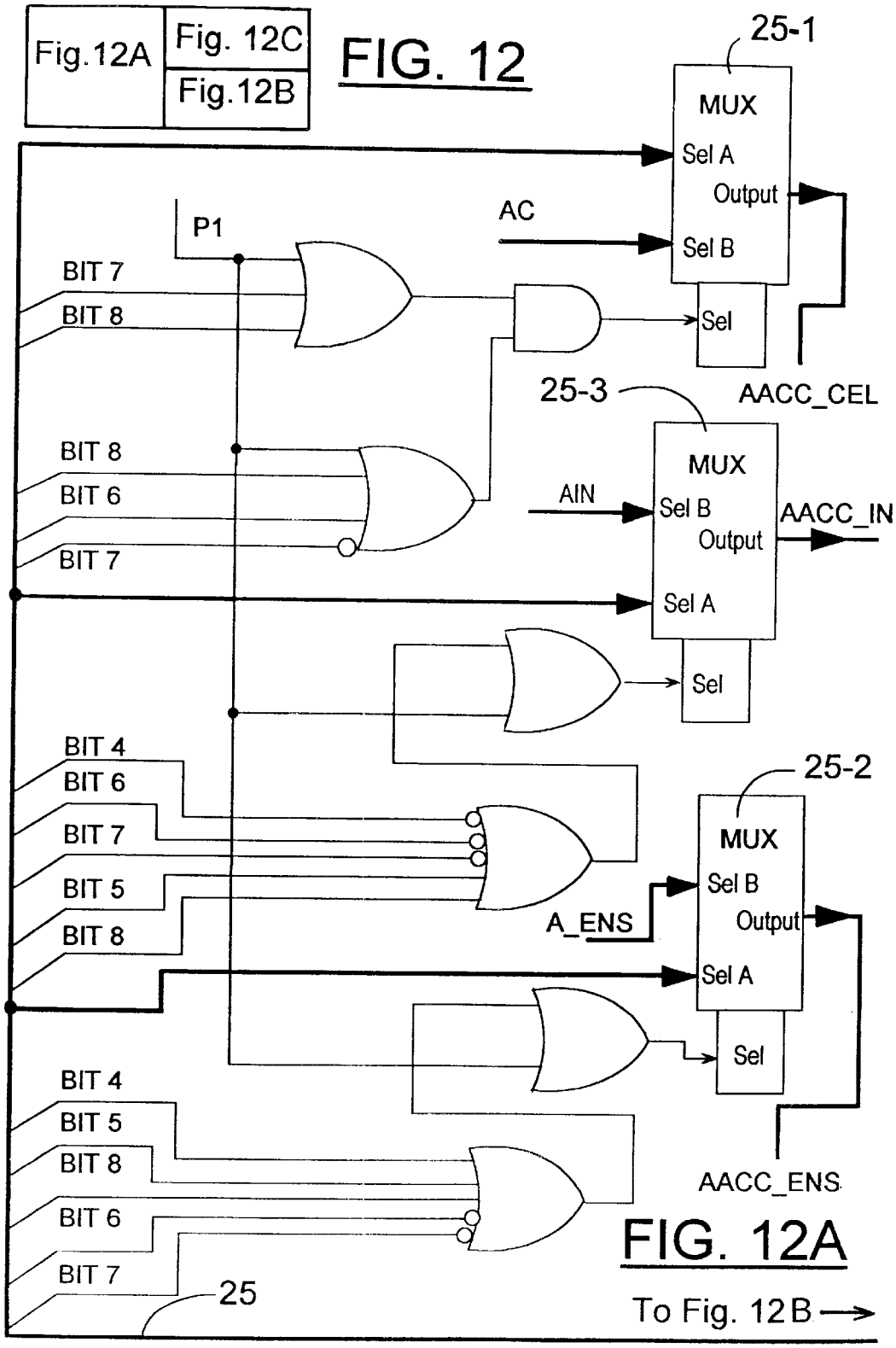
Figure 12B:
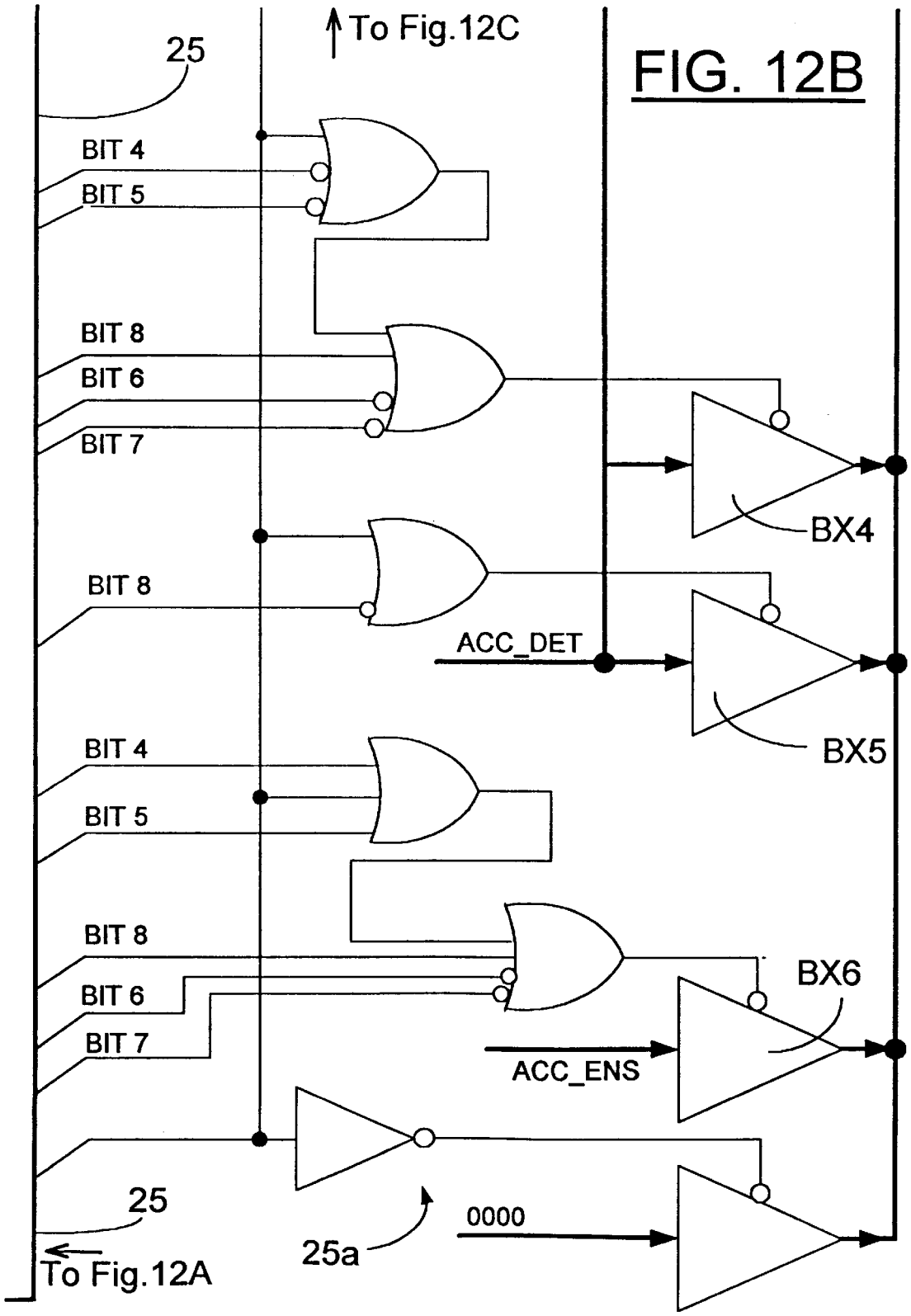
Figure 12C:
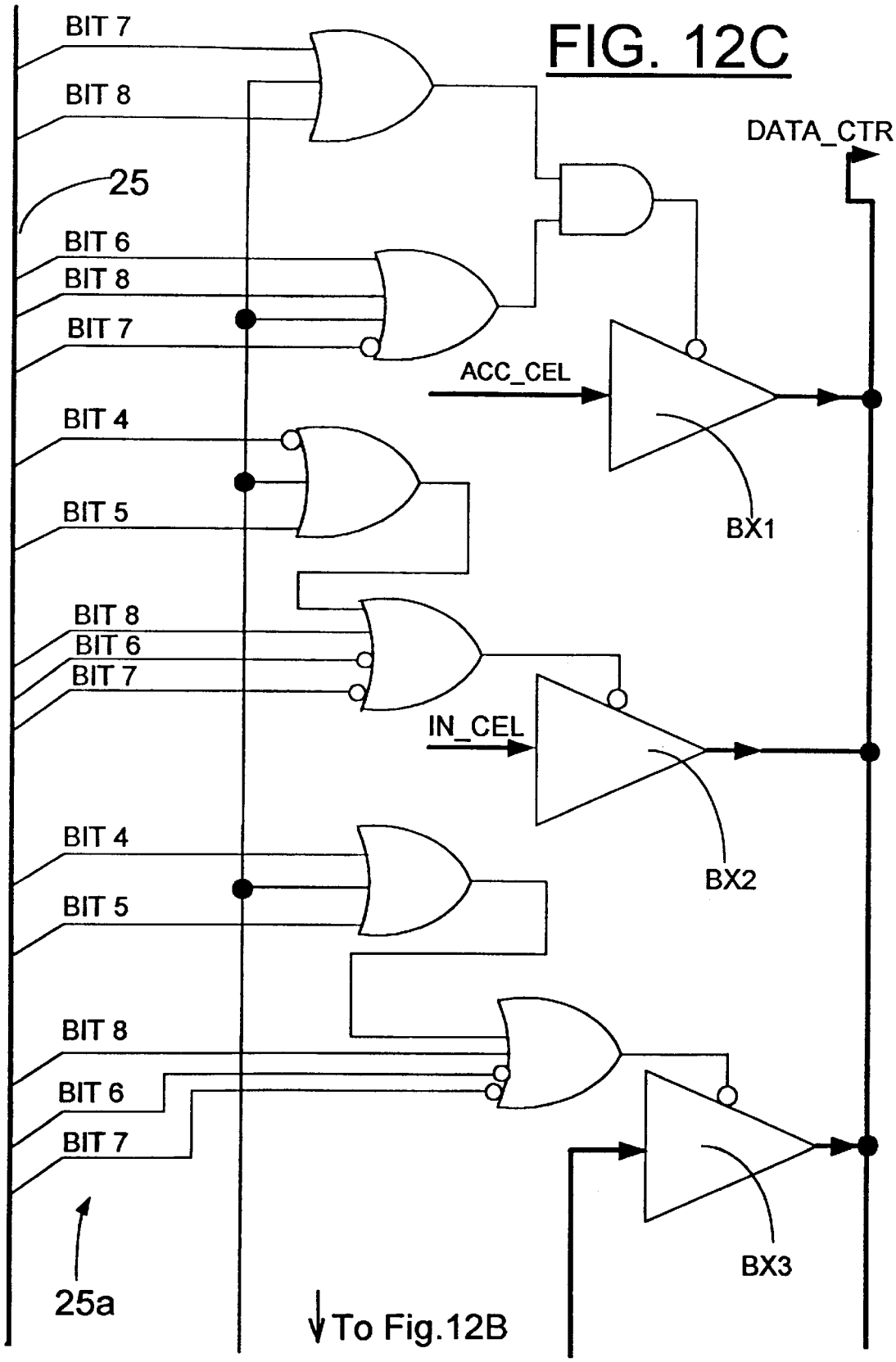

A source is selected from the CPU which loads memory M4 for this purpose (FIG. 5). The source selection values stored for the respective cells in memory M4 are transferred to an output of a bistable 23 activated on the active pulse of sub-period P2, at which output source selection command values ADR_CTR appear at the time when they must be respectively available for selecting a parameter value modification for the current cell. FIG. 12 gives more details of the selection block which is common to blocks 20A through 20D of FIG. 6 and which is controlled by the selection values ADR_CTR.

In the example described here, a parameter value modification source can be, selectively, another cell, or a set, or an external input to the unit SYNT, as appropriate (parameter detection signal), the word "input" here designates a group of blocks for adapting external signals for use in the unit SYNT.

The source or input selection block 25 (FIG. 12) therefore includes first selection logic 25*a* whose control signal is formed by the most significant bits 1 through 5 of the values ADR_CTR stored in memory M4 (FIG. 5). These most significant bits are used to transmit from the input to the output of the selection logic, selectively for each cell, one of four sample modification values which are respectively signals ACC_CEL, ACC_ENS, ACC_DET and IN_CEL generated from first level samples (cell) or second level samples (set), a signal input detector (amplitude, frequency or band) and a signal input (see below for more details).

The output signal DATA_CTR selected in the above way can be used as a parameter value modification value during the subsequent calculation of a first level sample of any cell.

The bits of the value ADR_CTR are also fed to second selection logic 25*b* which divides the modification value sources between four cases.

Figure 13A:
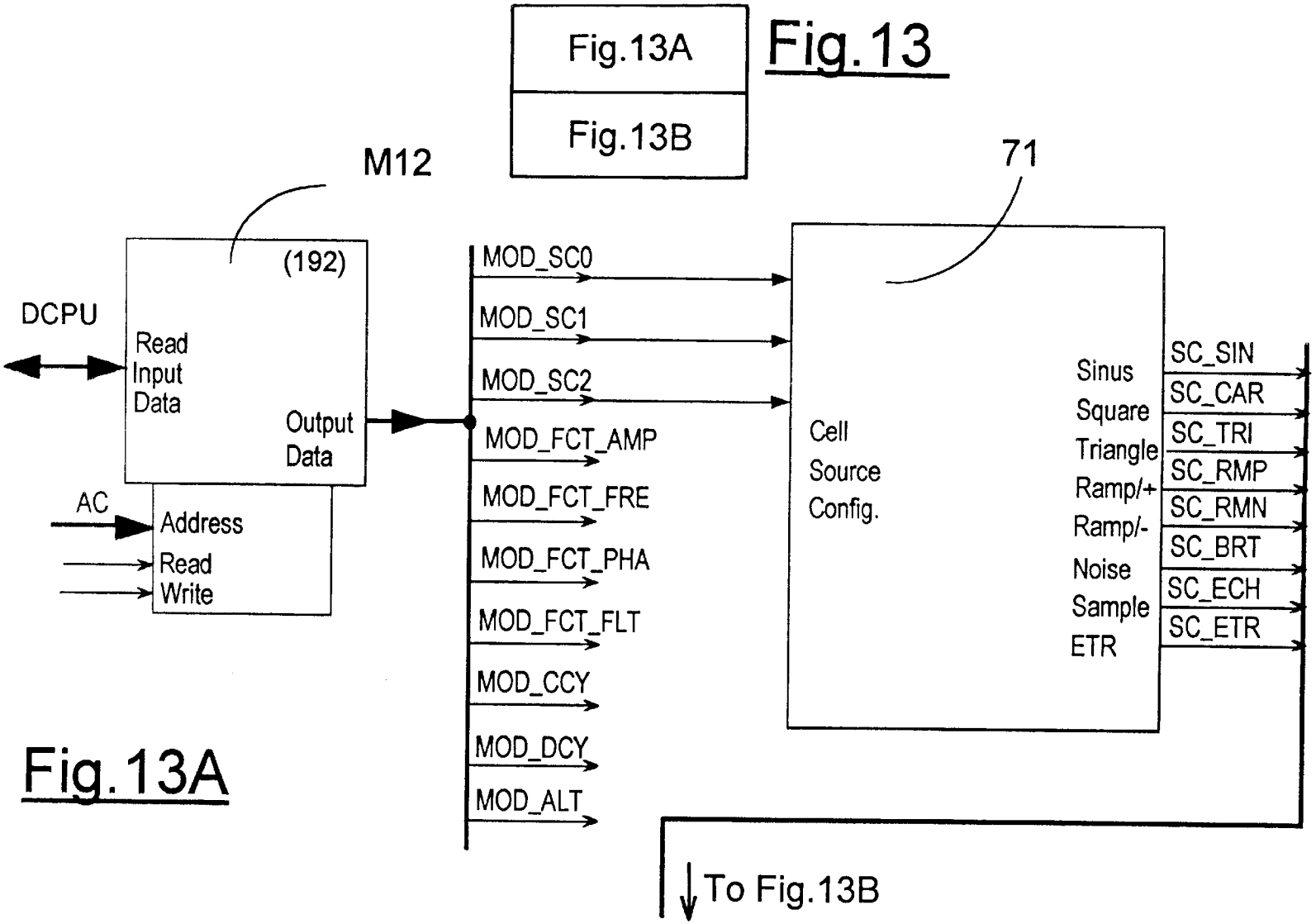
Figure 13B:
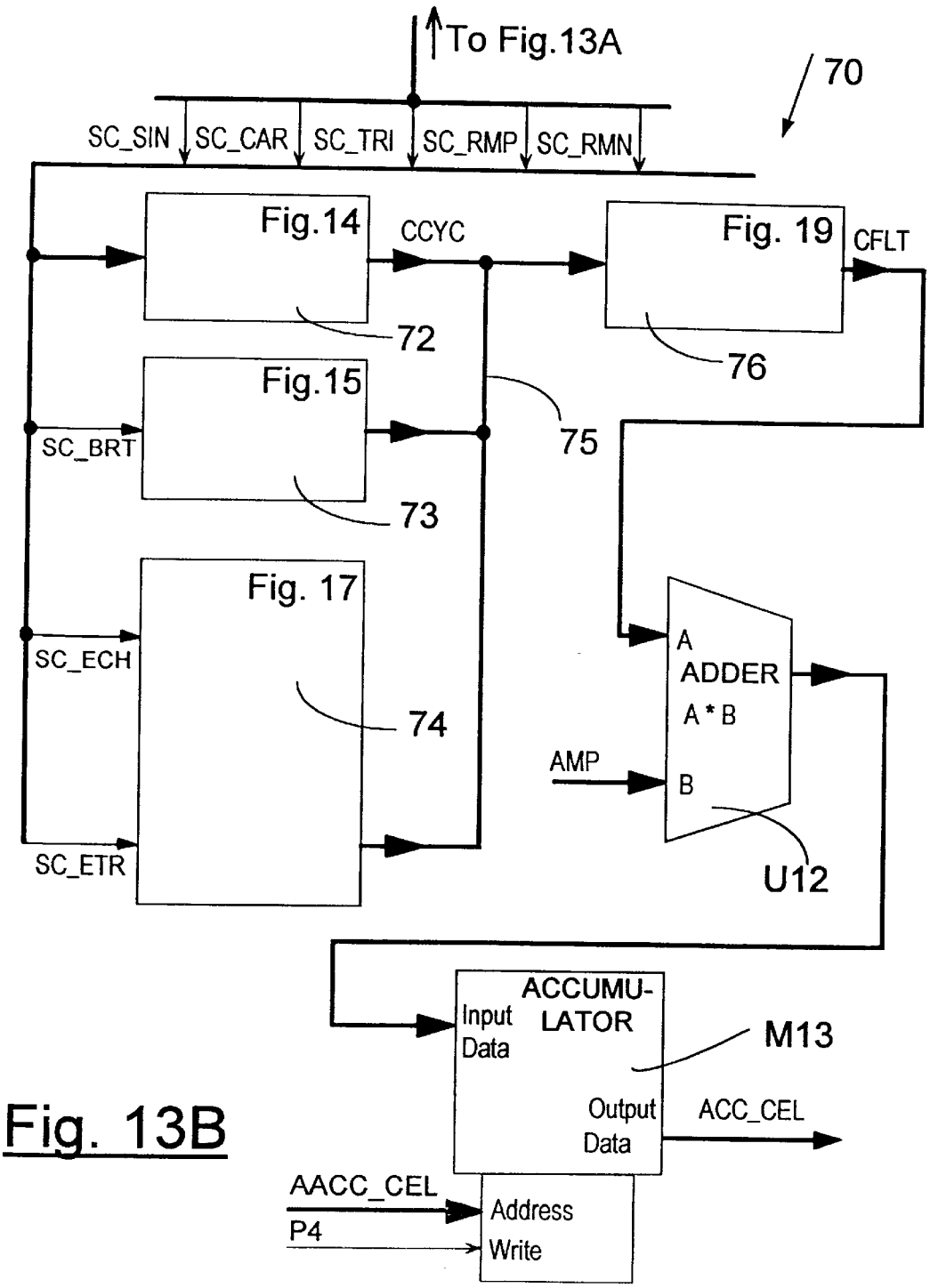

The first case concerns accumulation for the cells in an accumulator memory M13 using an address AACC_CEL from a multiplexer 25-1 (FIG. 13). The address normally has the value AC but during sub-cycle P1 it has the value of the most significant bits of the value ADR_CTR, when it determines a value between 0 and 191. The data DATA_CTR is then activated by a buffer BXI of the logic 25*a*.

The second case concerns the set accumulator memory M6 from FIG. 8 which receives address AACC_ENS via multiplexer 25-2 of logic 25*b*. This address has normally the value A_ENS, but during sub-cycle P1 it has the value ADR_CTR when the most significant bits of the value ADR CTR are between 192 and 207. The data DATA_CTR is then activated by a buffer BX6.

Figure 16:
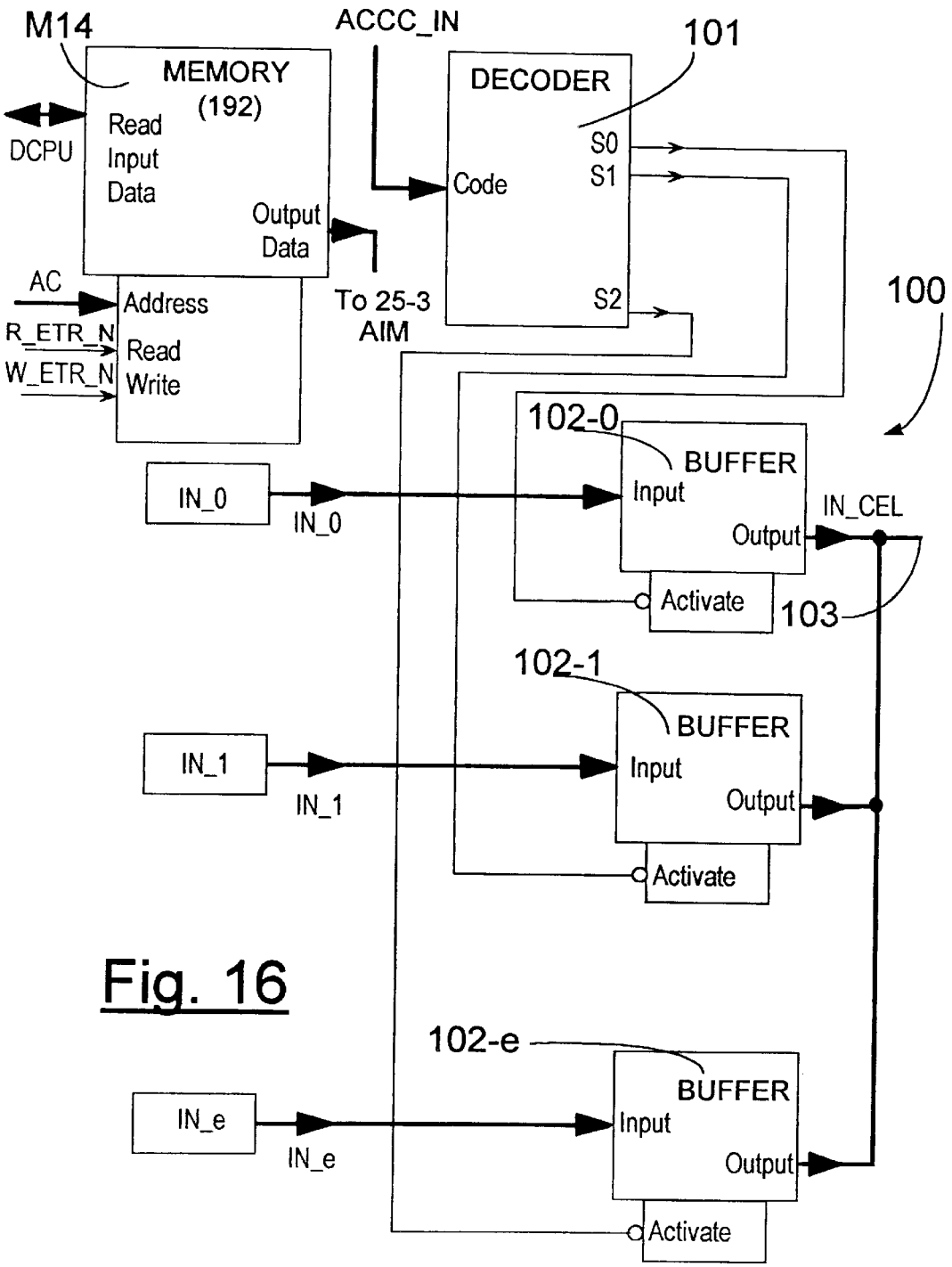
FIG. 16 is a diagram of a circuit for selectively allocating a group of external inputs to the sound synthesizer system in order to use those inputs as first level sample formation sources.

The third case concerns the selection of what it is convenient to call detectors by means of the value AACC_IN supplied by a multiplexer 25-3 of logic 25*b* (FIG. 12). The value AACC_IN is determined by an input selection memory M14 (FIG. 16). The address is normally AIN but during sub-cycle P1 it is ADR_CTR if the most significant bits of this signal determine a value between 208 and 223. The data DATA_CTR is then activated by a buffer BX2 of logic 25*a*.

The fourth case concerns the choice of the detectors represented in FIG. 18 (described in detail below). This choice concerns an amplitude block 144, a frequency block 147 or a band block 146. Values of ADR_CTR beyond 224 can be used to define the detectors. The data DATA_CTR is then activated by buffers BX3 through BX5, as appropriate.

FIG. 13 is a diagram of an input block and mode selection command circuit 70. The first level samples can be calculated in the cells using a number of modes of operation and as a function of output signals established by any of a particular number of input blocks. These can in turn establish their output signals from sources that can be internal and/or external to the unit SYNT.

The choice of modes and input blocks is determined under the control of the CPU which to this end can load a "configuration memory" M12 with data appearing, if necessary, at output 13*e* of block 13 of interface 1 (FIG. 2). This data represents determination values respectively stored for each cell at locations (of which there are 192 here) of memory M12, where they can be written or read under the control of write/read signals W_MOD and R_MOD from block 14. The bits of these determination values correspond to the various configuration that the unit SYNT can adopt.

The three least significant bits MOD_SCO through MOD_SC2 are therefore fed to selection logic 71 which, according to the values of these bits, can activate eight modes of operation used in three input blocks 72 through 74 which form zero level samples.

Input block 72 implements a mode of operation in which the unit SYNT uses waveform generators that it itself includes. This block will be described with reference to FIG. 14 (activation signals SC_SIN, SC_CAR, SC_TR, SC_RMP and SC_RMN).

Input block 73 uses a mode of operation in which the unit SYNT uses its own noise generator. This block will be described with reference to FIG. 15.

Input block 74 uses a mode of operation whereby the unit SYNT uses samples previously generated and stored (signal SC_ECH) or samples used in real time which can come from outside the unit SYNT (signal SC_ETR). These two modes of operation will be discussed with reference to FIGS. 16 and 17.

Figures 19, 19A, 19B:
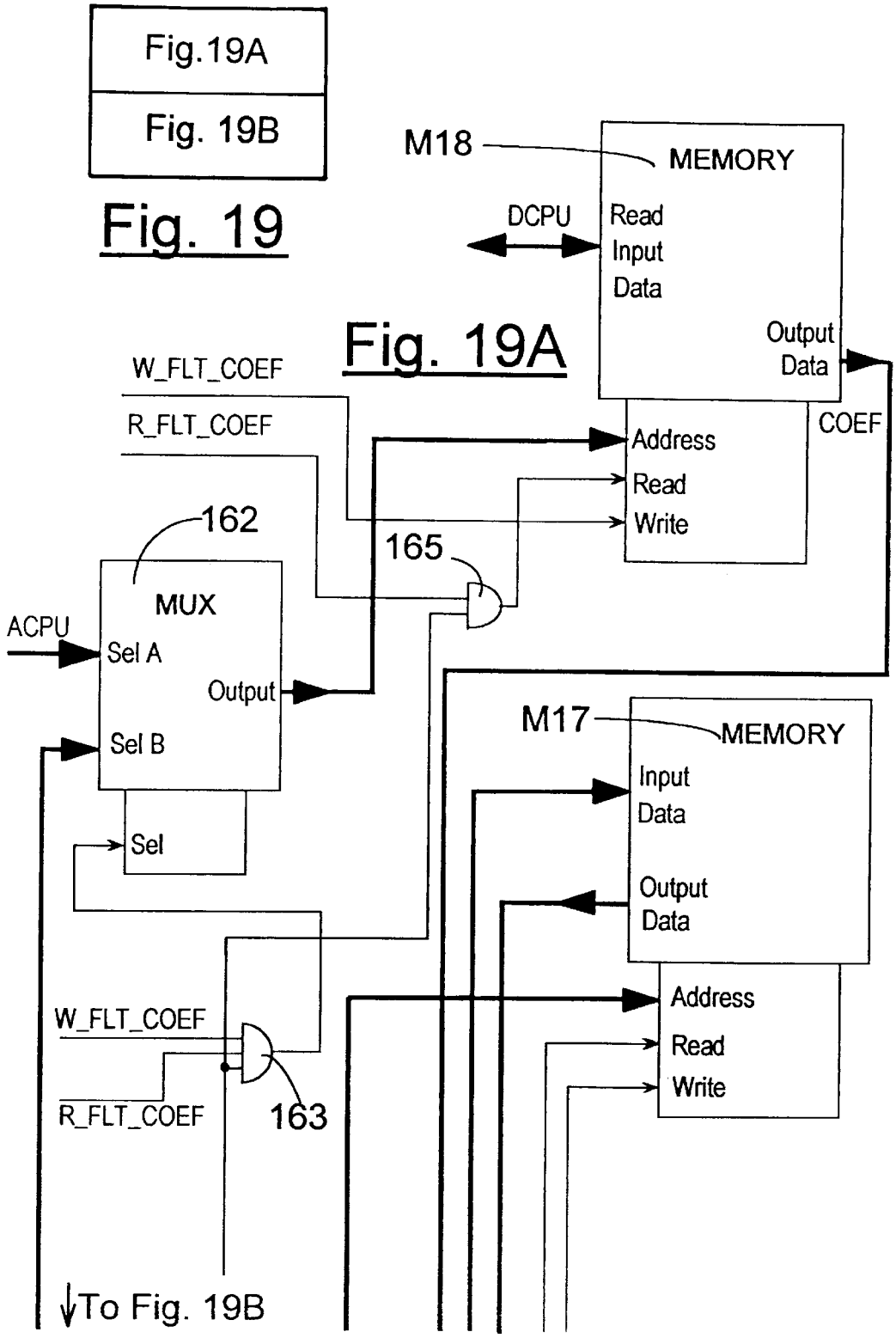
FIG. 19 is a diagram of a circuit for allowing for some filter coefficients in the final phase of generation of the first level samples.
Figure 19B:
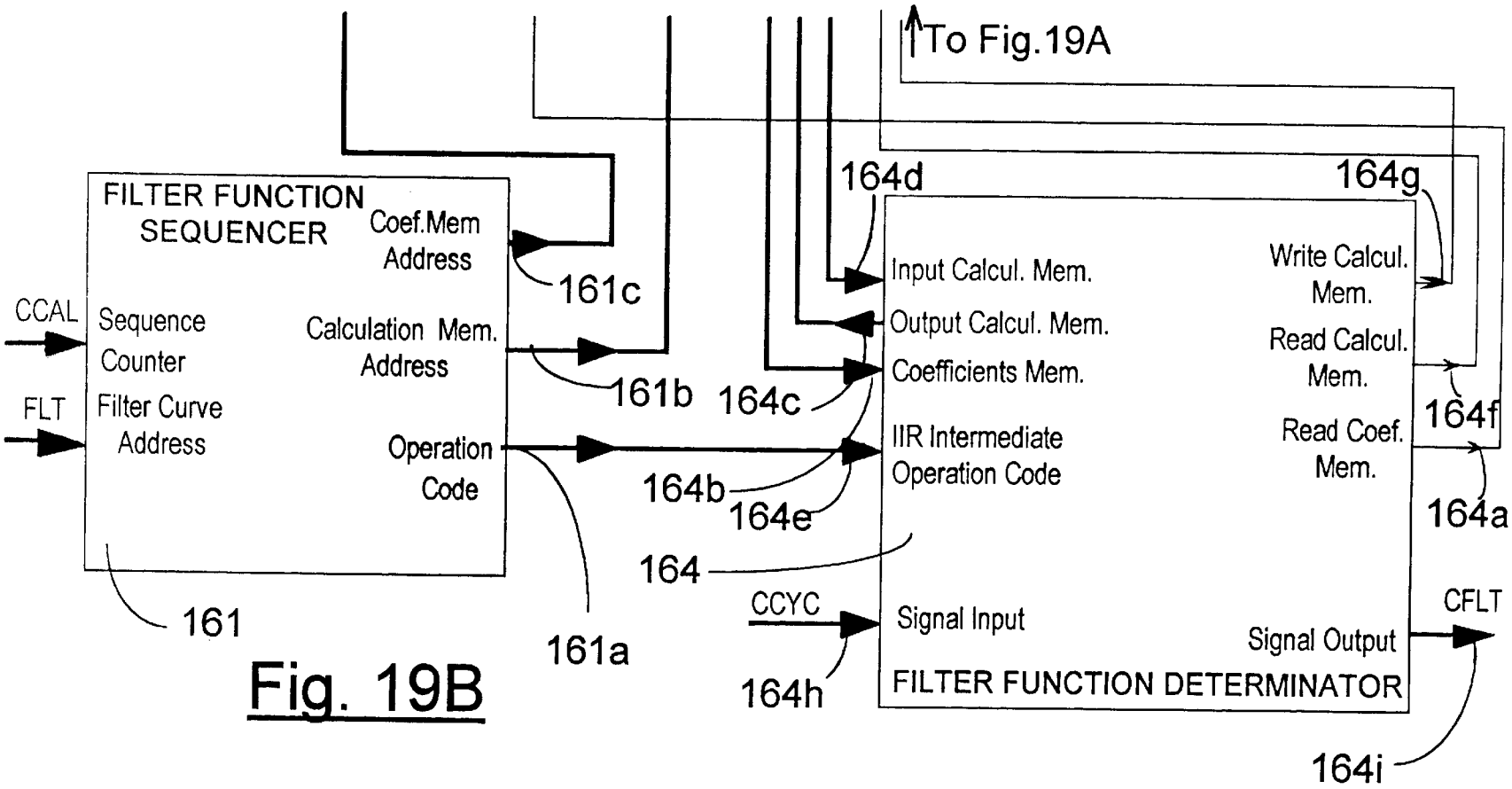

The samples generated in blocks 72, 73 and 74 appears on a bus 75, depending on the mode of operation selected, the signal travelling on this bus being signal CCYC. This signal is applied to a filter unit 76 whose structure is shown in FIG. 19. This unit supplies samples with predetermined filter characteristics, its output signal being the signal CFLT. Each sample of this signal is applied to the input A of a multiplication arithmetic unit U12 in which its value is multiplied by the current amplitude parameter value AMP fed to input B of the arithmetic unit. The result of the multiplication is written in an accumulator memory M13, which has 192 locations, at the address determined by the address value MCC_CEL supplied by selection logic 25b (FIG. 12), under the control of the active pulse of sub-period P4. Memory M13 is a write-only memory, writing at a given address causing the previous written value to be passed to the output. The corresponding signal is representative of successive first level samples and its name is ACC_CEL (cell output).

The four intermediate significant bits of values read in memory M12 are used to determine the mode of calculation for the amplitude, frequency, phase and filter parameters performed in the respective arithmetic unit U4 of each of circuits 20A through 20D in FIG. 6. Their binary value sets arithmetic unit U4 to addition mode or to multiplication mode.

The three most significant bits from memory M12 selectively determine the following modes of operation: continuous, repeat and "forward-backward" for generating first level samples from the cells. The names of these bits are respectively MOD_CCY, MOD_DCY and MOD ALT. These signals will be described with reference to FIGS. 20 and 21.

Figure 14:
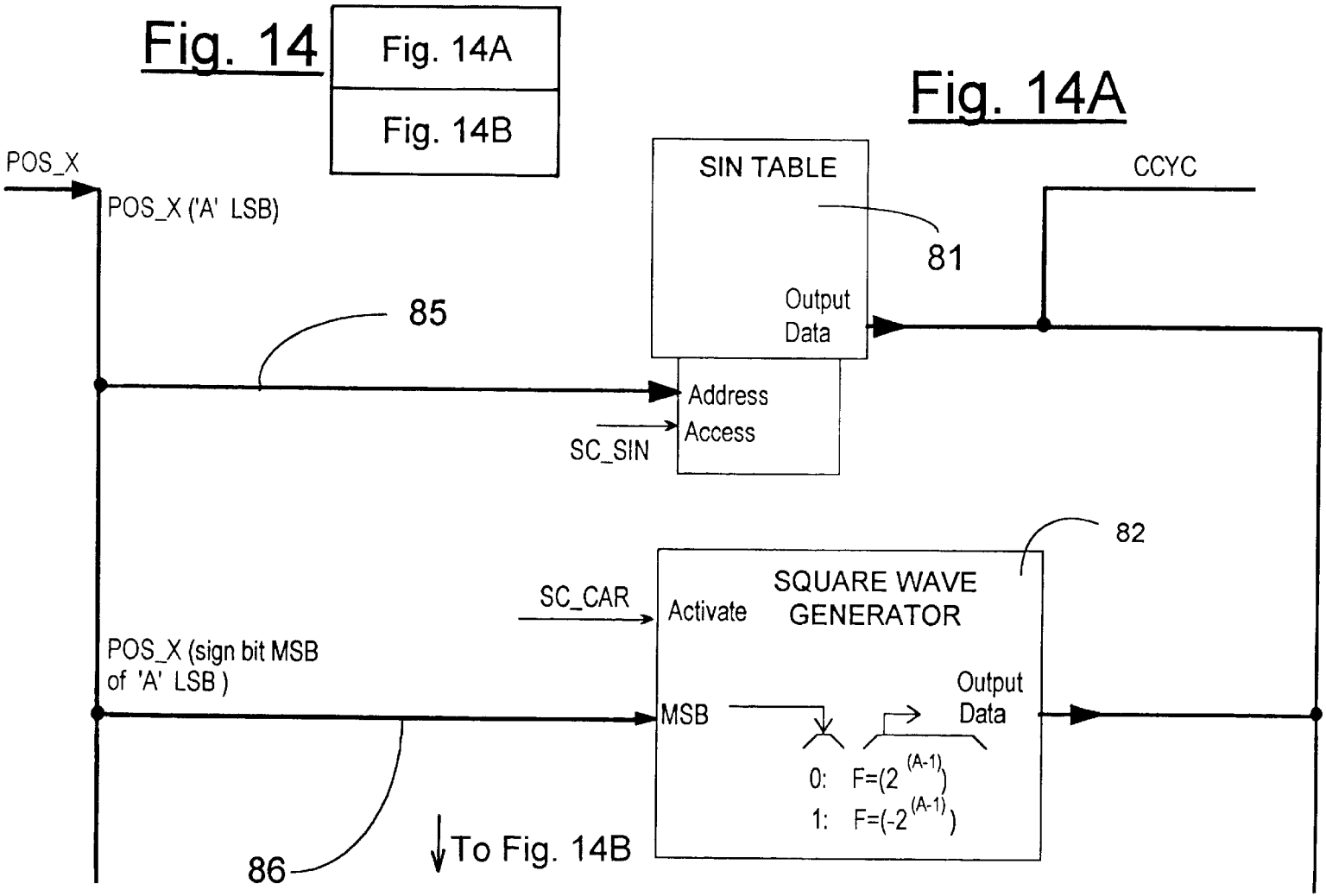
Figure 14B:
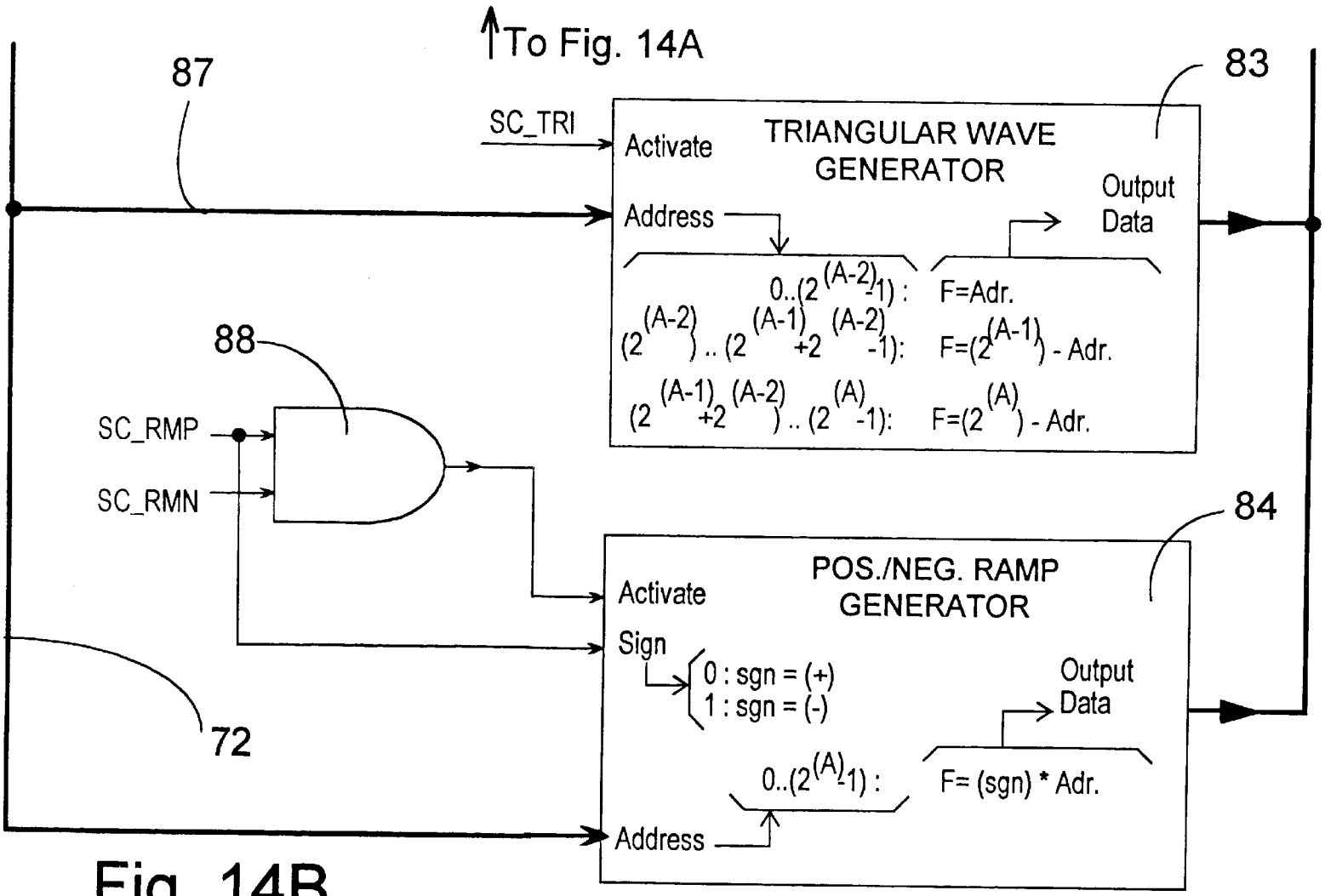

Input block 72 will now be described with reference to FIG. 14. This input block includes four function generators 81 through 84 for producing zero level samples and to which the time value POS_X calculated in calculation circuit 30 from FIG. 7 is applied. It should be remembered at this point that, in accordance with an important feature of the invention, the value POS_X is in fact an address value most of the time.

The first function generator is a sine table 81 storing a predetermined number of sine values, this number being equal to $2^A$ and A being equal to 10 in this example. The table 81 is in fact a memory with $2^A$ locations which can be addressed using address values determined by the A least significant bits of the designation value POS_X. If A=10, for example, the ten least significant bits of the value POS_X are used to prepare each first level sample, i.e. they determine the sine value to be extracted from table 81 provided, of course, this mode of operation is selected. The address value formed by the current value POS_X is fed to the table via the line 85. Access to table 81 is enabled by signal SC_SIN from selection logic 71 (FIG. 13).

Note that the designation value POS_X can have a much larger number of bits than the number A (for example 32) and the same set of addresses of table 81 can therefore be scanned in succession a very large number of times during incrementing of the value POS_X up to its maximum value during operation of the unit SYNT.

Generator 82 is capable of generating a square waveform by determining the times at which the polarity of the first level samples to be generated changes.

Generator 82 is activated on signal SC_CAR from selection logic 71 (FIG. 13). The change is effected in accordance with the sign of the most significant bit of the A bits of the current value of POS_X received via conductor 86. In this case, POS_X therefore does not constitute a memory address as such.

Generator 83 generates triangular functions. This is an arithmetic function calculating a triangular oscillation on the basis of the address on A least significant bits of the signal POS_X used as location addresses. These address values reach it via conductor 87. The addresses and the resulting functions are summarized within the block representing generator 83. The latter is activated under the control of signal SC-TRI from logic 71 (FIG. 13).

Generator 84 is also an arithmetic function calculating a positive or negative ramp oscillation on the basis of the address on A least significant bits of the value POS_X. A series of values stored in this way can be scanned positively or negatively under the control of a pair of signals SC_RMP and SC_RMN, respectively, from logic 71 and fed to an AND gate 88. The output of this gate validates activation of generator 84, the level of signal SC_RMP determining the direction of the series of calculated values. The function generated by the addresses is also indicated inside the block representing function generator 84.

Figure 15:
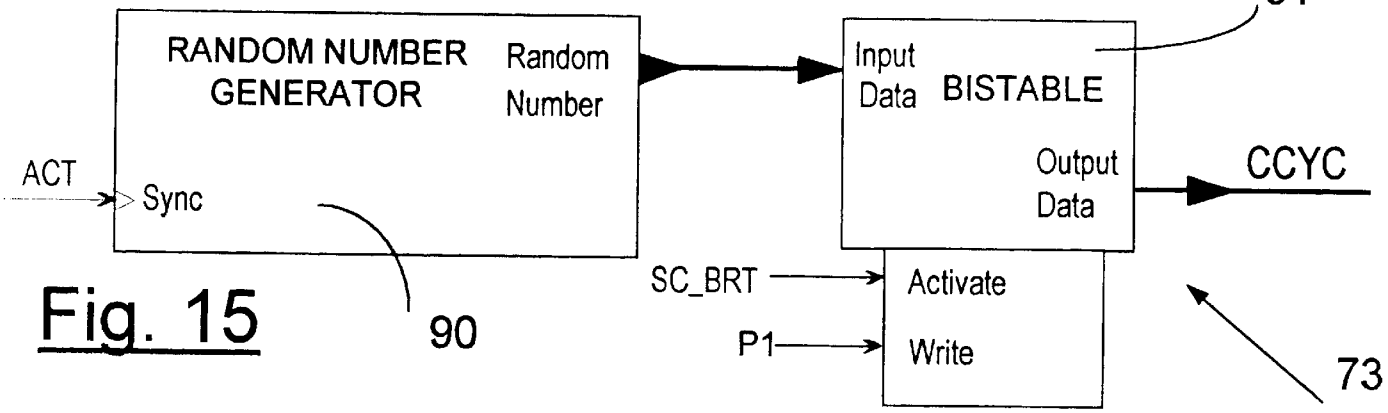
FIG. 15 is a diagram of another circuit for generating first level samples from zero level samples also produced within the synthesizer unit but in this case adapted to generate random noise.

FIG. 15 shows the input block 73 from FIG. 13 in more detail. This block generates first level samples if the latter must have random amplitude values. Input block 73 includes a random number generator 90 operating continuously. On the appearance of a sampling pulse ACT, the number generated at the corresponding time is passed to a bistable 91 into which it is written on the occurrence of the corresponding pulse P1. If bistable 91 is simultaneously activated by enabling signal SCR_BRT, the corresponding data is taken out of bistable 91 and the current sample value will be based on this data.

A part of the input block 100 of the unit SYNT, namely an input allocation circuit, will now be described with reference to FIG. 16. There can be 'e' inputs numbered 0 through e, for example 16 inputs. Each input is typically connected to an analog/digital converter in turn connected to an analog signal source (not shown). The signal sources can be musical instruments fitted with transducers, musical instruments associated with a microphone, turntables, microphones picking up the sound spectrum of an orchestra, a compact disc, etc; a very large number of such sources can be envisaged.

The signals present at inputs 0 through e are denoted IN_0 through IN_e. To be able to allocate them, input block 100 includes a memory M14 with 192 locations into which the CPU can write input allocation values at addresses supplied by signal AC under the command of signal W_ETR_N from block 14 of interface I (FIG. 2). Reading is therefore performed under the command of signal R_ETR_N which also comes from block 14. The data stored in memory M14 by the CPU represents an input allocation code which is fed to multiplexer 25-3 (FIG. 12) whose output is connected to a decoder 101 having e outputs which can activate buffers 102-0 through 102-e whose inputs receive input signals IN_0 through IN_e, respectively. Consequently, depending on the content of memory M14 and the status of multiplexer 25-3, an external input for a given cell is applied to a bus 103 common to all buffers 102-0 through 102-e. The name of the signal on this bus is IN_CEL and it therefore forms zero level samples.

Note, however, that signal IN_CEL, and likewise signals ACC_CEL, ACC_ENS and ACC_DET, can be used as selected parameter values provided that they are allowed to pass to the output of logic 25*a* (FIG. 12) under the control of signal ADR_CTR. If this is authorized, the value of IN_CEL is routed as signal DATA_CTR so that it can be combined by multiplication or addition with the current value of a parameter under the control of signal MODE_FCT.

Figure 17:
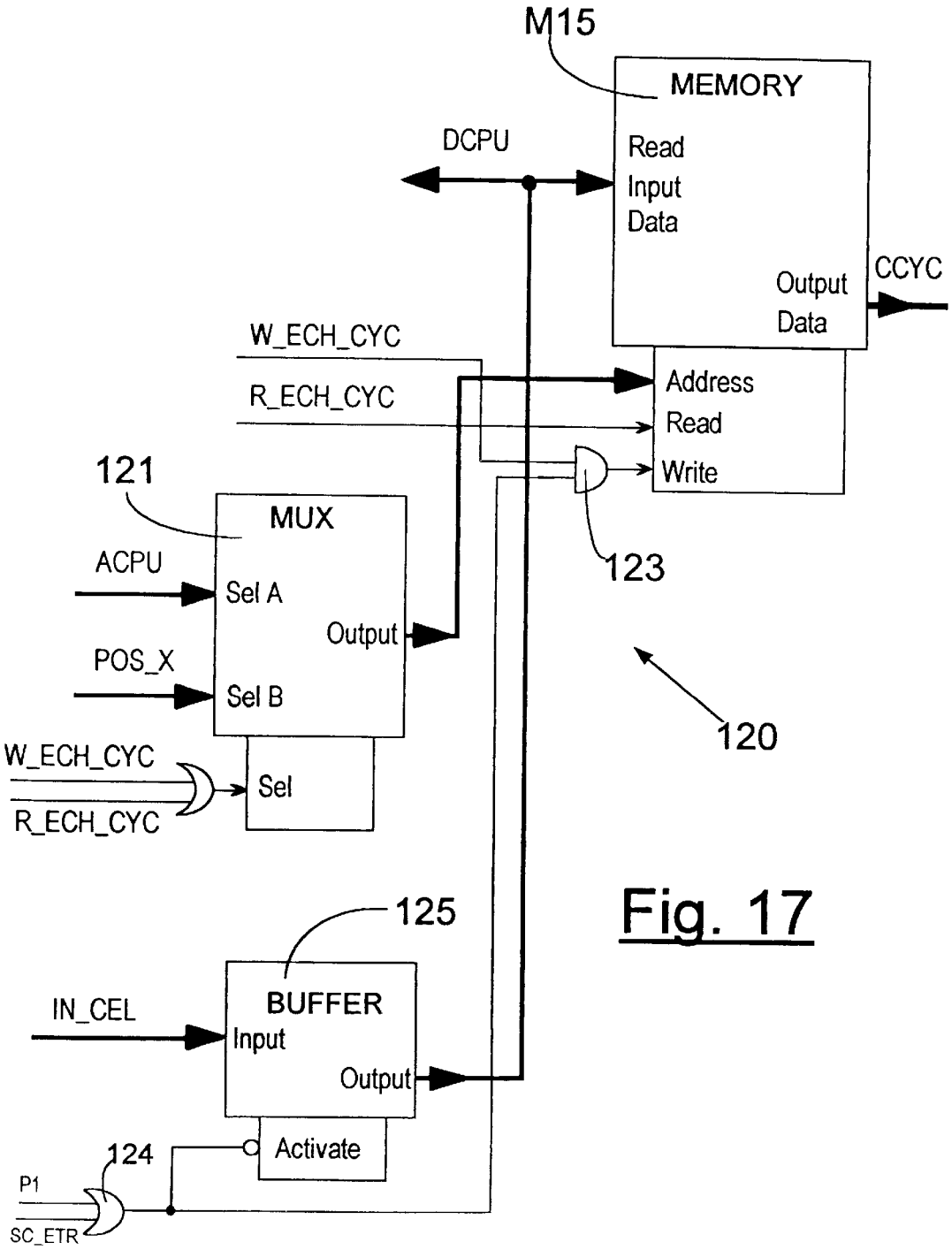
FIG. 17 is a diagram of a circuit for storing some zero level samples.

FIG. 17 is a diagram of a circuit for storing zero level samples and selecting the temporal use of those samples for producing first level samples in the cells of the unit SYNT.

The circuit includes a high-capacity sample memory M15 which can store a large number of zero level samples. This memory can have $2^{32}$ locations, for example. Note, however, that the capacity of memory M15 can be larger or smaller according to the length of a required record of successive samples. Note also that this memory is the only one of the system in accordance with the invention which needs to have a high capacity.

The addresses of memory M15 come from a multiplexer 121, for example a 32-bit multiplexer, having an input A receiving address signal ACPU from interface I (FIG. 2). These addresses are therefore determined by the CPU. Also, the data input of zero level sample memory M15 is connected to block 13 of interface I so that the CPU can write data into this memory at addresses it sets itself. This mode of storage in memory M15 enables the use as zero level samples of, for example, signals selected graphically by a user on the screen of the CPU, the application program of the control unit naturally being designed specifically for this task, as is well known in the art. The address ACPU is activated by signals W_ECH_CYC and R_ECH_CYC which respectively control writing and reading by a CPU.

The other input B of multiplexer 121 is connected to the output of the calculation circuit 30 from FIG. 7 from which it therefore receives the current value of POS_X, here also used as an address, but this time for memory M15 (current value of POS_X). Output B is selected when signals W_ECH_CYC and R_ECH_CYC are active. These signals from block 14 of interface I are both applied to an OR gate 122 whose output is connected to the activation input of multiplexer 121. Input A of multiplexer 121 is activated if either of these two signals is active.

Also, readingAriting in sample memory M15 can be selectively controlled by the same signals R_ECH_CYC and W_ECH_CYC. To this end, signal R_ECH_CYC is applied directly to the read command input of memory M15 and signal W_ECH_CYC is applied to an AND gate 123 whose output is connected to the write command input of the same memory.

The other input of the AND gate 123 is connected to the output of an OR gate 124. This receives at its first input the signal corresponding to the active pulse of period P1 and at its other input signal SC_ETR which can be activated if the data in memory M12 (FIG. 13) designates the mode of operation corresponding to the output of decoder 71.

The output of the OR gate 124 is fed to the activation input of a buffer 125. This receives at its input the signal IN_CEL that constitutes the output of the input allocation circuit from FIG. 16. The output of buffer 125 is connected to the data input of sample memory M15.

The output of OR gate 124 is also connected to one input of AND gate 123 to enable the write input of memory M15 to be activated.

Accordingly, zero level samples can be written at addresses which depend either on the CPU, by way of signal ACPU on activation by signal W_ECH_CPU for writing a sample into memory M15, or on incrementing the current value POS_X by 0001. This selection depends on the status of selection signal SC_ETR for placing multiplexer 32 in one or other of its configurations.

Consequently, the address at which the data is written into memory M15 depends on the address specified by the CPU or by incrementing the value POS_X by '1' under the control of signal SC_ETR. This latter manner of incrementation corresponds in reality to reproduction in real time of zero level signals (whence ETR:

real time inputs). Note that when memory M15 is in the real time operating mode, the written exits immediately the memory. In the other, sampling (ECH), mode of operation, the data can remain in the memory for a predetermined time, the memory then acting to some degree as a "tape recorder".

When signal SC_ETR is active, memory M15 is used alternately for writing (P1) and for reading to obtain the zero level sample. If signal SC_ECH is active (FIG. 13), memory M15 is used in write mode only to write a new sample. The memory is normally used in read mode, the sample being read in the same manner as for the sine table of block 81 from FIG. 14, except that in the case of memory Mthe sample can be modified at any time point by point and the dimension of the sample table contained in memory M15 can be predetermined or chosen at will, although this is not the case for the sine table of block 81.

In any event, the signals from sample memory M15 form signal CCYC which are first level samples not yet filtered in filter circuit 160.

Figure 18A:
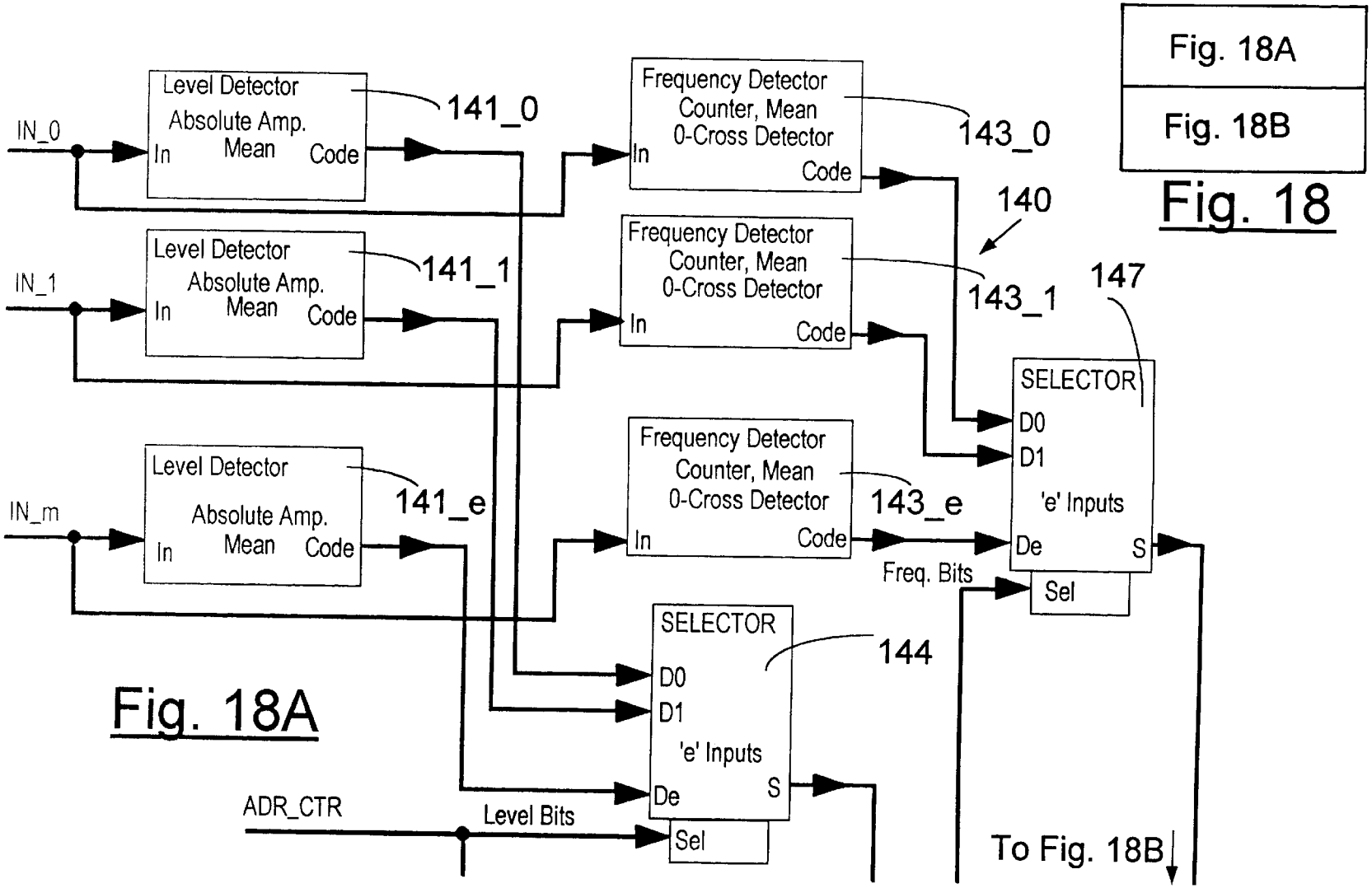
Figure 18B:
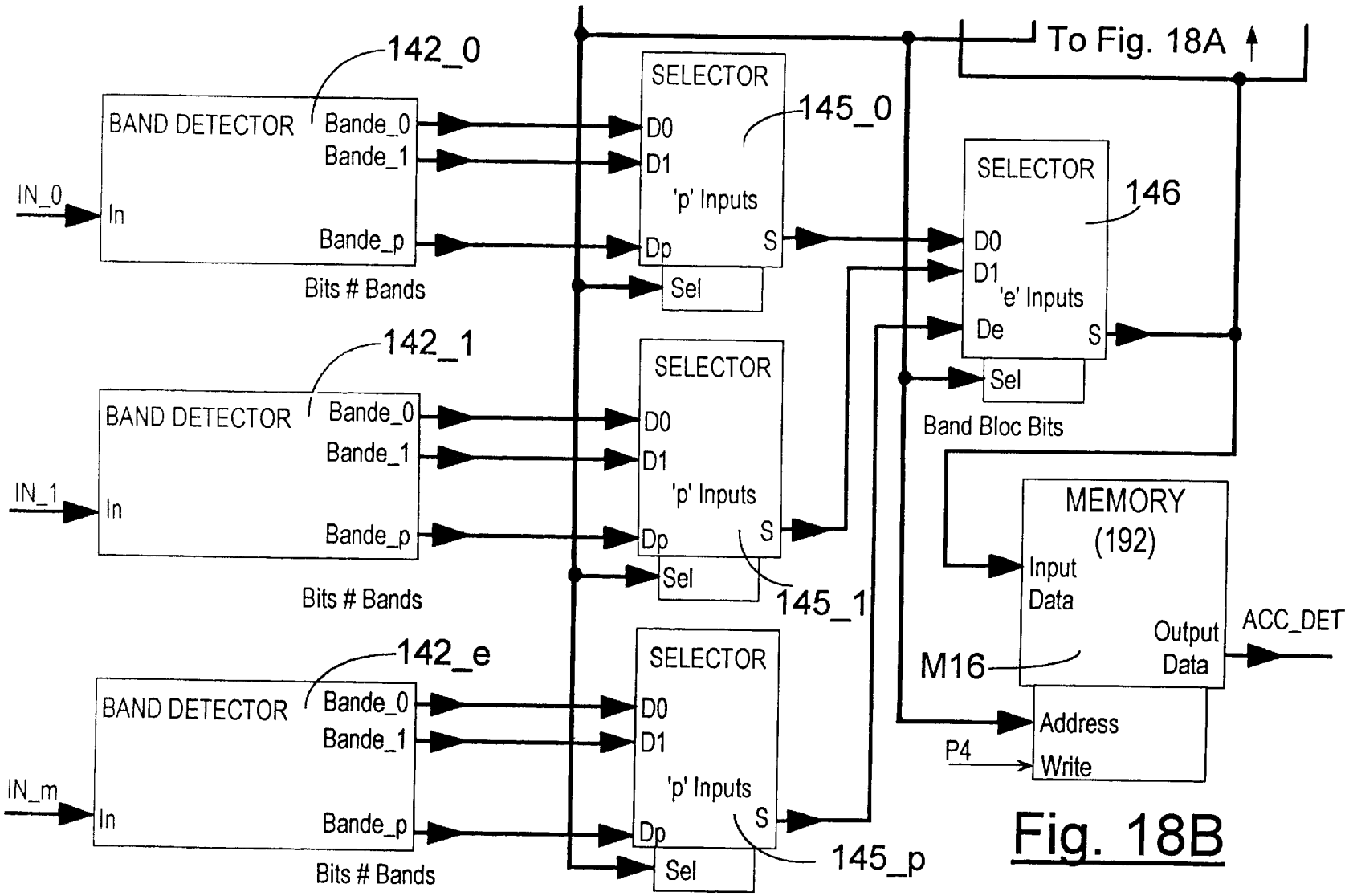

FIG. 18 shows a circuit for analyzing input signals applied to inputs IN_0 through IN_e of the synthesizer unit SYNT. This circuit 140 is called a "parameter detector circuit" because it is designed to detect in the input signals amplitude, frequency and amplitude distribution as a function of frequency (band) properties which, by being converted into digital signals, can be used to adjust the parameter values which the cells will use to form the first level samples in the synthesizer unit.

The inputs of detector circuit 140 are connected in parallel to inputs IN_0 through IN_e of the synthesizer unit, together forming the signal E from FIG. 1. Consequently, the inputs of the allocation circuit from FIG. 16 and the detection inputs from FIG. 18 are connected in parallel.

Detector circuit 140 includes a first group of detectors 141_0 through 141_e for determining the absolute value of the amplitudes of the digital sound samples applied to respective inputs IN_0 through IN_e via analog/digital converters (not shown). They are also designed to establish the average value over a number of successive samples and to supply a corresponding digital value at their output.

The detector circuit 140 includes a second group of detectors 142_0 through 142_m for determining an average amplitude value in each of a plurality of p frequency bands of series of samples respectively applied to inputs IN_0 through IN_e. These average amplitude values appear at a particular output 0 through p of each detector, in the form of a digital code, and for each of the p bands.

Detector circuit 140 further includes a third group of detectors 143_0 through 143_e for determining time properties of the series of input samples, and in particular the zero crossing times, their average frequency and a count value. This data is present in the form of digital codes at each of the outputs of detectors 143_0 through 143_e.

All the digital values from the detectors of circuit 140 can be selectively placed in an accumulator memory M16 with 192 locations under the command of the active path of sub-period P4. The addresses at which these values are written in this memory are formed by the least significant bits of signal ADR_CTR applied to block 25 shown in FIGS. 5 and 12. The most significant bits of this signal respectively determine the position of a plurality of selectors to which the detector output values are applied. Accordingly, the outputs of detectors 141_0 through 141_e are applied to 'e' inputs of a selector 144 in accordance with a series of amplitude bits of signal ADR_CTR. Selective activation of these bits connects a particular output of detectors 141_0 through 141_e to the output of the selector, which will then be written under the control of the active pulse of sub-period P4 into a corresponding part of the location of that memory designated by the concomitant address part of signal ADR_CTR.

Likewise for other groups of bits, forming "band" bits of signal ADR_CTR and enabling selectors 145_0 through 145_p to be set so that amplitude values respectively corresponding to the various bands 0 through p on which detectors 142_0 through 142_e work can be grouped at their output. The values corresponding to the grouped bands can also be selected using a selector 146 which receives the grouped values at its inputs DO through De. The output of selector 146 forms a part of the digital signal sent to locations of memory M16. Finally, a selector 147, with the aid of the frequency bits of signal ADR_CTR, allocates the digital values at the output of detectors 143_0 through 143_e to the various memory locations of memory M16.

Consequently, the latter can contain for each cell of the unit SYNT a digital value for which the stored data represents the values of the amplitude and frequency parameters of external digital samples applied to the unit SYNT.

As shown in FIG. 5, the parameter values obtained in this way from the input signal can be used in calculating parameter values (value VAL) provided that at the time concerned signal ACC_DET is authorized to reach the output of block 25*a* from FIG. 12 under the control of signal ADR_CTR from the CPU, as shown in FIG. 2. Remember that signal DATA_CTR can be combined by addition or multiplication with the current value of a parameter under the control of signal MODE_FCT, which is applied to arithmetic unit U4 in FIG. 5, this signal MODE_FCT being itself selected by the content of memory M12 (FIG. 13) loaded by the CPU.

Thus it can be seen that the generation of first level samples in the cells can be determined by four separate parameter values respectively contained in signals ACC_CEL, ACC_ENS, ACC_DET and IN_CEL, as can be seen from FIG. 12.

FIG. 19 shows the filter circuit 160 for appropriately filtering signal CCYC, as shown by block 76 in FIG. 13.

This circuit includes a filter function sequencer 161 which receives signal CCAL from interface I (FIG. 2) to drive a sequence counter and signal FLT from the FIG. 5 circuit as a parameter determining the filter action by ultimately selecting filter coefficients in a memory M18. This signal in fact determines an address of a table containing a predetermined filter coefficient curve. The sequencer thus determines a filter operation code which appears at its output 161*a*. The sequencer can also generate two types of address values, respectively appearing at its outputs 161*c* and 161*b*.

The address value at output 161*b* is applied to a filter calculation memory M17. Memory M17 has a predetermined number of locations, for example 16 384. Address output 161*c* is applied to input B of a multiplexer 162 whose input A can receive address values directly from block 12 of interface 1. These values are written by the CPU to characterize these filters (coefficients) in a memory M18. The filter process is used to read this data for the calculation.

Input B of multiplexer 162 is selected under the command of the output of an AND gate 163 which is open provided that one of the three signals is present, i.e. read signal R_FLT_COEF, write signal W_FLT_COEF or a coefficient read command signal constituting an output 164a of an IIR filter function determination block 164.

The output of multiplexer 162 is fed to the filter coefficient memory M18. This memory receives its data directly from the CPU. The data is written at the appropriate addresses under the control of a write signal from an AND gate 165. A first input of this AND gate is connected to block 14 of interface I (read signal R_FLT COEF), and its other input is connected to output 164*a* of the filter function determination block 164.

The data output of the filter coefficient memory M18 is connected to an input 164*b* of block 164. For reading coefficients, the data input and output of the filter calculation memory M17 are respectively connected to output 164*c* and input 164*d* of block 164. The latter receives the operation code from block 161 at its input 164*e*. Reading in memory M17 is controlled by a signal from output 164*f*. The write control signal comes from output 164*g* of block 164.

Finally, block 164 has an input 164*h* to which is applied the signal CCYC originating selectively from blocks 72, 73, and 74 of FIG. 13. The finished "filtered" samples appear at output 164*i* of block 164. Note that memory 17 can store filter calculation intermediate data temporarily, this data producing the filter signal at output 164*i*, i.e. signal CFLT which is the signal used in FIG. 13 to determine the level 1 sample. The operation code commands transmission of the signals between the inputs and outputs of block 164.

The circuit 180 for determining time limits of certain sample production processes will now be described with reference to FIGS. 20 and 21. These production processes are the sample mode when the unit SYNT works with samples from memory M15 from FIG. 17 and the real time sampling mode. The determination circuit 180 is therefore validated at the appropriate time by signal SC_ECH or signal SC_ETR applied to an AND gate 181 shown at the top of FIG. 20.

The determination circuit 180 includes a memory M19 which can store start time values (i.e. values representing a predetermined time on the time axis by accumulation of a particular number of values analogous to values POS_X) of a series of particular samples representing a note to be played, for example. Memory M19 has 192 locations and can therefore be loaded with a start time value for each cell. The address value is formed by signal AC and data is written/read in the memory from the management unit CPU under the control of signals W_ECH_DEB/R_ECH_DEB.

Another memory M20, which also has 192 locations, stores end times of a series of samples in an analogous manner. Data is written/read in this memory by signals W_ECH_FIN/R_ECH_FIN. The determination circuit also includes two memories M21 and M22 with 192 locations in which "loop" values can be stored, to be more precise time values representing a loop start time and a loop end time, the word "loop" being understood in the present context as cyclic repetition of the same series of samples by one of more cells. Memories M21 and M22 can be written and read under the command of signals W_ECH_B2/R_ECH_B1 and W_ECH_B2/R_ECH_B2, respectively. The data comes each time from the CPU.

Each memory M19 through M21 is associated with a respective comparator 182 through 185 each of whose input A is connected to the data output of the associated memory and each of whose input B receives the current value of POS_X. Comparators 182 and 184 supply an enabling signal when their input B is less than or equal to their input A and comparators 183 and 185 supply a signal of this kind if input B is greater than or equal to input A.

The outputs of comparators 182 through 185 are respectively connected to activation logic units 186 through 190 each receiving a plurality of signals which are combined logically therein to activate the output buffers 192 through 195, if necessary, their outputs selectively supplying the value INIT_X, which is a particular initialization value from which POS_X is then incremented by designation values calculated in calculation circuit 30.

Activation logic units 186 through 191 also receive mode signals MOD_CCY, MOD_DCY and MOD_ALT which are contained in the output data of memory M12 from FIG. 13.

Another output buffer 196 sets the value INIT_X to zero if signal SC_ECH or SC_ETR is inactive, via an inverter 197.

The limit determination circuit 180 also includes a sign memory M23 with 192 locations in which can be written the sign determining the direction of advance of the value POS_X. This memory M23 is addressed by signal AC and receives the sign bit to be stored for the cells of a multiplexer 198. By way of selection signal, the latter receives signal C_INIT from comparator 50 in FIG. 8. This signal causes the appropriate sign to be passed to the output of the multiplexer when signal C_INIT is active. Otherwise, the sign signal comes from a logic gate 199 which logically combines the output of memory M23 with mode signal MOD_ALT. When the latter is active ('0'), the sign changes each time memory M23 is written.

Another multiplexer 200 is controlled by the same mode signal MOD_ALT to establish selectively the signal SGN used in block 34 of calculation circuit 30 from FIG. 7. Input A of this multiplexer receives a signal T_DIR and input B receives the mode signal MOD_DCY.

Note again that buffers 194 and 195 are activated by respective AND gates 201 and 202 and that writing in memory M23 is controlled by logic unit 203.

Buffer 192 fixes the limit at the point or at the start time E_DEB of the series of samples, when POS_X reaches the start address E_DEB or less on comparator 182 in the case of a non-cyclic mode (MOD_CCY=1) which is decreasing (MOD_DCY=0), the selection being performed by gate 186.

Buffer 193 fixes the limit at the end point E_FIN of the series of samples when POS_X reaches the end address E_FIN or more on comparator 183 in the case of a non-cyclic mode (MOD_CCY=1) that is increasing (MOD_DCY=1), the selection being effected by gate 187.

Buffer 194 fixes the limit at the loop-1 point E_B1 of a series of loop samples when the value POS_X reaches loop-2 address E_B2 or more on comparator 185 in the case of a cyclic mode (MOD_CCY=0) which is increasing (MOD_CCY=1) and not alternating (MOD_ALT=1), the selection being effected by gates 191 and 201. This value setting applies also in the case of a cyclic mode (MOD_CCY=0) that is alternating (MOD_ALT=0), but decremented (T_DIR=0), if the value POS_X reaches the loop-1 address E_B1 or less on comparator 184, the selection being done by gates 188 and 201. In alternating mode, the value of T_DIR will be set to 0 by gate 203 when fixing the limit E_B1 to start decrementing.

Buffer 195 fixes the limit at loop-2 point E B2 of the series of samples when the value POS_X reaches loop-1 address E_B1 or less at comparator 184 in the case of a cyclic mode (MOD_CCY=0), decreasing (MOD DCY=0) and not alternating (MOD_ALT=1), the selection being effected by gates 189 and 202. This value setting applies also in the case of a cyclic mode (MOD_CCY=0), alternating (MOD_ALT=0) and incrementing (T_DIR=1), when the value POS_X reaches loop-2 address E_B2 or more at comparator 185, the selection being effected by gates 190 and 202.

The limits are fixed by signal INIT_X which is routed to multiplexer 35 (FIG. 7) which uses command CD_INIT from gate 208 to reinitialize the value POS_X.

Figure 21:
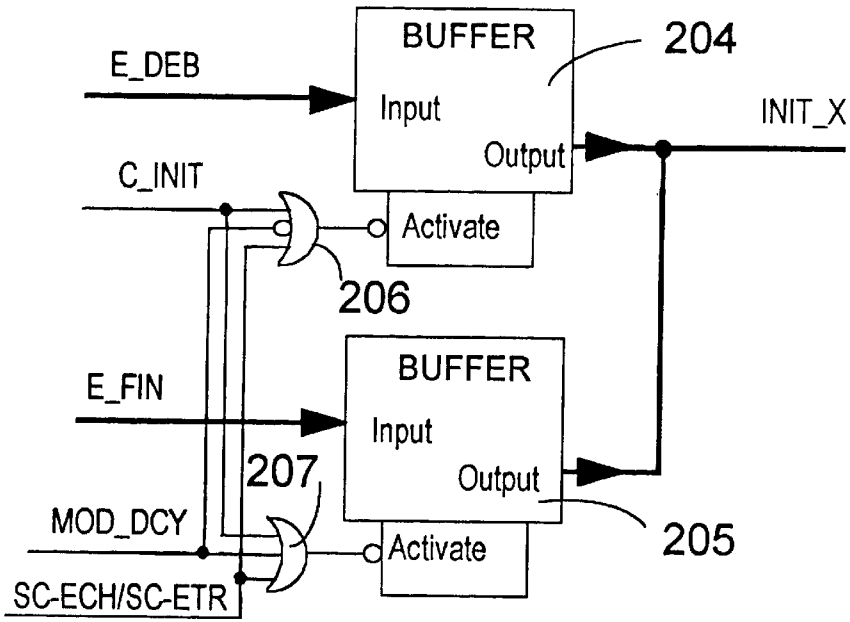
FIGS. 20, 20A–D and 21 are diagrams illustrating a circuit for producing time limits used during the generation of the first and second level sound samples.

As shown in FIG. 21, signal INIT_X can also be selectively produced by the output of two buffers 204 and 205 which respectively receive signals E_DEB and E_FIN from memories M19 and M20. These buffers are activated by the appropriate logic combination of signals C_INIT (phase synchronizabon), mode signal MOD_DCY and the output signal of OR gate 181, this logic combination being formed by OR gates 206 and 207.

Buffer 204 fixes the initial value (or position) of POS_X on activation of C_INIT and of mode signals SC_ECH/SC_ETR. When MOD_DCY=1 (increasing) start point E_DEB constitutes the initialization value transmitted to INIT_X, if MOD_DCY=0 (decreasing) and end point E_FIN constitutes the initial value transmitted to INIT_X. The latter signal is then selected at multiplexer 35 (FIG. 7) to initialize the value POS_X.

Figures 20, 20A, 20B, 20C, 20D:
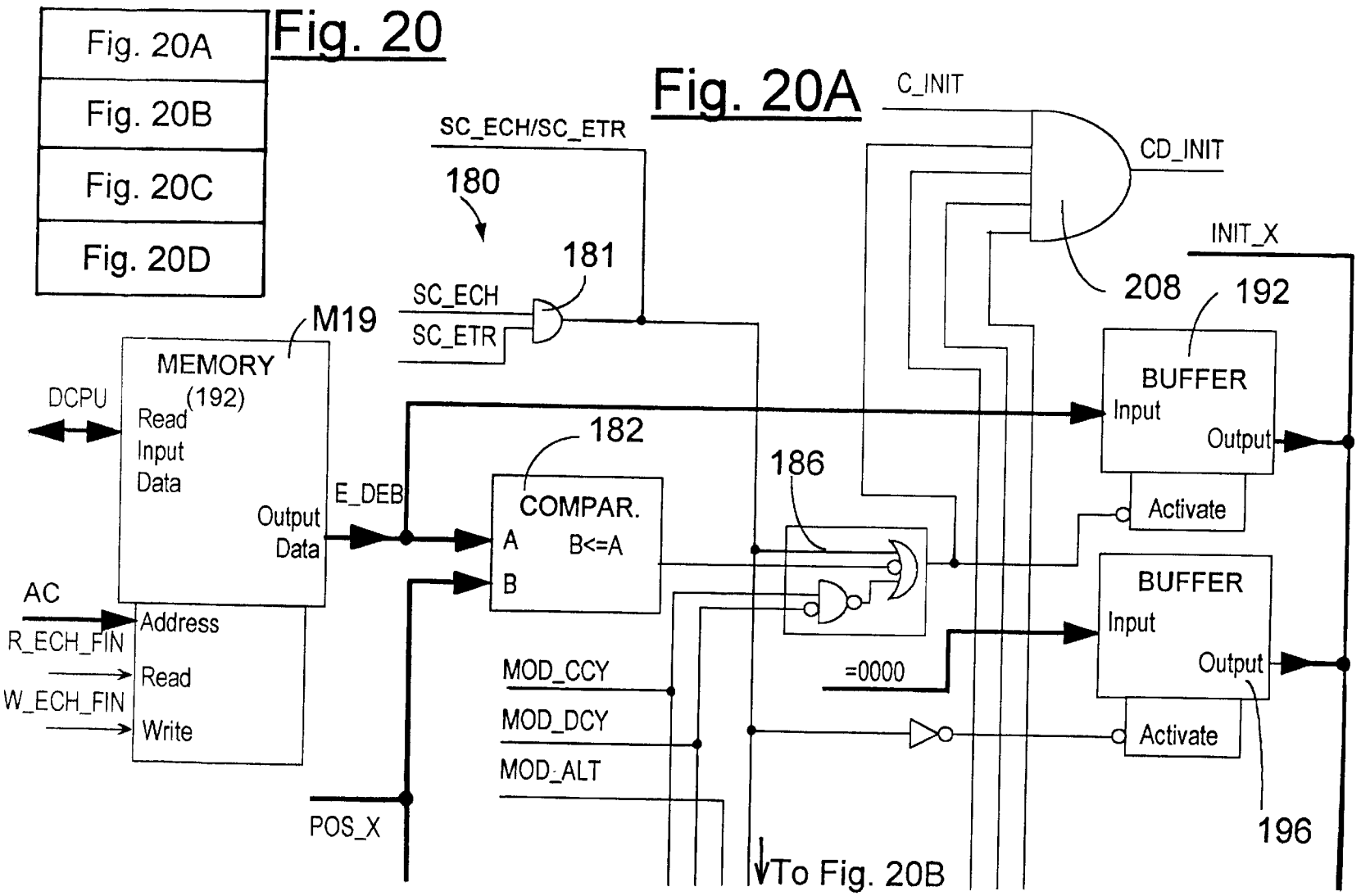
Figure 20B:
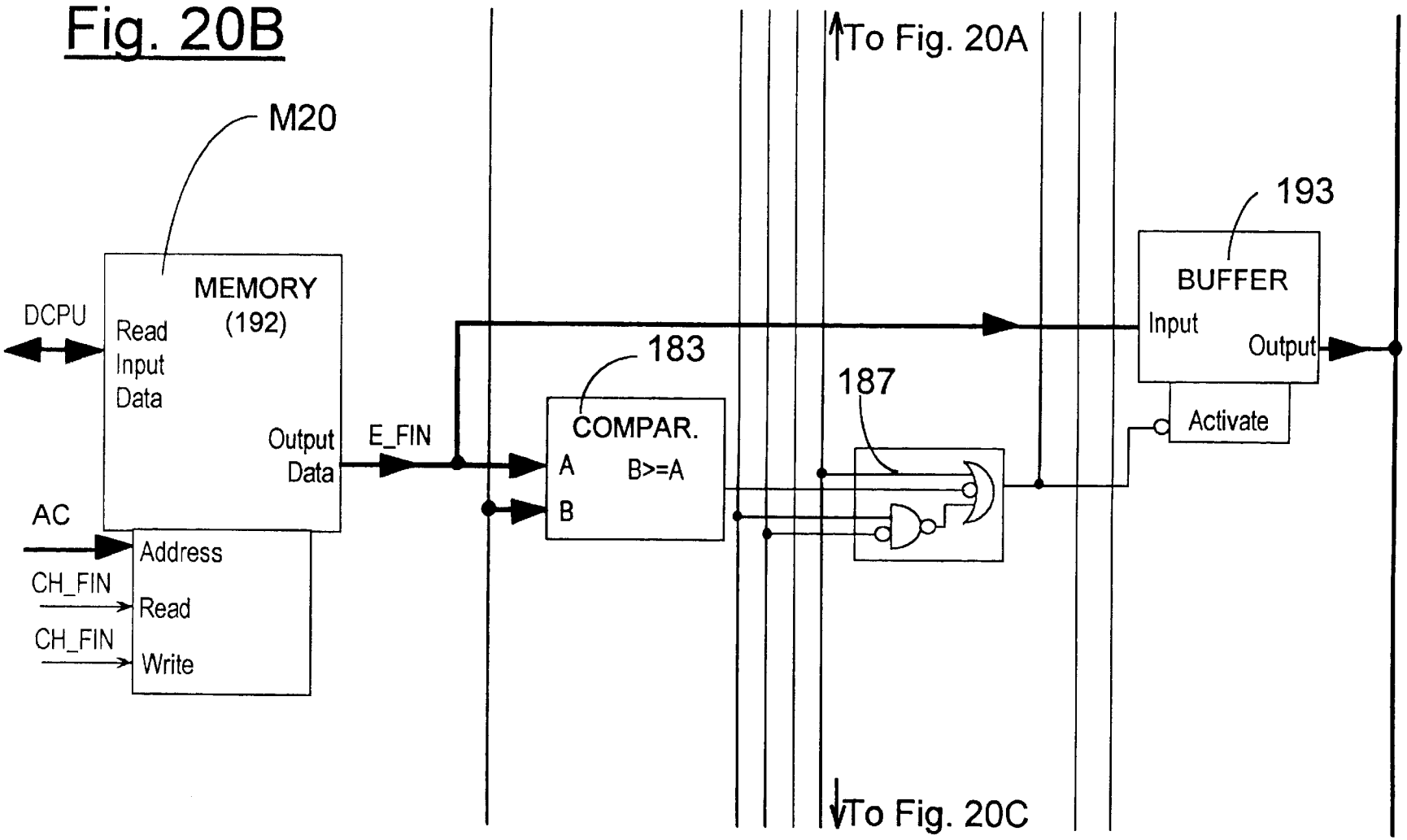
Figure 20C:
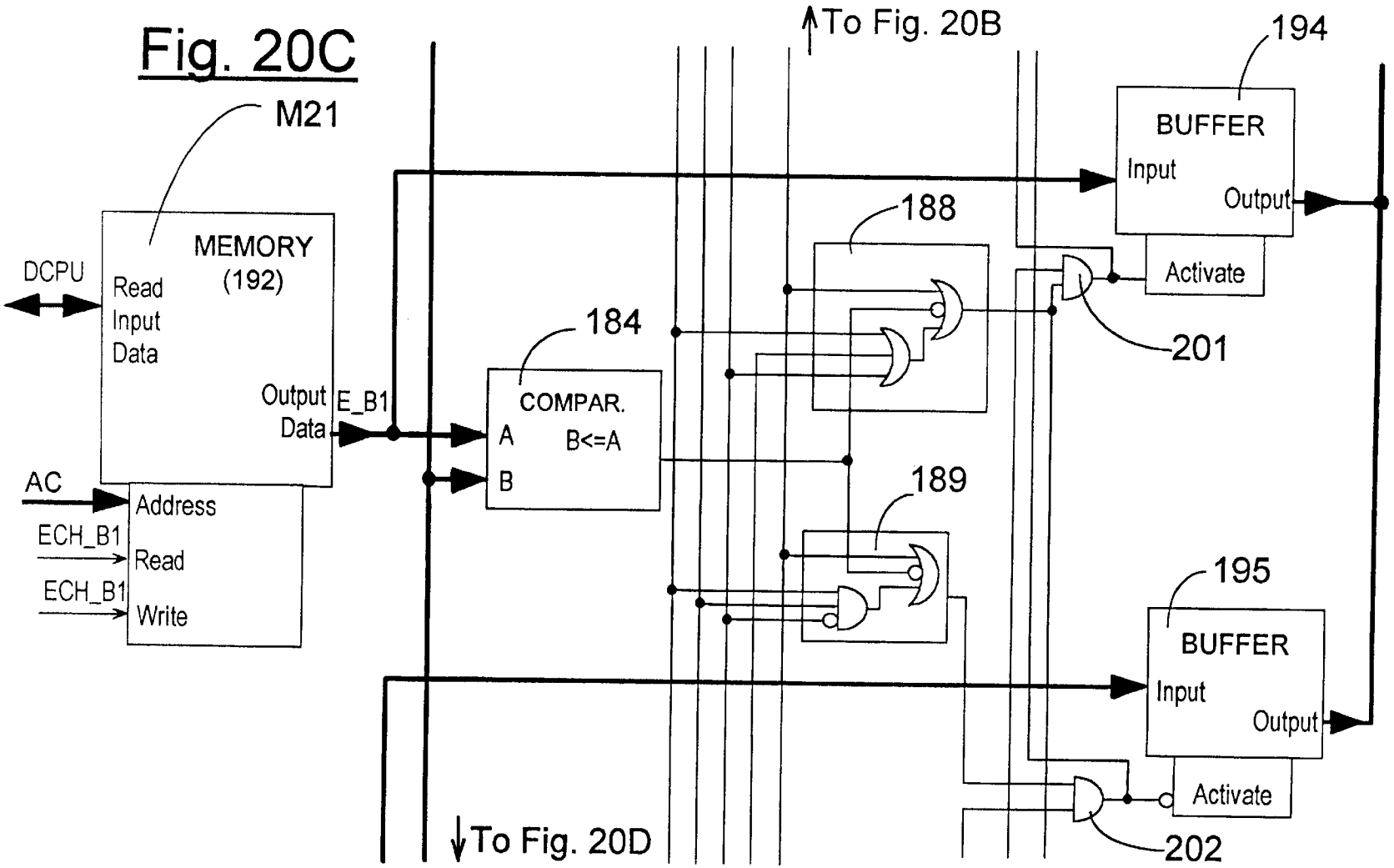
Figure 20D:
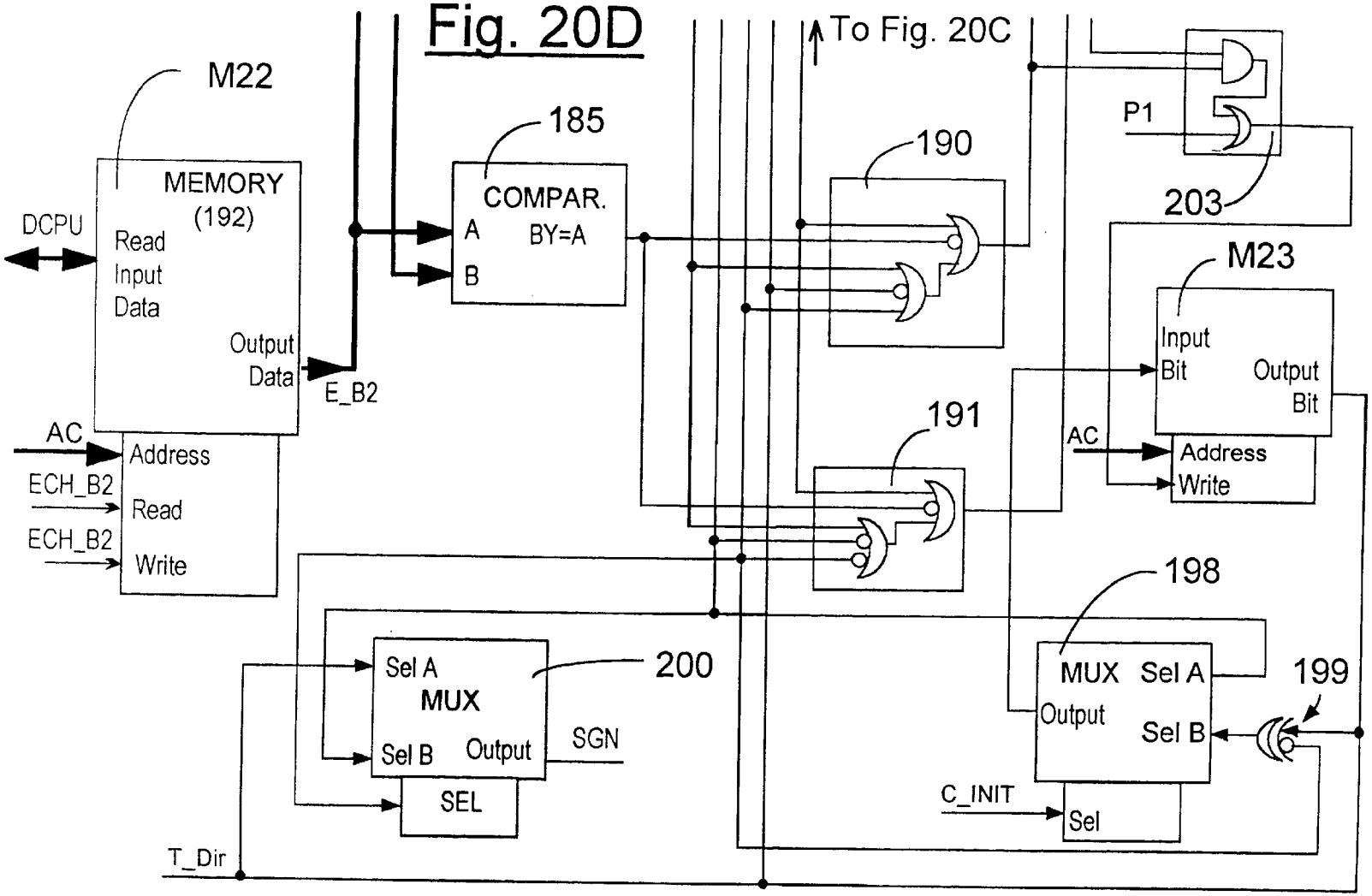

Note further that signal C_INIT is passed through an AND gate 208 and is seen at the top in FIG. 20. This gate supplies signal CD_INIT.

How the circuit for determining time limits works will now be described.

When the phase of a cell is synchronized, for example at the start of a new note to be played, the value POS_X must be set to its initial value via multiplexer 35 of calculation circuit 30 (FIG. 7).

When the unit SYNT is placed in one of the various modes by signal SC_SIN, SC_CAR, SC_TRI, SC_RMP or SC_RMN, the initial value INIT_X of POS_X is equal to zero. This value is passed through buffer 196 which is activated in the absence of signal S_ECH or SC_ETR.

In contrast, in mode SC_ECH or SC_ETR, the value INIT_X is determined by a start time of a given cell on the time axis. The corresponding time value is the value E_DEB stored by the cell concerned in memory M19 if the increment of the value POS_X must be positive (signal MOD_DCY=1). If the increment is negative (signal MOD_DCY=0), the initial value is the value E_FIN stored in memory M20 for the cell concerned.

A series of first level samples for each cell can be delimited in time by time limits between which the value POS_X can change, by being incremented or decremented or "looped", which amounts to repeating the same series of samples a particular number of times. Such looped repetition can also be done in various ways: "forward", "bactcward" or alternately "forward" and "backlward".

Of course, the values POS_X delimited in this way constitute each time an address of memory M15 (FIG. 17) which stores sample values to be reproduced either in real time (mode ETR) or from samples already stored there beforehand (mode ECH).

A number of situations that can arise for each cell or for some cells during the production of first level samples in the operating modes just referred to will now be examined.

1) Series of samples; incrementing of POS_X In this case, at the beginning (i.e. at the time of phase synchronization), sample memory M15 is addressed using value E_DEB. The address is then increased progressively by incrementing the value POS_X calculated in calculation circuit 30 as a function of frequency values FRE and ENS_FRE which are imposed on the calculation circuit, in a manner similar to that described with reference to the waveform generators from FIG. 14.

When the value POS_X subsequently reaches or exceeds the value E_FIN stored in memory M20 it is no longer increased and remains at this value until a new phase synchronization is requested (new note).

The process is then as follows:

MOD_CCY=1, which means that the series of first level samples is not cyclic, and MOD_DCY=1, which means that the increments of POS_X are positive.

While POS_X<E_FIN, POS_X is incremented from the imposed value, no control being exercised by signals INIT_X or CD_INIT.

If POS_X>=E FIN, POS_X is maintained at the value of E_FIN by setting the values of signals INIT_X and CD_INIT. For this, the output of logic block 187 must be at '0'; consequently, the output of gate 181 must be at '0'(SC_ECH or SC_ETR=0) and the output of comparator 183 must be at '1'(true comparison which is inverted at the input of logic block 187) and Not[MOD_CCY and MOD_DCY]=0.

Buffer 193 is activated by the status of logic unit 187 and transmits E_FIN on the bus which transmits INIT_X to the calculator circuit 30. CD_INIT activates initialization by virtue of the status of gate 208 whose output is at '0' through the intermediary of the output of logic block 187.

2) Series of samples, decrementing of POS_X

On phase synchronization, memory M15 is addressed using the value E_FIN. POS_X is progressively decremented from this value as a function of frequency, the decrements being calculated in the calculator circuit 30; when POS_X<=E_DEB, its value is no longer decremented and it retains the value E_DEB until a new phase synchronization is requested (new note).

For this: MOD_CCY=1 (non-cyclic) and MOD_DCY=0 (decremental progress of POS_X).

Memories M20 and M19 respectively contain values E_FIN and E_DEB. Comparator 182 compares E_DEB with the current value of POSX, logic block 186 commands initialization of POS_X and buffer 192 transmits the value E_DEB to the bus transmitting INIT_X to the calculator circuit 30.

Accordingly, when POS_X>E_FIN, POS_X is decremented progressively as a function of the frequency and no control is exercised by INIT_X or CD_INIT.

When POS_X<=E_FIN, POS_X will be set to the value E_DEB at the command of INIT_X and CD_INIT.

The output of logic block 186 must be at '0'. For this, the output of gate 181 is at '0' (SCLECH=0 or SC_ETR=0), the output of comparator 182 is at '1' (true comparison which is inverted at the input of logic block 186) and Not[MOD_

CCY and NOT(MOD_DCY]=0. Accordingly, buffer 192 is activated by the status of block 186 and transmits the value E_DEB on the INIT_X bus to calculation circuit 30. CD_INIT actuates initialization by the status of gate 208 whose output has the value '0' because of the logic state of block 186.

3) Cyclic series of samples, incrementing of POS_X

At the outset, memory M15 is addressed by the value of E_DEB which is incremented progressively, as in case 1, but this time, when the value POS_X reaches or exceeds the value E_B2 stored in memory M22, it will be set to the value E_B1, the value POS_X is incremented again up to the value E_B2, and so on.

In this mode of operation: MOD_CCY=0 (cyclic), MOD_DCH=1 (incrementing) and MOD_ALT=1 (not altemating, the loop being always traveled in the same direction).

Memories M19 through M22 respectively contain the values E_DEB, E_FIN, E_B1 and E_B2. Comparator 185 compares the value E_B2 to the current value of POS_X. The logic unit 191 and AND gate 201 command initialization of POS_X and buffer 194 transmits the value E_B1 on the bus which transmits INIT_X to the calculation circuit 30.

Accordingly, when POS_X<E_B2, POS_X is incremented as a function of the frequency values FRE and ENS_FRE by the calculation circuit 30, signals INIT_X and CD_INIT having no effect.

When POS_X>=E_B2, POS_X is set to the value E_B1 at the command of signals INIT_X and CD_INIT. For this, the output of the logic unit must be at '0', which means that the output of the OR gate must be at '0' (SC_ECH=0 or SC_ETR=0), the output of the comparator must be at '1' (true comparison inverted at the input of logic block 191) and [MOD_CCY or Not(MOD_DCY) or Not (MOD_ALT)]=0. The output of gate 201 is at '0' if the outputs of block 188 are or the output of block 191 is at '0'.

Buffer 194 is then activated by the status of AND gate 201 and transmits the value E_B1 on the bus carrying INIT_X. Initialization is activated by the state of gate 208 whose output will be at '0' because of the state of gate 201. POS_X is therefore initialized again to the value E_B1, which satisfies the condition POS_X<E_B2, and the cycle starts again.

4) Cyclic series of samples, decrementing of POS_X

During phase synchronization, the value E_FIN addresses memory M15 and this value is progressively decremented as a function of the frequency (signals FRE and ENS_FRE). When POS_X<=E_B1, its value is set to E_B2, after which POS_X continues to be decremented to the value E_B1, and so on.

Memories M19, M20, M21 and M22 respectively contain the values E_DEB, E_FIN, E_B1 and E_B2. Comparator 184 compares E_B1 to the current value of POS_X; logic block 189 and AND gate 202 command initialization of POS_X and buffer 195 transmits the value E_B2 on the bus carrying INIT_X to the calculation circuit 30.

When POS_X>E_B1, POS_X is decremented progressively as a function of the frequency and no command is exercised by signals INIT_X and CD_INIT.

When POS_X<=E B1, POS_X will be set to the value of E_B2 at the command of these two signals. For this, the output of logic block 189 must be at '0'. Consequently, the output of AND gate 181 must be at '0' (SC_ECH=0 or SC_ETR=0), the output of comparator 184 must be equal to '1' (true comparison, inverted at the input of logic block 189) and [MOD_CCY or MOD_DCY or not(MOD_ALT)]=0. The output of AND gate 202 will be equal to '0' if the outputs of block 189 or of block 190 are equal to '0'. Buffer 195 is then activated by the state of AND gate 202 and the value E_B2 is transmitted to calculation circuit 30 via the bus for transferring INIT_X. CD_INIT activates AND gate 208 whose output will be at '0' because of the output of AND gate 202. POS_X is initialized to E_B2, which re-establishes the condition POS_X>E_B1.

5) Cyclic and alternating series of samples, POS_X is incremented and then decremented Memory M15 is addressed at the outset by the value E_DEB which is progressively incremented as a function of signals FRE and ENS_FRE and then, when POS_X>=E_B2 (first limit time of the loop), its value will be set to E_B2 (second limit time of the loop) and the value will be decremented progressively until it again reaches the value E_B1. Thereafter, when it has reached E_B1, its value will be set to E_B1 and the value POS_X will be incremented until it reaches E_B2, and so on.

For this, MOD_CCY=0 (cyclic), MOD_DCY=1 (incremental progression at time of phase synchronization), MOD_ALT=0 (alternating direction of progression) and T_DIR=1 (set to MOD_DCY by means of multiplexer 198 and the selection effected by signal C_INIT).

Memories M19 through M22 respectively contain values E_DEB, E_FIN, E_B1 and E_B2. Comparators 184 and 185 respectively compare the values E_B1 and E_B2 with the current value of POS_X. Logic unit 190 and gate 202 command the initialization of POS_X with an increment direction determined by T_DIR. Logic unit 188 and AND gate 201 command initialization of POS_X with a decrement direction determined by T_DIR=1.

Logic unit 203 and multiplexer 198 command the increment/decrement direction by means of signal T_DIR.

Buffer 194 places the value E_B1 on the bus for transferring INIT_X by means of the initialization command (end of incrementing) and buffer 195 transmits the value E_B2 on the same bus for the initialization of the end of decrementation.

Under the above conditions, when T_DIR=1, the value POS_X is incremented because POS_X<E_B2. There is no initialization by INIT_X or CD_INIT.

When T_DIR=1, initialization requires POS X>=E_B2. POS_X will be set to the value E_B2 by command of INIT_X and CD_INIT. The output of logic block 190 is at '0' because the output of AND gate 181 is at '0' (SC_ECH=0 or SC_ETR-0), the output of comparator 185 is at '1' (true comparison inverted at input of logic block 190), [MOD_CCY or not(T_DIR) or MOD_ALT]=0. The output of AND gate 202 is at '0' if the output of logic block 189 or logic block 190 is at '0'. Buffer 195 is activated by the output at '0' of AND gate 202 and therefore transmits the value E_B2 on the bus for transferring INIT_X to the calculation circuit 30.

Signal C_INIT will activate initialization by the status of AND gate 208. Its output (CLINIT) is therefore at '0' because of the output of AND gate 202.

Logic unit 203 is activated by the output of logic unit 190 and the period P1 will force complementing of direction bit T_DIR at memory M23, which activates decrement mode (T_DIR=0: decrement).

Therefore, when T_DIR=0, the value POS_X is decremented, because POS_X>E_B1. There is no initialization by INIT_X or CD_INIT.

When T_DIR=0, initialization requires POS_X<=E_B1. POS_X will be set to the value E_B1 at the command of INIT_X and CD_INIT. The output of logic unit 188 is at '0' because the output of AND gate 181 is '0' (SC_ECH=0 or SC_ETR=0), the output of comparator 184 is at '1' (true comparison inverted at the input of logic block 188), [MOD_CCY or (T_DIR) or MOD_ALT]=0. The output of AND gate 201 is at '0' if the output of logic block 188 or logic block 191 is at '0'. Buffer 194 is activated by the output at '0' of AND gate 201 and therefore transmits the value E_B1 on the bus for transferring INIT_X to the calculation circuit 30.

Signal C_INIT will activate initialization by the status of AND gate 208. Its output (CD_INIT) is then at '0' because of the output of AND gate 201.

Logic unit 203 is activated by the output of logic unit 188 and period P1 will force complementing of direction bit T_DIR at memory M23, which activates increment mode (T_DIR=1: increment).

A first example of operation of the sound synthesizer system will now be described.

It is assumed that the synthesizer system must generate a sinusoidal waveform sound at a frequency of 440 Hz with an amplitude set arbitrarily at 100 (this value producing a given volume after the output S).

It is also assumed that the number n of cells is 192, the number m of sets is 16 (it was 64 in the example described above) and the number q of outputs is also 16. The sinusoidal curve in table 81 (FIG. 15) is defined by 1 024 samples. The base clock 2 from FIG. 2 is at 67.737 MHz and the sampling frequency is 44.1 kHz (signal ACT), i.e. 67 737/8 (counter 3, FIG. 2)/192.

The unit SYNT is initialized by the CPU via interface 1. To this end, the CPU writes data appropriate to the example under consideration into various memories.

First of all, the CPU sets up the structure of the unit SYNT needed to produce the intended sound. Accordingly:

Set 0; the contents of cells 0 through 191 are routed to set 0. For this, the value '0' is written by signal AC at addresses 0 through 191 of memory M9 (FIG. 8) at the command of write signal W_ENS_CEL. Note that cells 1 through 191 will be inactive but will continue to be associated with set 0.

For the circuit for routing cells to the set (FIG. 8) to complete the addition of the cells to set 0 (in the example, only cell 0 is active), for a system with 16 sets, the hexadecimal value '1' must be written at address '0' of memory M9 by signal W_ENS_CEL. This sets cell 0 as the last cell to be added in the set (bit C_ENS=1, i.e. the fifth bit of the corresponding value), and allocates the accumulation of the value to the adder U10 (bit C_SEL active=0), i.e. the fourth bit of the corresponding value).

Sets volume: all sets are set to amplitude value '0'. For this, the value '0' is written at addresses 0 through 16 of memory M8 (FIG. 8) by means of write signal W_ENS_AMP.

Output 0: the content of set 0 must be routed to output 0. For this, memory 11 (FIG. 11) receives a binary value '1' at address '0' at the command of write signal W_SORTIE, so that bistable 63-0 will be activated by the value '1' of bit 0 applied to gate 62-0 during the active pulse of subperiod P4.

Thereafter, the CPU will determine the parameters that will apply during sound production, in the following manner:

a) AMPLITUDE PARAMETER

The amplitude values are all fixed at zero. For this, the value '0' is written at addresses 0 through 191 of memory M1 of circuit 20A (FIGS. 5 and 6) by write signal W_AMP_BAS. The 'maximum' value is written in memory M2 of the same circuit 20A by write signal W_AMP_INC to eliminate the interpolation on the amplitude values (this approach is chosen here by way of example). The 'maximum' value is written in memory M4 by write signal W_AMP CTR because in this example there is no amplitude control from other sources. 'Maximum' is the maximum value that is possible, so that with 16 bits, for example, it is 65 535 (or øFFFF in hexadecimal notation).

b) FREQUENCY PARAMETER

The basic value of the frequency is fixed arbitrarily at '1000' (integers to base 10 for all cells; this value '1000' is therefore written at all locations of memory M1 of block 20B (FIG. 6) by write signal W_FRE_BAS.

The value 'maximum' is written in all 192 locations of memory M2 of block 20B to deactivate interpolation by write signal W_INC_FRE.

The value 'maximum' is written by signal W_FRE_CTR into all locations of memory M4, there being no additional frequency control in this example.

Here the value 'maximum' is the maximum value that is possible, so that with 24 bits it is 16 777 215, for example (or hexadecimal øFFFFFF).

c) PHASE PARAMETER

The basic value of the phase is fixed at '0'; '0' is therefore written at all locations 0 through 191 of memory M1 of block 20C (FIG. 6) by write signal W_PHA_BAS.

The value 'maximum' is written at all locations of memory M2 of the same block 20C to deactivate interpolation on the phase values by write signal W_PHA_INC.

The value 'maximum' is written at all locations of memory M4 of the same block 20C using write signal V_PHA_CTR to deactivate any additional control over the PHASE parameter.

Here the value 'maximum' is the maximum value that is possible, so that with 9 bits it is 511, for example (or hexadecimal 1FF).

d) FILTER PARAMETER

All the filters are rendered inactive. The value 'maximum' is therefore wrtten at all locations of memory M1 of block 20D (FIG. 6) by write signal W_FLT_BAS.

The same value is written at all locations of memory M2 of block 20D, by write signal W FLT_INC to deactivate all interpolations of the FLT parameter.

The value 'maximum' is also written in all locations of memory M4 by write signal W_FLT_CTR to deactivate any additional control over the FILTER parameter. Here 'maximum' is the maximum value that is possible, so that with 8 bits it is 255, for example (or hexadecimal 0FF).

The sinusoidal oscillation needed to generate the required sound must then be programmed.

To generate this sinusoidal sound, the unit SYNT must be programmed so that sine table 81 (FIG. 14) is activated. Remember that the table contains 1 024 zero level samples with the values of the successive points together reproducing the sinusoidal waveform.

Activation is programmed by the CPU which, for cell '0', and using write signal W_MOD, writes at location '0' of memory M12 (FIG. 13) a value whose three least significant bits have the value '000'. As a result decoder 71 activates signal SC_SIN which frees access to table 81 of first level sample generator circuit 72 (FIG. 14). This places cell 0 in the appropriate mode.

Table 81 must be read at a clock rate that corresponds to a sound at a frequency of 440 Hz at the output of the unit SYNT. As already indicated, under these conditions it is necessary to use a multiplication factor of 10.21678 in arithmetic unit U4 of calculation circuit 30 (FIG. 7). This value is written at address '0'of memory M10 (FIG. 8) by write signal W_ENS_FRE. The value '1' is then written at address '0' of memory M1 of block 20B as the relative basic frequency value FRE. The actual frequency will be calculated by multiplier unit U4 (FIG. 7).

The phase of the cells of set 0 must be synchronized, which is necessary only for cell '0' in this example. The value '0' corresponding to set 0 is written into bistable 44 of first level allocator circuit 40 (FIG. 8) at the command of signal W_DEC.

In this example, it has been assumed arbitrarily that the amplitude is fixed at the value '100'. The value of set 0 that will comprise cell 0 has the maximum value on writing "maximum" at address 0 of memory M8 at the command of write signal W_ENS_AMP, for example the value 1 023 on 10 bits. The value '100' is then written in memory M1 of block 20A at the address 0 corresponding to cell 0 as the basic value of the AMPLITUDE parameter, at the command of write signal W_AMP_BAS.

The unit SYNT is then initialized to produce the required sound.

During this process, the signals corresponding to sub-periods P2_AMP, P2_FRE, P2_PHA and P2_FLT are not used, because there is no provision for modification of parameters in this example. During this initialization (up to phase synchronization), the sound synthesizer system performs the first passes on the cells, starting with cell 0.

FIRST PASS

During the active pulse of sub-period P1, a positive sign is assigned to the direction of the time axis; this means that the value of POS_X is increasing. For this, the corresponding sign bit has been stored beforehand in memory M23 and signals MOD_DCY and MOD_ALT have been set to the appropriate binary value by means of memory M12 (FIG. 13). The sign bit is fed to circuit 34 of calculator circuit 30.

During the active pulses of sub-period P3, the amplitude, frequency, phase and filtering parameters of cell 0 previously programmed by the CPU are confirmed by bistables 26 of blocks 20A through 20D. Set 0 receives the allocation of cell '0'(FIG. 8) via memory M7. During this operation, the preceding value of cell 0 is placed in set 0. Of course, in the example described, this preceding value is equal to zero.

Then, during the active pulse of sub-period P4, the parameters of cell 0 are fixed at their previously stored value, the designation value POS_X is accumulated in accumulator memory M5 (indeterminate value), the amplitude of cell 0 is calculated (zero value), cell '0' is allocated to set 0 with the zero amplitude value for that set as second level value (memory M7-FIG. 8) and the value zero is also put in bistable 63-0 (FIG. 11) as third level value. The active pulse of sub-period PCPU terminates period P1 to enable the CPU to write other values in the unit SYNT if required.

Periods P1 then follow successively for all the cells, although no actual operation is effected in this example.

This completes a first cycle P.

SECOND PASS

This occurs during the next cycle P of signal ACT (FIG. 4). Phase synchronization is effected during the active pulse of the first period P1, in blocks 44 through 50 of first level allocation circuit 40. Because the phase value is equal to zero, the value POS_X is initialized during the active pulse of the following sub period P3, using the value in calculation circuit 30.

During the active pulse of subperiod P3, the four parameter values of cell 0 are initialized in accordance with the data written by the CPU. Calculation circuit 30 takes the phase value and calculates the value POS_X=0 which is confirmed in bistable 36 and cell 0 is again allocated to set 0 by means of memory M9 of allocator circuit 40. The current first level sample value is added to that of the preceding period P1 (it is still equal to zero).

During the active pulse of sub-period P4, the four parameters of cell 0 are conformed to their current value. The "accumulated" value (still zero) of POS_X is stored in memory M5. The value of the amplitude of the cell is established, on the one hand, by looking up the sine value at address 0 of table 81, this address being formed by the least significant bits of signal POS_X, and on the other hand by multiplying this sine value by the amplitude value (100) previously written in arithmetic unit U12 (FIG. 13).

Of course, the point value from table 81 (zero level sample value) was signal CCYC and has passed through filter circuit 160 (FIG. 19), which is inactive in the example considered here Signal ACC_CEL which is the first level sample formed in this way for cell 0 is allocated to set 0 by storage in memory M7 of first level allocation circuit 40. As the value 100 was previously written, the amplitude value of the first level sample will therefore also be equal to 100.

Arithmetic unit U10 (FIG. 8) adds the values of the cells of the same set and is reset to zero at the start of each pass (after processing for the last cell of a given set). As only one cell is used in this example, the corresponding first level sample value is equal to the second level sample value (output from bistable 42 to unit U9), i.e. to the amplitude of the set fixed previously at the maximum and calculated in unit U9.

Likewise, the value of the set itself is constituted (there is only one cell to consider) to form the second level sample which is thereafter allocated as third level sample to the required output (FIG. 11). The period P1 concerned then ends with writing of data by the CPU during the active pulse of sub-period PCPU.

All cells 1 through 191 are then treated in the same fashion, but of course without practical effect because in this example only cell '0' is active.

THIRD PASS

At the start of period P1 the sign of progress of the value POS_X is again set as positive by circuit 34 of calculation circuit 30.

The following operations are then performed during the active pulse of sub-period P3.

The four parameters of cell 0 now have values according to the data written previously by the CPU. Calculation circuit 30 again recognizes the ordered phase during period P1. The value POS_X is set to zero at location '0' of memory M5.

Cell 0 is allocated to set 0 as in the first pass and the sum of the cell values for set 0 (cell 0 only) is calculated in arithmetic unit U10 and placed in bistable 42.

At the command of the active pulse of sub-period P4, the four parameters are confirmed in the accumulator memory M3 of each block 20A through 20D. The new value of POS_X is placed in accumulator memory M5 after it has been calculated in arithmetic unit U6 (FIG. 7), this value being equal to 10 or to 11 depending on the division effected in divider 31 of calculation circuit 30. The same value (PHA being equal to zero) appears at the output of arithmetic unit U7 and is used as an address for sine table 81. The value (or sample point) extracted from that table is stored at location '0' of accumulator memory M13 (FIG. 13) after it has been multiplied by the value AMP in arithmetic unit U12 (here this value is '100').

The multiplied value (signal ACC_CEL) is also stored at location '0' of accumulator memory M7 as the current second level sample value after addition to the value B (here zero) in arithmetic unit U10. The amplitude value of set 0 is then established in arithmetic unit U9 by multiplying the fixed amplitude value stored in memory M8, the multiplied value being loaded into memory M6.

The value that was stored in that memory is then passed to output 0 (FIG. 11) to be made audible.

The current period P1 again ends as required by writing of data by the CPU during the active pulse of sub-period PCPU.

The process continues during cycle P of signal ACT for all cells, again with no practical effect in the example under consideration.

FOURTH PASS

The only difference compared to the previous pass lies in the change in the value of POS_X, which is again incremented by 10 or 11 leading to the designation in the sine table of the new point value required to form the sound to be obtained.

Immediately the value of set 0 is extracted from memory M1 (FIG. 11) and routed to output 0, a sound will be audible, the external sound reproduction system being synchronized by means of signal EXT_SYNC.

Then, during subsequent passes, the value POS_X continues to be incremented by 10 or 11 in the case of cell '0' and the other cells will remain inactive if the CPU does not instruct a change of operation of the unit SYNT.

In the final analysis, the latter unit will therefore produce a sinusoidal single harmonic sound at a frequency of 440 Hz.

To produce sounds having a more complex sound spectrum, the process can involve a plurality of cells distributed between one or more sets in accordance with a configuration dictated by the spectrum. The zero level samples can then come from three different sources, namely the waveform generators shown in FIG. 14 or FIG. 15, the input circuits shown in FIG. 16 and FIG. 18 via memory M15 and the cells themselves using first level samples in accumulator memory M13.

Figure 22:
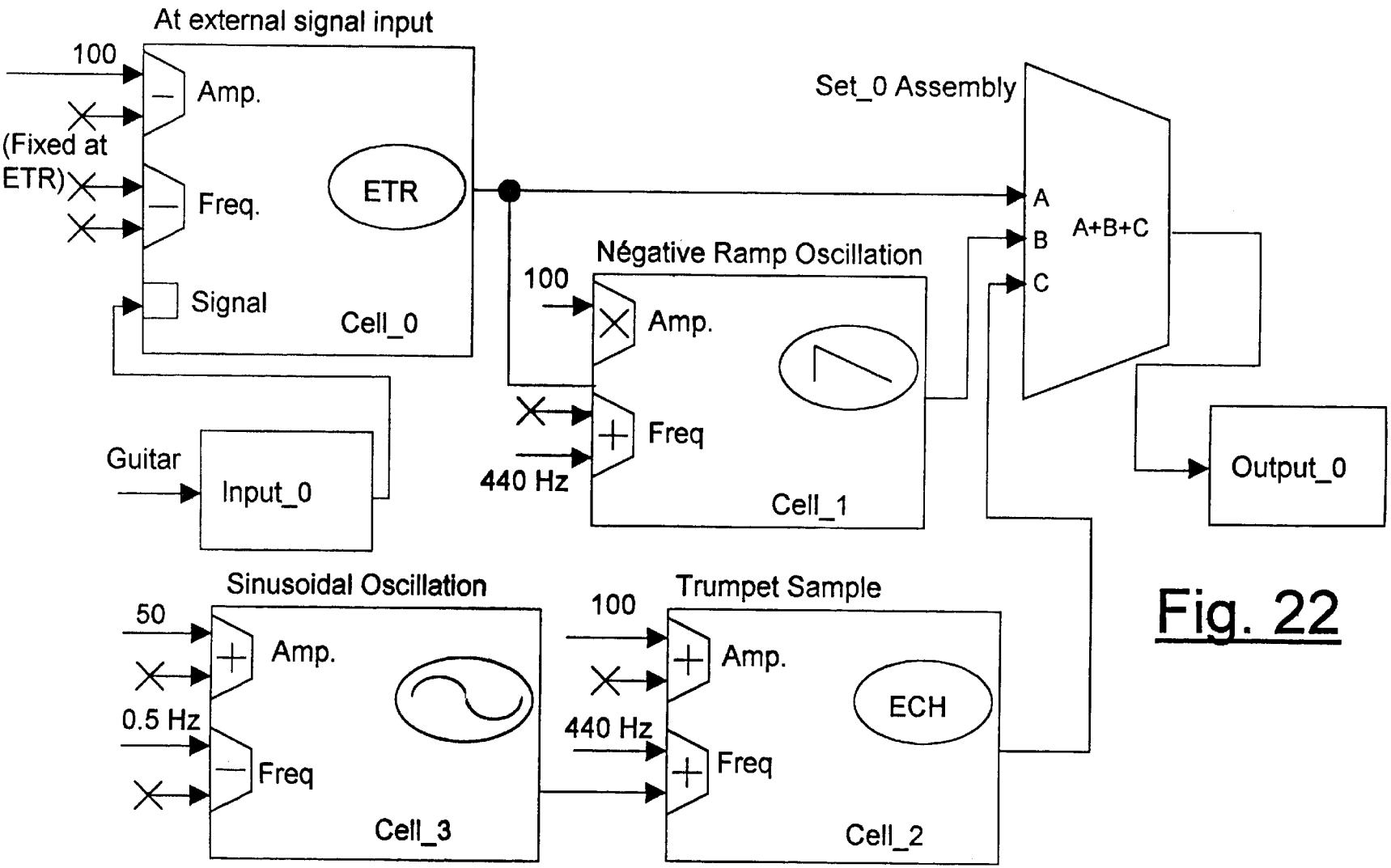
FIG. 22 shows one detailed example of the use of the synthesizer unit of the invention.

A second example described below explains the formation of a sound of this kind with a more complex spectrum (see FIG. 22).

Note that to facilitate understanding of the following explanation, the components involved in the process described will be indicated by their reference and another number indicating the figure in which the block concerned is shown (for example, block 3 from FIG. 2 will be denoted 2.3).

The configuration of the unit SYNT is then as follows:

A—Basic data:

number of cells used: 4 from 192,
number of cell signals added at output: 3 from 4,
number of sets used: 1 from 16,
number of outputs used: 1 from 16,
number of inputs used: 1 from 16,
sampling: as in first example.

B—Configuration of cells, set and output

Cell 0 uses an external signal (example: guitar) applied to input 0 (mode SC_ETR); its amplitude is fixed at '100'.

Cell 1 is used for a RAMP oscillation (mode SC_RMN) added to the signal. Its amplitude is fixed at '100' and amplitude modulated by cell 0 in a multiplicative manner. Its frequency is fixed at 440 Hz (base =440 Hz, frequency ratio =1; 5.U4).

Cell 2 contains a trumpet sample stored in memory (mode SC_ECH). This cell includes a vibrato and its frequency is modulated additively by cell 3. Its amplitude is fixed at '100'. Its frequency is 440 Hz (base =440 Hz, frequency ratio ='1').

Cell 3 is used for sine oscillation (mode SC_SIN) of amplitude '250', frequency 0.5 Hz (base =440 Hz, frequency ratio '0.001136'). This latter cell is not added to the output signal but serves only to modulate the frequency from cell 2.

The four cells are incorporated in the same set i.e. set 0. Only the content of cells 0 through 2 is routed to output 0. The phase and filter parameters of all the cells are at'0'.

1.1. Initialization:

The CPU initializes the system. The data is written in the corresponding memory.

1.1.1. Structure: the CPU establishes the structure of the system:

Set 0: cells 0 through 191 are routed to set 0. The value '0' is written at addresses W_ENS_CEL+0 through W_ENS_CEL+191 (8.M9). Cells 4 through 191 are inactive but are left in set 0. For allocation circuit 40 to complete the addition of cells to set 0 (cells 0 through 3 which are active, and the added cells 0 through 2), the following values must be written:

cell 0: hexadecimal value '30' at W_ENS_CEL+0 (8.M9), allocates the accumulation of cell 0 to adder U10 (bit 4 C_SCEL active='1', bit 5 C_ENS inactive='1');

cell 1: hexadecimal value '30' at W_ENS_CEL+1 (8.M9), allocates the accumulation of cell 1 to adder U10 (bit 4 C_SCEL active='1', bit 5 C_ENS inactive='1');

cell 2: hexadecimal value '30' at W_ENS_CEL+2 (8.M9), allocates the accumulation of cell 2 to adder U10 (bit 4 C_SCEL active='1', bit 5 C_ENS inactive='1');

cell 3: hexadecimal value '00' at W_ENS_CEL+3 (8.M9), cell 3 is not added (bit 4 C-SCEL inactive='0'). It is the last cell in the set (bit 5 C_ENS active='0'). This fixes the content of cell 3 as the last value to add in the set (bit C_ENS, i.e. bit 5 of the value);

Sets amplitude: the sets are first set to zero amplitude. The value '0' is written at addresses W_ENS_AMP+0 through W_ENS_AMP+15 (8.M8) corresponding to sets 0 through 15;

Sets frequency: the CPU programs the SYNT to a base frequency of 440 Hz. The program must take account of the sampling frequency (44.1 kHz) and the number of points per cycle of the generators (1 024 points) in calculating the frequency code. In this example, a frequency value is therefore used for set 0 identical to that previously discussed with reference to FIG. 6. This frequency value of set 0 is written at address W_ENS_FRE+0 (8.M10) corresponding to the address of the frequency of set 0;

Output 0: set 0 is routed to output 0. The value '1' (bit 0 to 1) is written to W_SORTIE (11 .M11) corresponding to the output destinations of set 0.

1.1.2. Cell initialization parameters: the CPU writes the value 0 for the amplitudes of all the cells.

Amplitude values: all the amplitudes are at '0' which is written at addresses W_AMP_BAS+0 to W_AMP_BAS+191 (6.20A[5.M2]).

Amplitude increment values: the value "maximum" is written at addresses W_AMP_INC+0 to W AMP_INC+191 (6.20A[5.M1]). This confers a value without interpolation on the amplitudes.

Amplitude modification values: the value "maximum" (hex_200) is written at addresses W_AMP_CTR+0 to W_AMP_CTR+191 (6.20.A[5.M4]). This deactivates modification of the amplitude.

Frequency values: all the frequencies are at the arbitrary value '1000' which is written at addresses W_FRE_BAS+0 to W_FRE_BAS+191 (6.20B[5.M2]).

Frequency increment values: the value "maximum" is written at addresses W_FRE_INC+0 to W_FRE_INC+

191 (6.20B[5.M1]). This confers a value without interpolation on the frequencies.

Frequency modification values: the value "maximum" is written at addresses W_FRE_CTR+0 to W_FRE_CTR+191 (6.20B[5.M4]). This deactivates modification of the frequencies.

Phase values: all the phases are at '0' which is written at addresses W_PHA_BAS+0 to W_PHA_BAS+191 (6.20C[5.M2]).

Phase increment values: the value 'maximum' is written at addresses W_PHA_INC+0 to W_PHA_INC+191 (6.20C[5.M1]). This confers a value without interpolation on the phases.

Phase modification values: the value 'maximum' is written at addresses W_PHA_CTR+0 to W_PHA_CTR+191 (6.20C[5.M4]). This deactivates modification of the phases.

Filter values: all the filters are rendered inactive: the value 'maximum' is written at addresses W_FLT_BAS+0 to W_FLT_BAS+191 (6.20D[5.M2]).

Filter increment values: the value 'maximum' is written at addresses W_FLT_INC+0 to W_FLT_INC+191 (6.20D [5.M1]). This confers a value without interpolation on the filters.

Filter modification values: the value 'maximum' is written at addresses W_FLT_CTR+0 to W_FLT_CTR+191 (6.20D[5.M4]). This deactivates modification of the filters.

1.2. Programming of modes and parameters of cells:

1.2.1. Cell 0: SC_ETR.

The CPU programs the SYNT to activate the input in real time 0 at cell 0. The real time input is written in the sampling memory (17.M15). In this example, the reserved addresses are delimited in a memory area between addresses 0 and 1023 used for continuous (cyclic) storage.

Cell 0 mode: cell 0 will be connected to real time input 0. The value '0' is written at the address W_ETR_N+0 (16.M14). The mode SC_ETR corresponds to the code '007' at W_MOD (13.M12). The access mode to memory M15 ( 1 024 addresses) is cyclic (MOD_CCY=0), increasing (MOD_DCY=1), non-alternating (MOD_ALT=1), the hexadecimal code '300' is added to W_MOD. The hexadecimal code '307' ('007'+'000'+'300') is written at the address W_MOD+0 (13.M12) corresponding to the address of the mode of cell 0. This activates command bit SC_ETR which starts the cell sampling mode.

Cell 0 sampling addresses: the start of sample and start of loop addresses have the value '0' which is written at addresses W_ECH_DEB+0 (20.M19) and W_ECH_B1+0 (20.M21). The end of sample and end of loop addresses have the value '1023' which is written at address W_ECH_FIN+0 (20.M20) and W_ECH_B2+0 (20.M22). As access is cyclic, memory M15 will be used as a circulating buffer in the area assigned to cell 0.

Cell 0 frequency: this does not have to be fixed, because sampling is based on the clock (2.2), which, when divided down, gives the sampling frequency of 44.1 kHz. In this mode (SC_ETR), the increment step is fixed and is equal to '1'.

Cell 0 amplitude: in this example, the amplitude is arbitrarily fixed at '100', which value is therefore written at address W_AMP_BAS+0 (6.20A[5.M2]).

1.2.2. Cell 1: SC_RMN.

Cell 1 will be programmed to be a negative ramp oscillation whose amplitude will be modulated by the output of cell 0.

Cell 1 mode: a negative ramp corresponds to code '4' at W_MOD (13.M12). Amplitude modulation is additive (MOD_FCT_AMP=0), code '0' is added to W_MOD. The value '4' is therefore written at the address W_MOD+1 (13.M12) corresponding to the address of the mode of cell 1. This activates command bit SC_RMN which activates the negative ramp oscillation mode (14.88,84).

Cell 1 frequency: the frequency factor written to set 0 corresponds to the 440 Hz base. The value '1' (frequency of set multiplied by 1) is therefore written at address W FRE BAS+1 (6.20B[5.M2]).

Cell 1 amplitude: '100' is written at address W AMP_BAS+1 (6.20A[5.M2]).

Cell 1 amplitude command: in this example, cell 1 uses the output of cell 0 for modulating its amplitude. The value '0' is written at W AMP_CTR+1 (6.20A[5.M4]). This value makes cell 0 the modulation source.

Note in passing that the code on nine bits formed by the most significant bits of signal ADR_CTR defines, as shown in FIG. 12 for 192 cells, the following selection: ACC CEL=hex_000 to hex_OBF, ACC_ENS=hex_OCO to hex_OCF, ACC_ETR=hex_ODO to hex ODF, ACC_DET amplitudes =hex_OEO to hex_OEF, ACC_DET frequencies =hex OFO to hex_OFF and ACC_DET bands =hex_100 to hex_IFF). The (maximum) value hex_200 is reserved for indicating that the command is inactive on the corresponding parameter of a cell.

1.2.3. Cell 2: SC_ECH.

Cell 2 is programmed to contain a sample of the recorded sound of a trumpet. In this example, it is assumed that this sound is a file contained in the CPU. Vibrato is applied to it by modulating its frequency, the modulating oscillation being that from the output of cell 3. Note that the 440 Hz frequency of that cell is no more than a reference value for sampling. The audible frequency will depend on the oscillation frequency recorded by the CPU. It is assumed that it has been recorded at a sampling frequency equivalent to that at which it will be regenerated and that the note played on the recording corresponds to 440 Hz. In other cases, the regenerated trumpet frequency can be transposed proportionally. The sample lasts two seconds, for example, that is 88 200 sampling points (440 Hz at 100 points per cycle). It is written in memory M15 at sampling addresses 1024 to 89224.

Cell 2 mode: cell 2 is programmed to generate the trumpet sampling signal. That corresponds to code '006' at W_MOD. The modulation of the frequency is additive and so code '000' is added to W_MOD. The sample mode is non-cyclic (MOD_CCY=1), increasing (MOD_DCY=1), non-alternating (MOD_ALT=1), and the hexadecimal code '380' is therefore added to W_MOD. The hexadecimal code '386' (006+000+380) is written at address W_MOD+2 (13.M12). This activates the command bit SC_ECH which activates the cell sampling mode.

Cell 2 sample addresses: the start of sample address has the value '1024' which is written at address W_ECH_DEB+2 (20.M19). The end of sample address is fixed at 89224 which is written at address W ECH FIN+2 (20.M20).

Cell 2 sample writing: the sample on 88 200 points is transferred from the CPU to sampling memory M15 at addresses W_ECH_CYC+'1024' to W_ECH_CYC+'89224' (17.121 and M15).

Cell 2 frequency: the frequency factor written to set 0 corresponds to the 440 Hz base. The value '1' (set frequency multiplied by 1) is therefore written at address W_FRE_BAS+2 (6.20B[5.M2]).

Cell 2 amplitude: the amplitude is arbitrarily fixed at the value '100' which is therefore written at address W_AMP_BAS+2 (6.20A[5.M2]).

Cell 2 frequency command: in the example, cell 2 uses the output of cell 3 to modulate its frequency. The value '3' is written at W_FRE_CTR+2 (6.20B[5.M4]) so that cell 3 is used as the modulation source.

1.2.4. Cell 3: SC_SIN.

Cell 3 is programmed to impose a sinusoidal oscillation at a low frequency of 0.5 Hz. This cell modulates the frequency of cell 2.

Cell 3 mode: it must be set to the sinusoidal oscillation mode beforehand. The value '0' is therefore written at address W_MOD+3 (13.M12). This activates command bit SC_SIN which activates function generator 81 containing the sine table.

Cell 3 frequency: the oscillation frequency being 0.5 Hz, the factor applied to the base frequency must be '0.00136' (0.5 Hz='440'*'0.00136'). The value '0.00136' (set frequency multiplied by 1) is therefore written at address W_FRE_BAS+3 (6.20B[5.M2]).

Cell 3 amplitude: in this example the amplitude is arbitrarily fixed at the value '250' which is written at the address W_AMP_BAS+3 (6.20A[5.M2]).

1.2.5. Starting:

Phase synchronization of cells 0 to 3: the cells programmed for set 0 are phase synchronized. The number '0' corresponding to set 0 is written at address W_DEC (8.44).

Set amplitude: the volume of set 0 is set to the maximum, by writing the value 'maximum' at address W_ENS_AMP+0 (8.M8).

An instrument such as a guitar is connected to real time input 0.

1.3. Generation of the sample:

Note that, as already described with reference to FIGS. 3 and 4, each sub period P includes a sub-period PCPU at the end of the calculation relating to each cell. This will not be expressly pointed out in what follows.

When the system has been initialized, it generates the sinusoidal signal at a cell.

First pass (during execution of the initialization operations described in sections 1.1.1 to 1.2.4):

Cell 0

P1: time axis x direction: positive.

read input IN_0 (example: value '0.28'). This value is routed to IN_CEL (16.103) and written in memory (17.M15) at an undefined address (POS_X) within the addressing limits established on initializing the cell, i.e. between E_DEB(0) and E FIN(1023).

signals P2_AMP, P2_FRE, P2_PHA and P2_FLT are inoperative because cell 0 is not subject to external control of amplitude, frequency, phase or filtering.

P3: the parameters of cell 0 are initialized according to the data written by the CPU to the values resulting from the initialization.

selection of set 0 on cell 0.

writing of the value of cell 0 by the active bit C_SCEL at (8.M9) on set (8.U10,42). This value is a null value like the previous value. The cell is initialized to the zero amplitude during previous passes.

P4: the parameters of cell 0 are fixed at their value.

accumulation of POS_X on the x-axis of cell 0 (5.M3; 6.20B).

zero value accumulated during subcycle P3 (8.42) written to set accumulator (8.M7).

calculation of amplitude (13.U12) of cell 0='100'. Value of the sample of cell 0 ='28' (amplitude '100'* Value IN_0 ='0.28'). Storage of this value in memory (13.M13).

calculation of amplitude of set 0 ='0', value routed to memory M6 (not stored).

set accumulator no value is written in memory M6 (bit C_ENS inactive at 8.M9). The preceding value is a null value. The set initialized to amplitude '0' during previous passes.

output accumulator: the value of set 0 is 0.

Cell 1

P1: x-axis direction: positive.

P2_AMP Cell 1 is subject to extemal control of its amplitude by cell 0. The value calculated in the preceding oscillation cycle of cell 0 (13.M13) is acquired at bistable 24 (FIG. 5). The modulation is active at value '28'.

The signals P2_FRE, P2_PHA and P2_FLT are inoperative because cell 1 is not subject to external control of frequency, phase and filtering.

P3: the parameters of cell 1 are initialized in accordance with the data written by the CPU to values acquired during initialization.

assignment of cell 0 to set 0.

addition of the value of cell 1 by the active bit C_SCEL (8.M9) to set 0 (8.U10,42). This value is a null value like the preceding one. The cell has been initialized to the amplitude '0' during previous passes.

P4: the parameters of cell 1 are fixed (amplitude +modulation) at the value '28'.

POS_X is accumulated on the x-axis of cell 1. The value is indeterminate.

the null value accumulated in sub-cycle P3 at bistable 42 is written into the accumulator of set M7 (FIG. 8).

the amplitude (13.U12) of cell 1 is calculated as '128' ('100'AMP+'28' (Val.cell 0)). The value of the sample is indeterminate ('128'* the ramp at an indeterminate address). Stored in memory M13.

the amplitude of the set at the value '0' is routed to memory M6 (not stored).

set accumulator the value is not written in memory M6, bit C_ENS being inactive (8.M9). The preceding value is a null value, the set having been initialized to the amplitude '0' during previous passes.

output accumulator: the value of set 0 is 0.

Cell 2

P1: x-axis direction: positive.

P2_FRE cell 2 is subject only to external control of frequency by cell 3.

The value of the oscillation of cell 3 on the preceding pass is a null value and acquired at bistable 24. There is no modulation.

P3: the parameters of cell 2 are initialized according to data written by the CPU to values acquired during initialization.

assignment of cell 2 to set 0.

addition of the value of cell 2, bit C_SCEL being active (8.M9) to the set (8.U10, 42). The value is a null value because the preceding value is a null value and the cell has been initialized to the amplitude '0' during preceding passes.

P4: the parameters of cell 2 are fixed at their value.

POS X is accumulated on the x-axis. The value is indeterminate and between E_DEB (1024) and E FIN (89224).

the null value accumulated in sub-cycle P3 at bistable 42 is written to the accumulator of the set (8.M7).

calculation of the amplitude (13.U12; value '100'). The value of the sample is indeterminate ('100'*sample at indeterminate address). The value is stored in memory M13.

the amplitude calculated for set 0 is routed to memory M6, but not stored.

set accumulator: no value is written in memory M6 because bit C_ENS is inactive (8.M9). The preceding value is a null value and the set is initialized to the amplitude '0' during preceding passes.

output accumulator: the value of set 0 is a null value.

Cell 3

P1: x-axis direction: positive.

cell 3 is not subject to any external control of amplitude, frequency, phase or filtering.

P3: the parameters are initialized in accordance with the data initialized by the CPU;

assign cell 3 to set 0;

the value of cell 3 is not added to set 0 (8.U10,42) because bit C_SCEL is inactive (8.M9).

P4: the parameters are fixed at their value.

POS_X is accumulated on the x-axis to an indeterminate value.

the null value accumulated during subcycle P3 at bistable 42 is written to the set accumulator (8.M7).

the amplitude (13.U12) is calculated (value '250'). The sample value of cell 3 is indeterminate ('250'*sine with indeterminate address). Stored in memory M13.

the amplitude of the set is calculated (value '0') and routed to memory M6.

set accumulator the value is written in memory M6 because bit C_ENS is active (8.M9). The preceding value is a null value. The set has been initialized to amplitude '0' during preceding passages. Bistable 42 is set to zero to initialize the set for the next pass.

output accumulator: the value of set 0 is a null value.

Pass 0 then implies processing of cells 4 to 191 during cycles P1 to PCPU.

There is no signal.

Second pass

This proceeds during phase synchronization and writing of the set parameters (section 1.2.5., first sample):

Cell 0

P1: phase synchronization is effected by writing the value '0' (number of set 0 to be phase synchronized, all the cells forming part of it) at bistable 44 (FIG. 8). As the phase values are '0', the term POS_X of the x-axis is initialized in the FIG. 7 circuit during the next sub-cycle P3. Initializabon signal C_INIT is generated by block 50 and routed to gate 208 which produces signal CD_INIT.

POS_X of cell 0 is initialized to E_DEB(cell 0)='0'.

reading of input IN_0 (e.g. '0.35') and transmission to IN_CEL.

The value is written in memory M15 (POS_X=?).

Cell 0 is not subject to any external control.

P3: the parameters of cell 0 have not changed since the preceding pass.

the circuit from FIG. 7 (block 35 signal CD_INIT) recognizes the phase synchronization ordered during cycle P1. POS_X is set to '0' at cell 0.

allocation of cell 0 to set 0.

writing of the value of cell 0 by active bit C_SCEL (8.M9) on set (8.U10,42); the amplitude value was '100'.

P4: the values of cell 0 are fixed at their value.

accumulation of POS_X on the x-axis of cell 0 ='0' (phase '0').

value accumulated during sub-cycle P3 at bistable 42 is written into set accumulator M7.

calculation of amplitude (13.U12) of cell 0 at value '100'. The sample value of cell 0='35' ('100'* IN_0='0.35'). Stored in memory M13.

calculation of amplitude of set at value '0'. It is routed to memory M6 but is not stored.

set accumulator the value is not written to memory M6 because bit C_ENS is inactive (8.M9). The preceding value is a null value, the set has been initialized to amplitude '0' during preceding passes.

output accumulator: the value of set 0 is a null value.

Cell 1

P1: phase synchronization at set 0 of the cell, executed during sub-cycle P3; E_DEB ='0'.

P2_AMP cell 1 is subject only to external control of amplitude by cell 0.

The value calculated during the preceding cycle of the oscillation of cell 0 and stored in memory M13 is acquired at bistable 24. The modulation is active at value '35'.

P3: the parameters of cell 1 have not changed since the preceding pass.

the circuit from FIG. 7 (block 35 signal CD_INIT) recognizes the phase synchronization ordered during cycle P1. POS_X is set to '0' at cell 1 (E_DEB).

allocation of cell 1 to set 0.

addition of the value of cell 1, bit C_SCEL being active (8.M9), to the set (8.U10, 42). The preceding values are cell 0 ('28)+cell 1 (?). The value is therefore indeterminate.

P4: the parameters of cell 1 are fixed at their value and the value of cell 0 (5.U4, M3; 6.20A) is added to the amplitude and modulates it. The total amplitude of the cell ='135'.

accumulation of POS_X on the x-axis of cell 1 ='0' (phase '0').

value accumulated during sub-cycle P3 at bistable 42 is written to set accumulator M7.

calculation of the amplitude (13.U12) of the cell 1='135', i.e. '100' Ampl+'35' (cell 0 value). The value of the sample of cell 1='134' ('135'*start ramp '0.99'). The value is stored in memory M13.

calculation of the amplitude of the set at the value '0' which is routed to memory M6 but not stored.

set accumulator. The value is not written in memory M6, because bit C_ENS is inactive (8.M9). The preceding value is a null value. The set initialized to amplitude '0' during the preceding passes.

output accumulator the value of set 0 is a null value.

Cell 2

P1: phase synchronization on set 0 of the cell, executed during sub-cycle P3. POS_X at cell 2 is initialized E_DEB='1024'.

P2_FRE: cell 2 is subject only to external control of frequency by cell 3. The value calculated during the preceding pass of the oscillation of cell 3 (13.M13) is acquired by bistable 24. The modulation is active at an indeterminate value.

P3: the parameters have not changed since the preceding pass.

the circuit from FIG. 7 (block 35 signal CD_INIT) recognizes the phase synchronization ordered during cycle P1. POS_X is set to '1024'(E_DEB).

allocation of cell 2 to set 0.

addition of the value of cell 2 by active bit C_SCEL (8.M9) to set 0 (8.U10,42) to preceding values: cell 0('28)+ cell 1 (?)+cell 2 (?). The value is therefore indeterminate.

P4: the parameters are fixed at their value. The frequency is added to the value of cell 1 (5.U4, M3; 6.20B) which modulates it as a function of the accumulated value of the first pass (e.g. accumulated value=indeterminate). Because phase synchronization is in process, the frequency value has no part to play.

accumulation of POS_X on the x-axis of cell 2='1024' (phase '0').

value accumulated during sub-cycle P3 at bistable 42 is written to set accumulator M7.

calculation of the amplitude (13.U12) at value '100'. The value of the sample of cell 2='11' ('100'*first trumpet point, for example '0.11' at address 1024). The value is stored in memory M13.

calculation of the amplitude of the set at value '0' which is routed to memory M6 but not stored.

set accumulator the value is not written in memory M6 because bit C_ENS is inactive (8.M9). The preceding value is a null value. The set was initialized to amplitude '0' during preceding passes.

output accumulator: the value of set 0 is a null value.

Cell 3

P1: phase synchronization on set 0 of the cell, executed in sub-cycle P3.

no external control during sub-cycles P2_AMP, P2_FRE, P2_PHA and P2_FLT.

P3: the parameters have not changed since the preceding pass.

the circuit from FIG. 7 (block 35 signal CD INIT) recognizes the phase synchronization ordered during cycle P1. POS_X is set to 0.

allocation of cell 3 to set 0.

the value of cell 3 is not added to the set (8.U10 ,42), bit C_SCEL being inactive (8.M9).

P4: the parameters are fixed at their value.

accumulation of POS_X on the x-axis='0' (phase '0').

value accumulated during the sub-cycle at bistable 42 is written to set accumulator M7.

calculation of the amplitude (13.U12) at the value '250'. The value of the sample='0' ('1250'* the first point of the sine table='0'). The value is stored in memory M13.

calculation of the amplitude of set 0 at the value '0' which is stored in memory and routed to memory M6.

set accumulator: the value written to M6 (bit C_ENS active at 8.M9) cell addition value, set initialized to amplitude='0' (set to maximum on next pass only). Setting to 0 of bistable 8.42, initializing the set for the next pass.

output accumulator: the value of set 0='0' (amplitude= '0'* the sum of the samples of cells 0 to 2), cell 3 not being added intentionally. Bit C_CEL is inactivated by the CPU.

Second pass of cells 4 to 191 on cycles P1 to PCPU (no signal).

Third pass (after phase synchronization, generation of the second sample):

Cell 0

P1: x-axis direction: positive.

reading of input IN_0 (e.g. '0.33') and routing to IN_CEL. The value '0.33' is written in memory M15= (POS_X='0').

there is no external control during sub-cycles P2_AMP, P2_FRE, P2_PHA and P2_FLT.

the parameters have not changed since the preceding pass.

incrementing of address POS_X to value '1' ('0'+'1'). In SC_ETR mode, the POS_X increment is constant and equal to '1' (7.32).

allocation of cell 0 to set 0.

writing of the value '35' by the inactive bit C_SCEL (8.M9) to set (8.U10, 42), the preceding value was '35'.

P4: the parameters are fixed at their value.

accumulation of POS_X on the x-axis='1'.

value accumulated during subcycle P3 at bistable 42 is written to set accumulator M7.

calculation of the amplitude (13.U12) of cell 0 at value '100'. The value of the sample of cell 0='33' (ampli '100'*value IN_0='0.33'). The value is stored in memory M13.

calculation of the amplitude of the set at the value 'maximum', which is routed to memory M8 but not stored.

set accumulator the value is not written in memory M6 because bit C_ENS is inactive (8.M9). The preceding value is retained until the last cell of set 0.

output accumulator: value of set 0=a null value.

Cell 1

P1: x-axis direction: positive.

P2_AMP cell 1 is subject only to external control of amplitude by cell 0. The value calculated in the preceding cycle of the oscillation of cell 0 (13.M13) is acquired at bistable 24. The modulation is active, i.e. the value '33'.

P3: the parameters of cell 1 have not changed since the preceding pass.

incrementing of address POS_X of cell 1='10'('0'+'10'). Note that the increment is equal to '10', 79 times out of 100 and equal to '11', 21 times out of 100 at 440 Hz.

allocation of cell 1 to set 0.

addition of the value of set 1, by the active bit C_SCEL (8.M9), to the set (B.U10, 42). The preceding values are: cell 0 ('35')+cell 1 ('134')='169'.

P4: the parameters are fixed at their value. The amplitude is added to the value of cell 0 (5.U4, M3 of 6.20A) which modulates it with the value '33'. The total value of cell 1 is therefore '100'+'33'='133'.

accumulation of POS_X on x-axis of cell 1='10'.

value accumulated in sub-cycle P3 at bistable 42 is written to the set accumulator (8.M7).

calculation of the amplitude (13.U12) of cell 1 at '133'0 {'100'ampl+'33') (cell 0 value)}.

sample value of cell 1='129'('133'* '0.97'). The value '0.97' is the value of the ramp at address 10. This value is stored in memory (13.M13).

calculation of the amplitude of the set at 'maximum'. This value is routed to memory M6, but not stored in memory.

set accumulator the value is not written in memory M6, because bit C_ENS is inactive (8.M9). The preceding value is a null value. The set has been initialized to amplitude '0' during preceding passes.

output accumulator: the value of set 0 is a null value.

Cell 2

P1: x-axis direction: positive.

P2_FRE cell 2 is subject only to external control of frequency by cell 3. The value calculated during the preceding pass of the oscillation of cell 3 (13.M13) is acquired at bistable 24. The modulation is active at the value '0'.

P3: the parameters of cell 2 have not changed since the preceding pass.

incrementing of address POS_X of cell 2='1034' ('1024'+'10'). Here also, the increment is equal to '10', 79 times out of 100 and equal to '11', 21 times out of 100 at 440 Hz).

allocation of cell 2 to set 0.

addition of the value of cell 2 by the active bit C_SCEL (8.M9) to the set (U8. U10,42). The preceding values are: cell 0 ('35')+cell 1 ('134')+cell 2 ('11')='180'.

P4: the parameters of cell 2 are fixed at their value. The frequency is added to the value of cell 3 (5.U4, M3 of 6.20B) which modulates it, here at the value '0'. The frequency of the cell is therefore '10.21' ('10.21'+'0').

accumulation of POS_X on the x-axis='1034'.

the value accumulated during sub-cycle P3 on bistable 42 is written to set accumulator M7.

calculation of amplitude (13.U12) of cell 2 at value '100'(amplitude='100'). The value of the sample of cell 1='−8', for example ('100'*sample from address 1034 which is here assumed to be equal to '−0.08'). The value is stored in memory M13.

calculation of the amplitude of set 0 at the value 'maximum'routed to memory M6, but not stored.

set accumulator: the value is not written in memory M6 because bit C_ENS is inactive (8.M9). The preceding value is zero. The set is initialized to the amplitude '0' during preceding passes.

output accumulator: the value of set 0 is a null value.

Cell 3

P1: x-axis direction: positive.

cell 3 is not subject to external control of amplitude, frequency, phase or filtering.

P3: the parameters have not changed since the preceding pass.

incrementing of address POS_X='0'('0'+'0'), the increment being equal to '0.001136', i.e. '0', 9 989 times out of 10 000 and '1', 11 times out of 10 000 at 0.5 Hz).

allocation of cell 3 to set 0.

the value of cell 3 is not added to set 0 (U8.U10, 42) because bit C_SCEL is inactive (8.M9).

P4: the parameters are fixed at their value.

the accumulation of POS_X on the x-axis='0'.

the value accumulated during sub-cycle P3 at bistable 42 is written into set accumulator M7.

calculation of amplitude (13.U12) at '250'. The value of the sample='0'('250'* the first point from the sine table, i.e. '0'). The value is stored in memory M13.

calculation of the amplitude of the set at the 'maximum'value which is routed toward memory M6.

set accumulator the value is written in memory M6 because bit C_ENS is active (8.M9). The value of addition of the cells='180', (max amplitude '0.9999'* sum of cells 0 to 2='180'.

Note that cell 3 is not added intentionally, bit C_CEL being inactivated by the CPU. The set is initialized to the 'maximum'amplitude. The bistable 42 is set to '0' initializing the system for the next passage.

output accumulator the value of set 0=180.

Third pass of cells 4 through 191 on cycles P1 through PCPU (no signal).

Fourth passage(summary)

Cell 0

P1: reading of input IN_0 (e.g.: '0.04') routed on IN_CEL. The value written in memory M15 at '0.04' (POS X='0').

P3: POS X (cell 0)−'2'('1+'1').

set 0: preceding value of cell 0='33'.

P4: value of sample of cell 0='4' (ampli '100'* value IN_0='0.04').

Cell 1

P2_AMP: cell 1 is subject to external control of amplitude by cell 0. The value of cell 0 from the preceding pass is acquired at bistable 24. The modulation is active, at value '33'.

P3: POS_X='21'('10'+'11'). (Increment='10', 79 times out of 100 and '11', 21 times out of 100 at 440 Hz).

set 0: addition of preceding values: cell 0('33')+cell 1 ('129')='162'.

P4: amplitude added to the cell value 0='8'. Total amplitude='104'('100'+'4').

value of sample of cell 1='101' ('104'*add.21 ramp= '0.95').

Cell 2

P2_FRE: cell 2 is subject to external control of frequency by cell 3. The value of cell 3 from the preceding pass is acquired at bistable 24. The modulation is active (value '0').

P3: POS_X='1045' ('1034'+'11'). (Increment='10', 79 times out of 100; '11', 21 times out of 100 at 440 Hz).

set: addition of preceding values: cell 0 ('33')+cell 1 ('129')+cell 2 ('−8')='154'.

P4: frequency added to preceding value '0' of cell 3, cell frequency '1.21'(10.21'+'0').

value of sample of cell 2='−18' ('100'* add sample 1045=example −'0.18').

Cell 3

P3: POS_X ='0'('0'+'0'). Increment='0.001136', or '0', 9 989 times out of 10 000 and '1', 11 times out of 10 000 at 0.5 Hz).

the value of cell 3 is not added, bit C_SCEL being inactive (8.M9), on the set (U8.U10,42).

P4: the value of the sample from cell 3=0(250'*first point of sine table='0').

set: bit C_ENS is active at memory M9. The total for addition of the cells='154' (sum of cells 0 to 2)*'0.9999' (max.ampl. set). Cell 3 is not added because C_CEL is inactivated by the CPU.

output accumulator: value of set 0='154'.

Fourth pass of cells 4 through 191 on cycles P1 through PCPU (no signal).

O—O—O—O—O—O—O—O—

A signal is therefore generated by the sequence of passes in cells 0 to 2. Cell 3 being at a low frequency (0.5 Hz), the effect of its modulation on the frequency of cell 2 will be equally slow, the sine oscillation of this cell will advance the address once only every 998.9 passes (or 11 times in 10000, as indicated above). To see the effect, go direct from the 999th pass to the 1001th pass.

999th pass (summary)

Cell 0

P1: read input IN_0 (e.g.: '−0.69') routed to IN_CEL. The value is written in memory M15='−0.69' (POS_X='0').

P3: POS_X='995' (994+'1'). Note that this value will be incremented up to E_B2 ('1023') and then truncated to take the value of E_B1 ('0'), the operation being cyclic.

set 0: cell 0 preceding value (example='−72')='−72'.

P4: the value of the sample of cell 0='−69' (ampli '100'* value IN_0='−0.69').

Cell 1

P2_AMP cell 1 is subject to external control of amplitude by cell 0. The value on the preceding cycle of cell 0 is acquired at bistable 24. The modulation is active, i.e. at the value '−69'.

P3: POS_X='942'('9321'+10'). (Increment='10', 79 times out of 100 and '11', 21 times out of 100 at 440 Hz). Note that this value is incremented on 10 bits ('0' to '1023').

set 0: addition of preceding values: cell 0('−72') +cell 1 {'−23': ramp ('−0.81')*('100'−'72')}='95'.

P4: the amplitude is added to the value of cell 0='−69'. Total amplitude='31'('100'−'69').

value of the sample of cell 1='−25'0 ('31'*add.942='−0.82').

Cell 2

P2_FRE: cell 2 is subject to external control of frequency by cell 3. The value of cell 3 from the preceding pass is acquired at bistable 24. The modulation is active, i.e. at the value '0'.

P3: POS_X='10159' ('10149'+'10'). (Increment='10', 79 times out of 100 and '11', 21 times out of 100 at 440 Hz). Note that this value will be incremented up to E_FIN ('89224') and then stops being incremented, the operation being non-cyclic here.

set 0 addition of preceding values: cell 0 ('−72')+cell 1 ('−23')+cell 2 (e.g.: '32')='−63'.

P4: the frequency is added to the preceding value '0' of cell 3. The frequency of the cell='10.21'('10.21'+'0').

the value of the sample of cell 2='30' ('100'*add.10159 sample=example '−0.30').

Cell 3

P3: POS_X='1'('0'+'1'). (Increment='0.001136': '0', 9989 times from 10 000 and '1', 11 times from 10 000 at 0.5 Hz.

the cell 3 value is not added, bit C_SCEL being inactive (8.M9) on the set (U8.U10,42).

P4: the value of the sample='1'('250'*second point of the null value sine table='0.006').

set: bit C_ENS is active at memory M9. The total for addition of the cell='−63' (sum of cells 0 to 2)* '0.9999' (max. ampl. set). Cell 3 is not added because C_CEL is inactivated by the CPU.

output accumulator: the value of set 0='−63'.

999th passes of cells 44 to 191 on cycles P1 to PCPU (no signal).

1000th pass (summary)

Cell 0

P1: reading of input IN_0 (e.g.: '−0.64') routed to IN_CEL. The value is written in memory M15='−0.64' (POS_X='0).

P3: POS_X='996' ('995'+'1').

set 0: cell 0 has the preceding value='−69'.

P4: the value of the sample of cell 0='−64' (ampli '100'* value IN_0='−0.64').

Cell 1

P2_AMP: cell 1 is subject to external control of amplitude by cell 0. The value during the preceding passage of cell 0 is acquired at bistable 24. The modulation is active, i.e. at the value '−69'.

P3: POS_X='953'('942'+'11').

set 0: addition of preceding values: cell 01-69') +cell 1{C-25': ramp('!0.82')*('1 00'-'69')}='-95'.

P4: the amplitude is added to the value of cell 0='−64'. Total amplitude='36' ('100'−'64').

the value of the sample of cell 1='−30' ('36'*add ramp 953=0.83').

Cell 2

P2_FRE: cell 2 is subject to external control of frequency by cell 3. The value of cell 3 from the preceding pass is acquired at bistable 24. The modulation is active, i.e. at the value '1' which is added to the frequency increment, i.e. '11'('10.21' or '10', 79 times out of 100 and '11'21 times out of 100) +'1'='12', which will be the value on the next pass. The current increment is '11'.

P3: POS_X='10170' ('10159'+'11'). (Increment='10', 79 times out of 100 and '11', 21 times out of 100 at 440 Hz).

set 0 addition of preceding values: cell 0('−69')+cell 1 ('−25')+cell 2 ('30')='−64'.

P4: the frequency is added to the preceding value '1' of cell 3. The frequency of the cell='11.21 '('10.21'+'1').

value of the sample of cell 2='24' ('1 00'*add sample 10 170 =example '0.24').

Cell 3

P3: POS_X='1'('1'+'0'). (Increment='0.001136': '0', 9989 times out of 10 000 and '1', 11 times out 10 000 at 0.5 Hz.

the value of cell 3 is not added to the set (U8.UIO,42), bit C_SCEL being inactive (8.M9).

P4: value of the sample of cell 3='1'('3250'*null value sine table second point='0.006').

set: bit C_ENS is active at memory M9. The total for the addition of the cells='−64' (sum of cells 0 to 2)* '0.9999' (max. ampl. set).

output accumulator: set 0 value='64'.

1000th passes of cells 4 to 191 on cycles P1 to PCPU (no signal).

1001th pass (summary)

Cell 0

P1: read input IN_0 (e.g.: '−0.59') routed to IN_CEL. The value is written in memory M15=−'0.59' (POS_X='0').

P3: POS_X='997' ('996'+'1').

set 0: cell 0 at preceding value='−64'.

P4: value of the sample of cell 0='−59' (ampli '100'* value IN_0='−0.59').

Cell 1

P2_AMP: cell 1 is subject to external control of amplitude by cell 0. The value on the preceding cycle of cell 0 is acquired at bistable 24, the modulation is active, i.e. at the value '−64'.

P3: POS_X='963'('953'+'10'). (Increment='10'79 times out of 100 and '11', 21 times out of 100 at 440 Hz).

set 0: addition of preceding values: cell 0 ('64')+cell 1 ('−30': ramp{−'0.83')*('100'−'64')}='−94'.

P4: the amplitude is added to the value of cell 0='−59'. The total amplitude='41' ('100'−'59')

the value of the sample of cell 1='−34' ('41'*add.963 ramp='0.84').

Cell 2

P2_FRE: cell 2 is subject to external control of frequency by cell 3. The value of cell 3 from the preceding pass is acquired at bistable 24. The modulation is active, i.e. at the value '1'. This value is added to the frequency increment, i.e. '10'('10.21 '11', 21 times out of 100)+'1'='11', value on next pass. The current increment is '11'.

P3: POS_X='10181' ('10170'+'11'). (Increment='10', 79 times out of 100 and '11', 21 times out of 100 at 440 Hz).

set 0 addition of preceding values: cell 0 ('−64')+cell 1 ('−29')+cell 2 ('24')='−71'.

P4: the frequency is added to the preceding value '1' of cell 3. The frequency of the cell='11.21 '('10.21'+'1').

value of the sample of cell 2='21' ('100'*add.10181 sample=example '−0.21').

Cell 3

P3: POS_X='1'('1'+'0'). (Increment='0.001136': '0', 9989 times out of 10 000 and '1', 11 times out of 10 000 at 0.5 Hz).

the value of cell 3 is not added to the set (U8. U10,42), bit C_CSEL being inactive at M9.

P4: the value of the sample of cell 3='1'('250'*null value sine table second point='0.006').

set 0: bit C_ENS is active at M9. The total of addition of the cells='−63' (sum of cell 0 to 2)* '0.9999' (max. ampl. set).

output accumulator: value of set 0='−71'.

1001th passes of cells 4 to 191 on cycles P1 to PCPU (no signal).

The signal will therefore be generated by the sequence of passes on cells 0 to 2. Cell 3 being at low frequency (0.5 Hz), the effect of its modulation on the frequency of cell 2 will be felt more slowly, the increment of cell 2 (base '10.21') tracks the slow evolution of the sine of cell 3 ('10.21'+'1' on passes 1001 to 1998, '10.21'+'3' on passes 1999 to 2996, '10.21'+'4'on passes 2997 to 3994, '10.21'+'6' on passes 3995 to 4991, etc).

There is claimed:

1. A system for synthesizing a series of electronic samples for producing a sound spectrum appearing at an output, said system comprising:

first means for determining a succession of working cycles timed in accordance with a sampling frequency;

at least one source of zero level samples representing at least one sound signal and adapted to provide in each working cycle x in progress at least one zero level sample, second means for determining, for each of said zero level samples to be selected during a next working cycle x+1, a first value of a frequency parameter appropriate to that sample, third means for determining, for each of said zero level samples to be processed during a next working cycle x+1, at least one second value of at least one other parameter, also appropriate to that sample, at least two parameters memories for respectively memorizing said first and second parameter values during the current working cycle x at n respective memory locations so that said values can be used during the next working cycle x+1, fourth means for determining during each current working cycle and as a function of each of the n frequency parameter values stored during the preceding working cycle x−1, a designation value for designating among said zero level samples the zero level sample(s) which during the next working cycle x+1 will contribute to producing n respective first level samples, a designation value memory for storing said n designation values determined during the current working cycle x so that they can be used during the next working cycle x+1, fifth means for applying to each of the zero level samples designated during the preceding working cycle, during the current working cycle x, the corresponding value of said other parameter stored during the preceding working cycle x−1, to form n current first level samples and to store them in n respective locations of an accumulation memory, and sixth means for transferring to said output during the current working cycle x the n first level samples stored in memory during the preceding working cycle x−1, the n memory locations of said parameter memories, said designation value memory and said accumulation memory respectively providing n cells whose content can be modified from one working cycle to the other.

2. The synthesizer system claimed in claim 1 wherein said first, second, third, fourth, fifth and sixth means are used on a timesharing basis during successive working cycles to determine the values relating to said cells in said parameter, designation value and accumulation memories.

3. A synthesizer system as claimed in claim 1 further comprising a control unit connected to said second, third, fourth, fifth and sixth means to manage operating values thereof in accordance with software executed by said control unit.

4. The synthesizer system claimed in claim 3 wherein said operating values are initial values of said parameters andlor increment values of the parameters, said initial and increment values being determined by said software.

5. The synthesizer system claimed in claim 1 wherein said first means are adapted to determine successively, during each of said cycles, n sub-cycles of control signals respectively assigned to said n cells, the control signals of each of the sub-cycles being intended, on the one hand, to activate during the current working cycle x calculation operations for determining said first and second parameter values of the corresponding cell and, on the other hand, for each of said memories, to enable reading/writing in said n memory locations of data resulting from the determination of said values, said data forming the respective contents of said n cells used during the next working cycle x+1.

6. The synthesizer system claimed in claim 5 when dependent on claim 3 or claim 4 wherein each of said control signal sub-cycles also comprises a control signal for authorizing said control unit to communicate with said first, second, third, fourth, fifth and sixth means.

7. The synthesizer system claimed in claim 5 wherein said second means execute a calculation function of the form:

$$PAR_{Pn} = \left[\frac{(PAR_{Pn} - PAR_{Pn-1})}{INC_{Pn}}\right] + PAR_{Pn-1}$$

in which $PAR_{Pn}$ is the current frequency parameter value of the cell concerned during said current sub-cycle or the initial value of the frequency parameter, $PAR_{Pn-1}$ is the frequency parameter value produced during the preceding sub-cycle for that cell and $INC_{Pn}$ is the increment to the current frequency parameter value vis-à-vis the preceding value.

8. The synthesizer system according to claim 5 wherein said third means execute a calculation function of the form:

$$PAR_{Pn} = \left[\frac{(PAR_{Pn} - PAR_{Pn-1})}{INC_{Pn}}\right] + PAR_{Pn-1}$$

in which $PAR_{Pn}$ is the current value of one of said other parameters of the cell concerned during said current sub-cycle or the initial value of said other parameter, $PAR_{Pn-1}$ is the value of said other parameter produced during the preceding sub-cycle for said cell and $INC_{Pn}$ is the increment to the current value of said other parameter vis-à-vis the preceding value.

9. The synthesizer system according to claim 7 wherein said second and/or third means comprise an initial value memory adapted to contain said initial parameter value and an increment memory adapted to contain said parameter increment value for each of said cells.

10. The synthesizer system claimed in claim 7 wherein said third means comprise a circuit for calculating at least one of said other parameters which is identical to the circuit of said second means for calculating said frequency parameter.

11. The synthesizer system claimed in claim 1 wherein said fourth means comprise a first calculation unit for algebraically combining said frequency parameter value of the current working cycle with a value representing the fundamental frequency of the sound to be synthesized, to which the first level sample calculated during the current cycle contributes, a second calculation unit for algebraically combining the result supplied by said first calculation unit with the current content of the location of said designation value memory corresponding to the cell processed during the current working cycle, and seventh means for replacing at that location the designation value calculated during the preceding working cycle with the result of the calculation carried out during the current working cycle by said second calculation unit.

12. The synthesizer system claimed in claim 11 wherein said fourth means also comprise a multiplexer whose output is connected to said second unit, one of whose inputs receives the result of the calculation from said first calculation unit, and whose other input receives a progression signal of fixed value, in particular '0001' for progressing said designation value by said fixed value from one working cycle to the other under the control of a mode signal.

13. The synthesizer system claimed in claim 11 wherein said fourth means also comprise a third calculation unit for algebraically combining the result of the calculation of said second calculation unit with the current value of one of said other parameters representing the phase to be applied to the first level sample generated during the next working cycle x+1.

14. The synthesizer system claimed in claim 11 wherein said fourth means also comprise eighth means for assigning the positive or negative sign to the result of the calculation obtained in said first calculation unit.

15. The synthesizer system claimed in claim 1 wherein at least some of said sources comprise a zero level sample memory and said designation value is used to address said zero level sample memory.

16. The synthesizer system claimed in claim 15 wherein a first zero level sample memory is a sine table.

17. The synthesizer system claimed in claim 15 wherein a second zero level sample memory is adapted to store at least one sampled sound sequence whose successive samples constitute said zero level samples.

18. The synthesizer system claimed in claim 17 when dependent on claim 3 wherein said second zero level sample memory is connected so that it can be loaded by said control unit, optionally via said software.

19. The synthesizer system claimed in claim 1 wherein at least some of said sources comprise a function generator and said designation value is used as a designation value or as an address for identifying the equations of said function to be used.

20. The synthesizer system claimed in claim 19 wherein said function generator is chosen from the group comprising a square function generator, a triangular function generator andlor a positive and/or negative ramp generator.

21. A synthesizer system as claimed in claim 1 comprising as a source of zero level samples a random noise generator supplying samples at the rate of said sampling frequency.

22. The synthesizer system claimed in claim 17 wherein said second zero level sample memory is connected so that it can store, as zero level samples, first level samples calculated and stored in at least one cell during at least one earlier working cycle.

23. A synthesizer system as claimed in claim 22 further comprising ninth means for preparing zero level samples from at least one input of the synthesizer system to which a sound spectrum is applied from an external source and said ninth means are connected to said second sample memory to enable storage of said zero level samples from said inputs.

24. A synthesizer system as claimed in claim 23 comprising tenth means connected to said at least one input for analyzing the sound spectrum of said external source and deriving therefrom parameter values which can be used to modify the parameter or parameters determined by said second and third means.

25. A synthesizer system as claimed in claim 1 comprising tenth means for determining which of said zero level sample sources is used to generate, during each of said working cycles, the first level sample of each of said cells.

26. The synthesizer system claimed in claim 1 wherein said sixth means comprise eleventh means for distributing, during the current working cycle, the first level samples of said cells generating during a preceding working cycle to m memory locations of a second accumulation memory, the locations of that second accumulation memory providing m sets the content of which can vary from one working cycle to the other, and the content of each of said m locations is selectively transferred to said output as a second level sample during the current working cycle.

27. A synthesizer system as claimed in claim 26 wherein said source comprises a plurality of distinct outputs and further comprising twelfth means for selectively distributing the content of the memory locations of said second accumulabon memory to said distinct outputs as third level samples.

28. The synthesizer system claimed in claim 11 comprising thirteenth means for determining for said designation value limits between which that value can evolve during a particular series of successive working cycles.

29. The synthesizer system claimed in claim 28 wherein said thirteenth means are adapted to evaluate said designation values cyclically between said limits, i.e. from the first limit to the second limit, cyclically from the second limit to the first limit and/or cyclically in a loop from the first limit to the second limit and then conversely from said second limit to said first limit.

30. The synthesizer system claimed in claim 3 wherein said operating values are selectively stored in a plurality of memories comprising n locations by said control unit respectively belonging to the second, third, fourth, fifth and sixth means, as a function of said software.

31. The synthesizer system claimed in claim 1 wherein said third means include fourteenth means for applying at least one filter coefficient to at least some of the first level samples generated during at least some of said working cycles.

* * * * *